US006344869B2

(12) United States Patent
Sasaki et al.

(10) Patent No.: US 6,344,869 B2
(45) Date of Patent: Feb. 5, 2002

(54) THERMAL PRINTER, THERMAL PRINTING METHOD AND CONVEYOR FOR RECORDING MATERIAL

(75) Inventors: Hidemi Sasaki; Naoki Takatori; Satoru Goto, all of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/888,508

(22) Filed: Jun. 26, 2001

Related U.S. Application Data

(62) Division of application No. 09/018,446, filed on Feb. 4, 1998.

(30) Foreign Application Priority Data

| | | |
|---|---|---|
| Jan. 7, 1997 | (JP) | 9-025163 |
| Feb. 5, 1997 | (JP) | 9-022478 |
| Feb. 6, 1997 | (JP) | 9-023495 |
| Feb. 6, 1997 | (JP) | 9-023920 |
| Feb. 24, 1997 | (JP) | 9-039535 |

(51) Int. Cl.[7] ..... B41J 2/32
(52) U.S. Cl. ..... 347/222; 347/175
(58) Field of Search ..... 347/175, 222; 400/120.03, 691

(56) References Cited

U.S. PATENT DOCUMENTS

| | | | |
|---|---|---|---|
| 4,734,704 | A | 3/1988 | Mizutani et al. |
| 5,268,707 | A | 12/1993 | Katsuma et al. |
| 5,410,335 | A | 4/1995 | Sawano et al. |
| 5,565,903 | A | 10/1996 | Ueda |
| 5,585,832 | A | 12/1996 | Orimoto et al. |
| 6,037,961 | A | 3/2000 | Saito et al. |

FOREIGN PATENT DOCUMENTS

| | | |
|---|---|---|
| EP | 04308788 | 10/1992 |
| EP | 0622243 A2 | 11/1994 |
| EP | 08238785 | 9/1996 |
| JP | 06040062 | 2/1994 |
| JP | 8112921 | 5/1996 |
| JP | 8156299 A | 6/1996 |

OTHER PUBLICATIONS

EP 98 30 778—Partial European Search Report—Apr. 2, 1998.

Greer, W.M., "Heat–Exchanger Concept for Typewriters and Desk Top Equipment", IBM Technical Disclosure Bulletin, vol. 24, No. 7B, pp. 3966–3967, Dec. 1981.

*Primary Examiner*—Huan Tran

(57) ABSTRACT

A color thermal printer a conveyor for conveying a color thermosensitive recording sheet along a conveying path. A thermal head thermally records a full-color image to the recording sheet being conveyed. A fixer lamp applies ultra-violet rays of a predetermined range of wavelength to the recording sheet being conveyed, for optically fixing the recording sheet. In the thermal printer, a printer casing has a small height, and includes a front panel oriented vertically. An insertion opening in the front panel is adapted to insertion of the recording sheet before the recording, and ejection of the recording sheet after the recording. An air inlet and an air outlet are formed in the front panel. The insertion opening is disposed between the air inlet and the air outlet. An air passageway is disposed in the printer casing, and communicates from the air inlet to the air outlet via at least a portion of the conveying path. A fan unit is disposed in the air passageway, and causes air from the air inlet to flow along the air passageway, to cause heat generated in the printer casing to exit from the air outlet.

16 Claims, 34 Drawing Sheets

THERMAL PRINTER, THERMAL PRINTING METHOD AND CONVEYOR FOR RECORDING MATERIAL

This application is a divisional of co-pending application Ser. No. 09/018,446, filed on Feb. 4, 1998, the entire contents of which are hereby incorporated by reference and for which priority is claimed under 35 U.S.C. §120; and this application claims priority of Application No. 9-22478 filed in Japan on Feb. 5, 1997, Application No. 9-23495 filed in Japan on Feb. 6, 1997, Application No. 9-23920, filed in Japan on Feb. 6, 1997, Application No. 9-25163, filed in Japan on Feb. 7, 1997, and Application No. 9-39535 filed in Japan on Feb. 24, 1997 under 35 U.S.C. §119.

BACKGROUND OF THE INVENTION

1. Field of the Invention

The present invention relates to a thermal printer, a thermal printing method and a conveyor for recording material. More particularly, the present invention relates to a thermal printer which can be easily combined with a personal computer, a video player or the like, and a thermal printing method and a conveyor for recording material used with the thermal printer.

2. Description Related to the Prior Art

A tower type of personal computer has been recently used widely. The personal computer of this type has a feature of high extensibility, and includes a plurality of so-called bays, or spaces for setting respective relevant devices such as a flexible disk (FD) drive device, a hard disk device, a compact disk (CD) drive device and an MO drive device. Each bay can contain such a peripheral unit which is approximately 146 mm wide, 41 mm high, and 220 mm deep.

There is another suggestion of the personal computer in which a scanner is set in the bay with intention of extension, the scanner previously having been connected externally to a computer in a conventional manner. With the scanner or other peripheral units incorporated in the body of the personal computer, convenience and ease in use of them is increased. There is no need of externally connecting operation. Furthermore peripheral units to be installed do not require installing spaces in a room, although such are still required by external peripheral units.

It is conceived to combine a color printer with the personal computer of the tower type as one of the peripheral units, because the color printer will be usable with high frequency and much convenience. However there is no color printer which could be mounted in the bay of the personal computer, because the color printer in the prior art is too large and cannot be constructed in a small size suitable to the bay.

There is a color thermal printer of a sublimation type or wax transfer type, which is used with ink ribbon. The ink ribbon is wound in a roll form, which inevitably has a size of 25–30 mm at the minimum. It is impossible to construct the printer with a thickness equal to or less than 41 mm. Moreover the ink ribbon, when used up, must be renewed. If the bay contained the color thermal printer of this type, the entirety of the printer must be pulled out and opened for the purpose of renewal of the ink ribbon.

There is no ink jet printer which would be mounted in the bay of the personal computer, because sizes of an ink tank and a recording head of an ink jet printer cannot be reduced and are inconsistent to the smallness of the bay. The ink jet printer has a mechanical system of a serial printer, and also requires a mechanism for moving the recording head. Also the ink jet printer must be supplied with ink periodically. A body of the ink jet printer must be drawn and opened before the ink can be supplied. Both the head moving mechanism and supply of ink cause problems in failure of obtaining compactness of the body.

Among various types of color printers, there is a color thermal printer in which color thermosensitive recording material of direct thermal recording is heated to develop color by itself. The color thermal printer does not use ink ribbon, ink or other expendable material, and does not need to be open for the purpose of supplying anything expendable. Therefore this type of the color thermal printer has suitability to being contained in the bay of the personal computer.

The recording material includes a support, and a cyan thermosensitive coloring layer, a magenta thermosensitive coloring layer, and a yellow thermosensitive coloring layer, all of which are overlaid on the support. Among the three layers, the yellow coloring layer, which lies the farthest from the support, has the highest heat sensitivity. In the color thermal printer, a thermal head is pressed against the recording material, to print a yellow image to the yellow coloring layer line by line at first. Then a yellow fixer applies ultraviolet rays to the yellow coloring layer to fix the yellow image. The thermal head prints a magenta image to the magenta coloring layer next. A magenta fixer applies ultraviolet rays to the magenta coloring layer to fix the magenta image. Finally the thermal head prints a cyan image to the cyan coloring layer, so as to obtain a full-color image.

The thermal recording and the fixation are effected while the recording material is conveyed in a manner relative to the thermal head and the fixer unit. An example of various structures for conveying the recording material is a back-and-forth moving structure. The color thermal printer with this structure includes a recording material conveyor device or a conveyor roller set, which is constituted by a capstan roller and a pinch roller. The capstan roller is driven by a motor to rotate. The pinch roller has a diameter smaller than that of the capstan roller. The conveyor roller set nips the recording material and conveys it back and forth, while the thermal head pressurizes and heats the recording material to develop the three colors sequentially, that are yellow, magenta and cyan.

However there is no known color thermal printer which would be mounted in the bay of the personal computer, because of considerable largeness of parts and components in a color thermal printer and a large space required for their arrangement. For the three coloring layers, temperature at which each coloring layer starts being colored is different. Therefore the color thermal printer of the direct recording type inevitably has the maximum heating temperature higher than that of a wax transfer type of thermal printer, in which the temperature at which each coloring layer starts being colored is equal between the coloring layers. In the direct recording type, generated heat is considerably much due to the heating temperature. The problem of considerable generated heat should be solved in mounting the color thermal printer in the bay of the personal computer, in addition to the dimensional problems of the color thermal printer and its parts.

SUMMARY OF THE INVENTION

In view of the foregoing problems, an object of the present invention is to provide a thermal printer having a sufficiently small size and easily combined with a personal computer, a video player or the like, and a thermal printing method and a conveyor for recording material used with the thermal printer.

Another object of the present invention is to provide a thermal printer in which generated heat can be removed in an effective manner, and a thermal printing method and a conveyor for recording material used with the thermal printer.

Still another object of the present invention is to provide a thermal printer in which a fixer lamp can be easily removed and secured inside a printer casing, and a thermal printing method and a conveyor for recording material used with the thermal printer.

Another object of the present invention is to provide a thermal printer in which ranges of two margins upstream and downstream from a printing area on a recording material can be determined in an apparently suitable manner, and a thermal printing method and a conveyor for recording material used with the thermal printer.

A further object of the present invention is to provide a thermal printer capable of reducing influence of ambient light to a recording material being optically fixable, to protect its coloring ability of coloring layers, and a thermal printing method and a conveyor for recording material used with the thermal printer.

Another object of the present invention is to provide a thermal printer in which structural failure in a recording material conveyor is avoided, to prevent failure in registering the three colors and irregularity in conveying the recording sheet, and a thermal printing method and the conveyor for recording material used with the thermal printer.

In order to achieve the above and other objects and advantages of this invention, a thermal printer for recording an image to thermosensitive recording material, includes a conveyor for conveying the recording material along a conveying path, a thermal head for thermally recording the image to the recording material being conveyed, and a fixer lamp for applying electromagnetic rays of a predetermined range of wavelength to the recording material being conveyed, for optically fixing the recording material. In the thermal printer, a printer casing has a box shape of which a height is small, and includes a front face oriented substantially vertically to a direction of the height, and a rear face opposite to the front face. An insertion opening is formed in the front face, and adapted to insertion of the recording material therethrough before the recording, and ejection of the recording material therethrough after the recording. An air inlet and an air outlet are formed in the front face, the insertion opening being disposed between the air inlet and the air outlet. An air passageway is disposed in the printer casing, for communicating from the air inlet to the air outlet via at least a portion of the conveying path. A fan unit is disposed in the air passageway, for causing air from the air inlet to flow along the air passageway, to cause heat generated in the printer casing to exit from the air outlet.

Moreover, a partition is disposed to extend along the conveying path, for defining first and second portions of the air passageway on respective sides thereof by partitioning an inside of the printer casing, the first portion extending from the air inlet, and the second portion communicating with the first portion at an edge of the partition, and extending to the air outlet.

Consequently in the thermal printer, generated heat can be removed in an effective manner. The thermal printer can have a sufficiently small size and easily combined with a personal computer, a video player or the like.

In a preferred embodiment, a driver circuit drives the fixer lamp. There is a printed circuit board on which the driver circuit is mounted, and to which the fixer lamp is secured.

Consequently the fixer lamp can be easily removed and secured inside a printer casing.

In another preferred embodiment, a conveyor roller set includes first and second rollers, for nipping the recording material and for rotating, to convey the recording material along a conveying path in a first direction and a second direction reverse to the first direction. A fixer unit emits electromagnetic rays to fix the recording material while the recording material is conveyed, wherein the first roller is disposed between the fixer unit and the recording material, and the fixer unit applies the electromagnetic rays to the recording material through upstream and downstream spaces adjacent to the first roller.

Consequently ranges of two margins upstream and downstream from a printing area on a recording material can be determined in an apparently suitable manner.

In still another preferred embodiment, the recording material includes a support, and at least first, second and third thermosensitive coloring layers, overlaid on the support, for developing respective colors being different from one another, wherein the first coloring layer is disposed at a recording surface, the third coloring layer is disposed most deeply from the recording surface, and the first and second coloring layers have fixability to electromagnetic rays of respectively first and second ranges of wavelength. The thermal printer includes a printer casing. A conveyor is disposed in the printer casing, for conveying the recording material along a conveying path. A thermal head is disposed under the conveying path, confronted with the recording surface of the recording material directed downwards, for heating the at least first, second and third coloring layers serially to develop the colors while the recording material is conveyed, for effecting thermal recording of the fullcolor image in a frame-sequential manner. A fixer is disposed under the conveying path, confronted with the recording surface, for emitting electromagnetic rays of first and second ranges of wavelength, to fix the first and second coloring layers optically.

Consequently the thermal printer is capable of reducing influence of ambient light to a recording material being optically fixable, to protect its coloring ability of coloring layers In another preferred embodiment, a recording material conveyor device for conveying recording material, includes a motor. A capstan roller is rotated by the motor. A rotatable pinch roller is disposed in a manner confronted with the capstan roller, for nipping the recording material between the pinch roller and the capstan roller. A pinch roller supporter supports the pinch roller in a shiftable manner in a direction crosswise to a rotational axis of the pinch roller, wherein the pinch roller, before nipping the recording material, is set in a first position with a smaller distance to the capstan roller than a thickness of the recording material, and when nipping the recording material, is set back from the first position.

Consequently structural failure in a recording material conveyor is avoided, to prevent failure in registering the three colors and irregularity in conveying the recording sheet.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
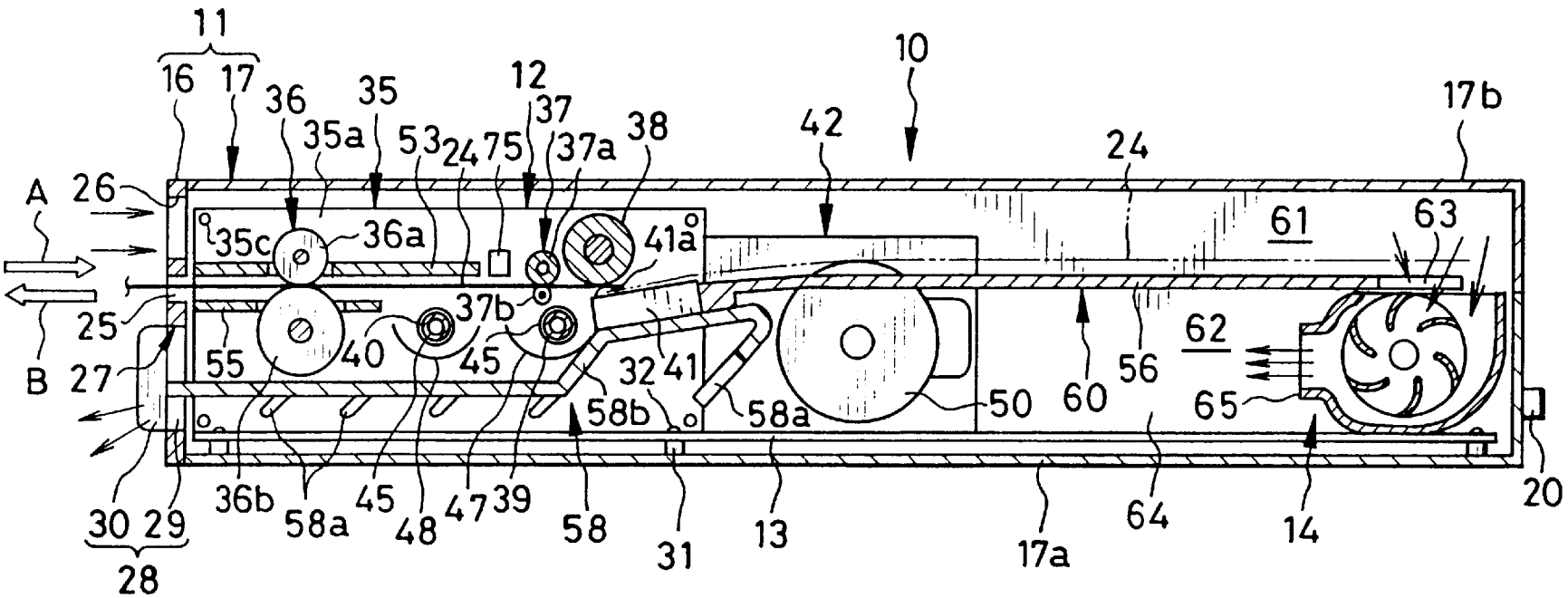
FIG. 1 is a vertical section illustrating a color thermal printer.

In FIG. 1, a color thermal printer 10 is illustrated in section. The thermal printer 10 is constituted by a printer casing 11, a printing unit 12, a printed circuit board 13 and a heat remover unit or cooler unit 14.

Figure 2:
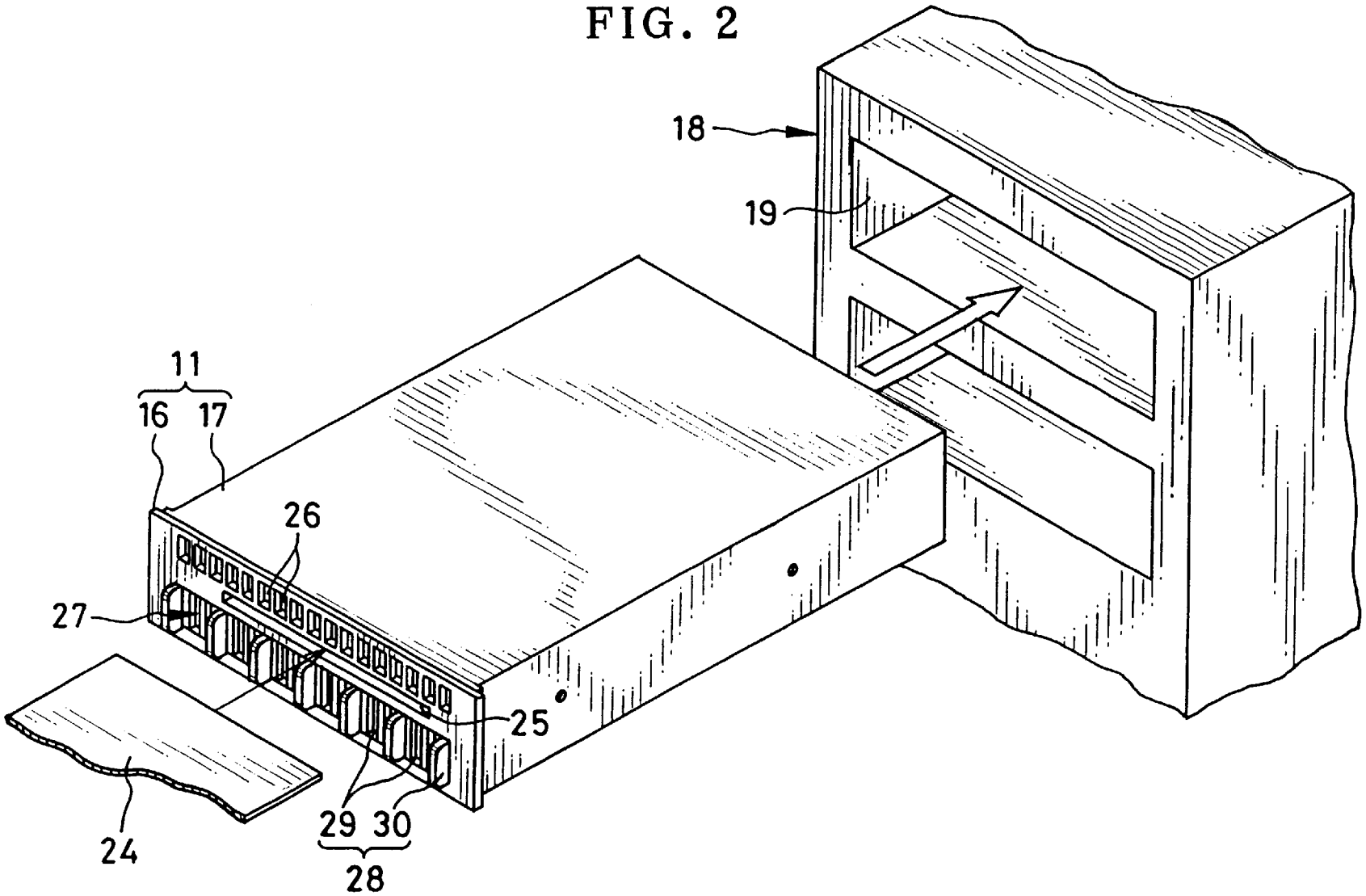
FIG. 2 is a perspective illustrating the thermal printer and a personal computer of a tower type.

In FIG. 2, the printer casing 11 is constituted by a casing component 17 and a front panel 16, and generally has a shape of a box or rectangular parallelepiped and with a small thickness. There are screws (not shown) which secure the front panel 16 to the casing component 17. The casing component 17 has a shape and size suitable to be mounted in a bay 19 of a personal computer 18 of a tower type. In the present embodiment the casing component 17 is 146 mm wide, 41 mm high, and 220 mm deep.

In FIG. 1, the casing component 17 is constituted by lower and upper casing halves 17*a* and 17*b*, which make it easy to incorporate the printing unit 12, the printed circuit board 13 and the heat remover unit 14. The rear of the printer casing 11 has a connector 20. When the thermal printer 10 is mounted in the bay 19 of FIG. 2, the connector 20 is connected with a connector included in the personal computer 18, so that the printer can be supplied with electric power, and can send and receive data including control data and image data. Note that the casing component 17 may be formed as a box with a lid without splitting into the casing halves 17*a* and 17*b*.

In FIG. 2, the front panel 16 has an insertion opening 25 formed in the center to extend horizontally, and adapted to insertion of color thermosensitive recording material or sheet 24. The insertion opening 25 lies offset to the right as viewed in the front. As will be described later, an internal conveying path or passageway in connection with the insertion opening 25 is offset to the right for the purpose of simplifying construction of the apparatus. Also a space for accommodating a drive unit 42 is maintained inside the printer casing 11 by offsetting the insertion opening 25.

The recording sheet 24, as is well known in the art, includes a support, and a cyan thermosensitive coloring layer, a magenta thermosensitive coloring layer, and a yellow thermosensitive coloring layer, all of which are overlaid on the support. Among the three layers, the yellow coloring layer, which lies the farthest from the support, has the highest heat sensitivity. The yellow coloring layer and the magenta coloring layer have characteristics of optical fixability to ultraviolet rays of wavelength ranges respectively peaking at 420 nm and 365 nm. When each of the coloring layers is optically fixed, its ability to develop the associated color is destroyed.

There an air inlet 26 and an air outlet 27 formed in the front panel 16. The air inlet 26 is located above the insertion opening 25. The air outlet 27 is located below the insertion opening 25. The air inlet 26 includes plural vertical slits arranged horizontally at a regular pitch. The air outlet 27 is constituted by plural openings being relatively great, rectangular, arranged horizontally. In the air outlet 27 is disposed a heat remover 28, which is constituted by an extension of a securing bracket 58. To be precise, the heat remover 28 includes air outlet slits or air sub-outlets 29 and heat dissipator fins 30, which are arranged horizontally at regular pitches.

In FIG. 1, the printed circuit board 13 is secured to a bottom inner face of the printer casing 11 by securing bosses 31 and securing screws 32 in combination. The printing unit 12 is secured to the printed circuit board 13 by securing screws (not shown) in a unified manner. Circuits for controlling relevant components are included in the printed circuit board 13. There are integrated circuits (IC), transistors, resistors, capacitors and the like, which are mounted on the printed circuit board 13 for incorporating the circuits. The printed circuit board 13 has a greater thickness than that used conventionally and is resistant to flexing force, because the printing unit 12 is secured to it.

The printing unit 12 is a unit constituted by a chassis 35 containing a supply roller set 36, a conveyor roller set 37, a platen roller 38, yellow and magenta fixer lamps 39 and 40 in an optical fixer unit, a thermal head 41, and the drive unit 42, all of which are arranged in the chassis 35.

Figure 3:
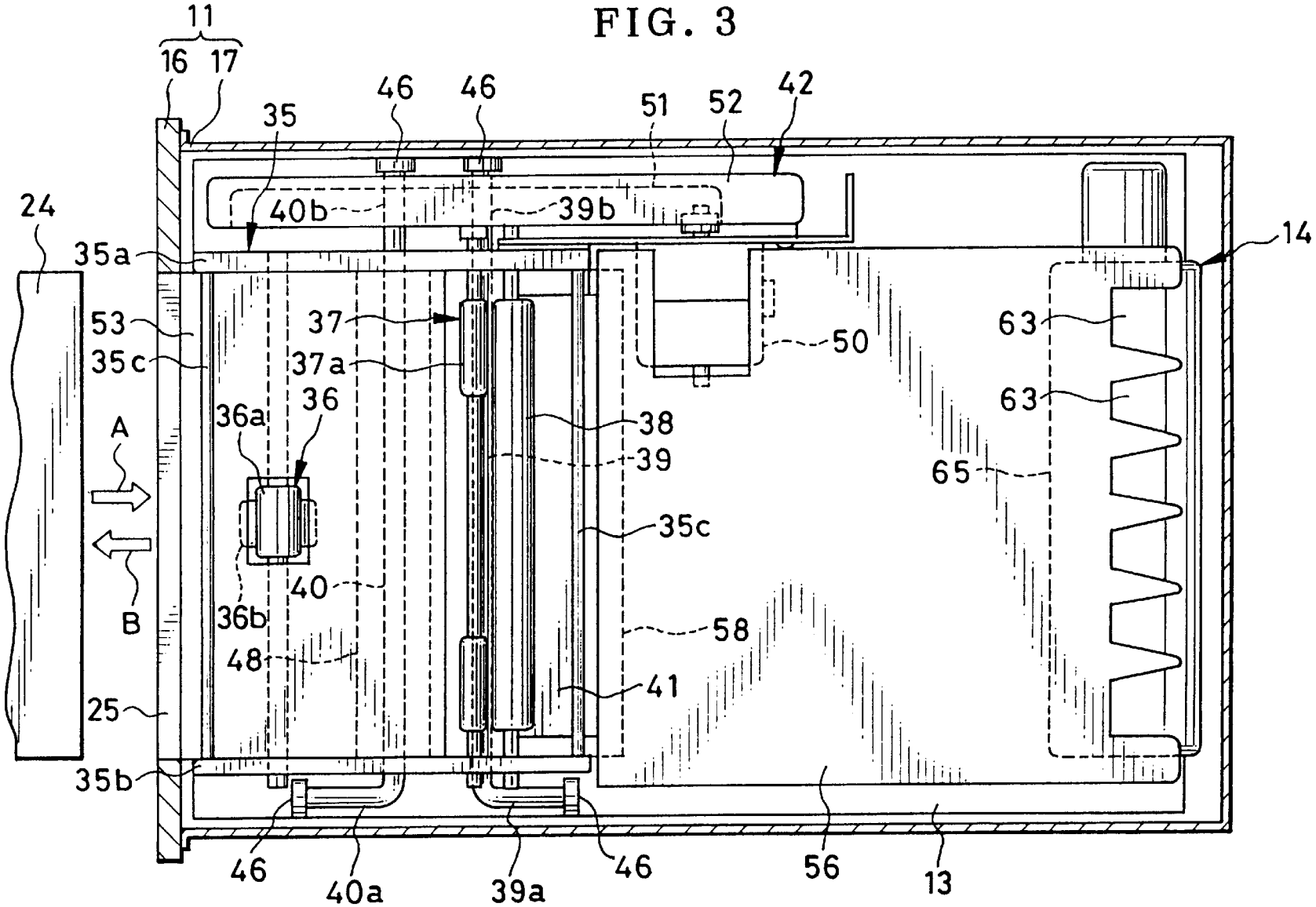
FIG. 3 is a top plan illustrating the thermal printer of which the top is open.

In FIG. 3, the chassis 35 is constituted by lateral plates 35*a* and 35*b* and a stay 35*c* for connecting them. Between the lateral plates 35*a* and 35*b* are disposed the supply roller set 36, the conveyor roller set 37 and the platen roller 38 and the thermal head 41. An interval between the lateral plates 35*a* and 35*b* is slightly greater than a width of the recording sheet 24, so that the lateral plates 35*a* and 35*b* guide lateral edges of the recording sheet 24.

In FIG. 1, lamp securing holes 45 are formed in the lateral plates 35*a* and 35*b*. The fixer lamps 39 and 40 are inserted in the lamp securing holes 45 to secure them to the lateral plates 35*a* and 35*b*. In FIG. 3, sockets 46 are disposed on ends of the fixer lamps 39 and 40. The sockets 46 are connected to the printed circuit board 13 by use of codes and connectors. In FIG. 1, reflectors 47 and 48 are associated with the fixer lamps 39 and 40, and reflect rays from the fixer lamps 39 and 40 toward the recording sheet 24 in such a manner that rays are efficiently applied to the recording sheet 24.

The yellow fixer lamp 39 is adapted to the yellow color, emits near ultraviolet rays being visible in a wavelength range peaking at 420 nm, and applies the rays to the recording sheet 24 to fix the yellow coloring layer, which is prevented from further developing the yellow color in the course of the magenta recording. The magenta fixer lamp 40 is adapted to the magenta color, emits ultraviolet rays in a wavelength range peaking at 365 nm, and applies the rays to the recording sheet 24 to fix the magenta coloring layer, which is prevented from further developing the magenta color in the course of the cyan recording. In FIG. 3, the fixer lamps 39 and 40 have a long tubular shape with a small diameter. Their middle portions between lamp ends 39*a*, 39*b*, 40*a* and 40*b* have a feature of emitting rays at a uniform amount. In each of the lamp ends 39*a*, 39*b*, 40*a* and 40*b*, rays are emitted only at a decreased amount. The lateral plates 35*a* and 35*b* are disposed in positions for separating those middle portions from the lamp ends 39*a*, 39*b*, 40*a* and 40*b*. The lamp ends 39*a* and 40*a* are bent at angle of 90 degrees, for the purpose of preventing a width of the thermal printer from being great due to them which emits only rays at the smaller amount.

The lamp ends 39*b* and 40*b* of the fixer lamps 39 and 40 are straight without bends. A space adjacent to the lamp ends 39*b* and 40*b* with a reduced amount of rays contains the drive unit 42. The drive unit 42 is disposed on the outside of the lateral plate 35*a*. The drive unit 42 is constituted by a stepping motor 50, a gear train 51 as a transmission, and a cover 52. The gear train 51 transmits rotation of the stepping motor 50 to the supply roller set 36, the conveyor roller set 37 and the platen roller 38 in such a manner as to keep constant the peripheral speeds of the supply roller set 36, the conveyor roller set 37 and the platen roller 38. The supply roller set 36, the conveyor roller set 37 and the platen roller 38 rotate in either of a supply direction A and a printing direction B indicated in FIGS. 1 and 3.

In FIG. 1, the supply roller set 36 is constituted by a drive roller 36*a* and a push roller 36*b*. The conveyor roller set 37 is constituted by a capstan roller 37*a* and a pinch roller 37*b*. Inside the chassis 35 are disposed an upper front guide plate 53, a lower front guide plate 55 and a rear guide plate 56, all of which guides the recording sheet 24 toward the supply roller set 36, the conveyor roller set 37, the platen roller 38 and the thermal head 41.

In FIG. 1, the thermal head 41 is secured to the lateral plates 35*a* and 35*b* via the securing bracket 58. The platen roller 38 is caused by a lifter mechanism 59 to shift between a push position and a retracted position. See FIG. 4. The platen roller 38, when in the push position, causes heating element array 41*a* of the thermal head 41 to push the recording sheet 24. The heating element array 41*a* includes a great number of heating elements arranged in parallel with an axial direction of the platen roller 38. In the thermal recording the heating elements are driven in accordance with image data, to record a full-color image in a three-color frame-sequential manner.

In FIG. 1, the securing bracket 58 operates as a heat dissipator of the thermal head 41. The securing bracket 58 is arranged along the conveying path of the recording sheet 24, is extended under it, and includes heat dissipator fins 58*a*, which protrude from it and are arranged at a certain interval. A distal end of the securing bracket 58 is located near to the air outlet 27, to constitute the heat remover 28. Note that it is possible to form an opening in a stepped portion 58*b* of the securing bracket 58, for the purpose of flow of air from a fan unit 65 toward the fixer lamps 39 and 40.

A partition 60 is constituted by a combination of the front guide plates 53 and 55, the securing bracket 58 and the rear guide plate 56. The partition 60 splits the inside of the printer casing 11 into an upper portion or chamber 61 and a lower portion or chamber 62. A suitable number of gaps 63 with an edge are defined at an end of the rear guide plate 56, to communicate the upper chamber 61 with the lower chamber 62. An air passageway 64 including the chambers 61 and 62 is defined by a combination of the partition 60 and the gaps 63 in a channel shape inside the printer casing 11. Note that the gaps 63 may have any suitable shapes such as openings, holes, slots and the like.

The fan unit 65 is disposed under the rear guide plate 56 at the gaps 63. The fan unit 65 is fixedly secured to the printed circuit board 13. The fan unit 65 is a type called a cross flow fan which has a cage shape, and takes in air through the air inlet 26, and exhausts the air through the air outlet 27 to the outside of the casing. Thus the heat from the thermal head 41 is dissipated by the heat remover 28 and the heat dissipator fins 58*a* of the securing bracket 58. The heat remover unit 14 consists of a combination of the air inlet 26, the partition 60, the fan unit 65, the securing bracket 58 and the air outlet 27.

Note that the cross flow fan for the fan unit 65 consists of a housing and a cage-shaped rotor or impeller. The cage-shaped rotor or impeller includes a number of long blades arranged in a cylindrical manner, and is rotatable about a shaft, which is extended crosswise to the conveying direction of the recording sheet 24.

Figure 4:
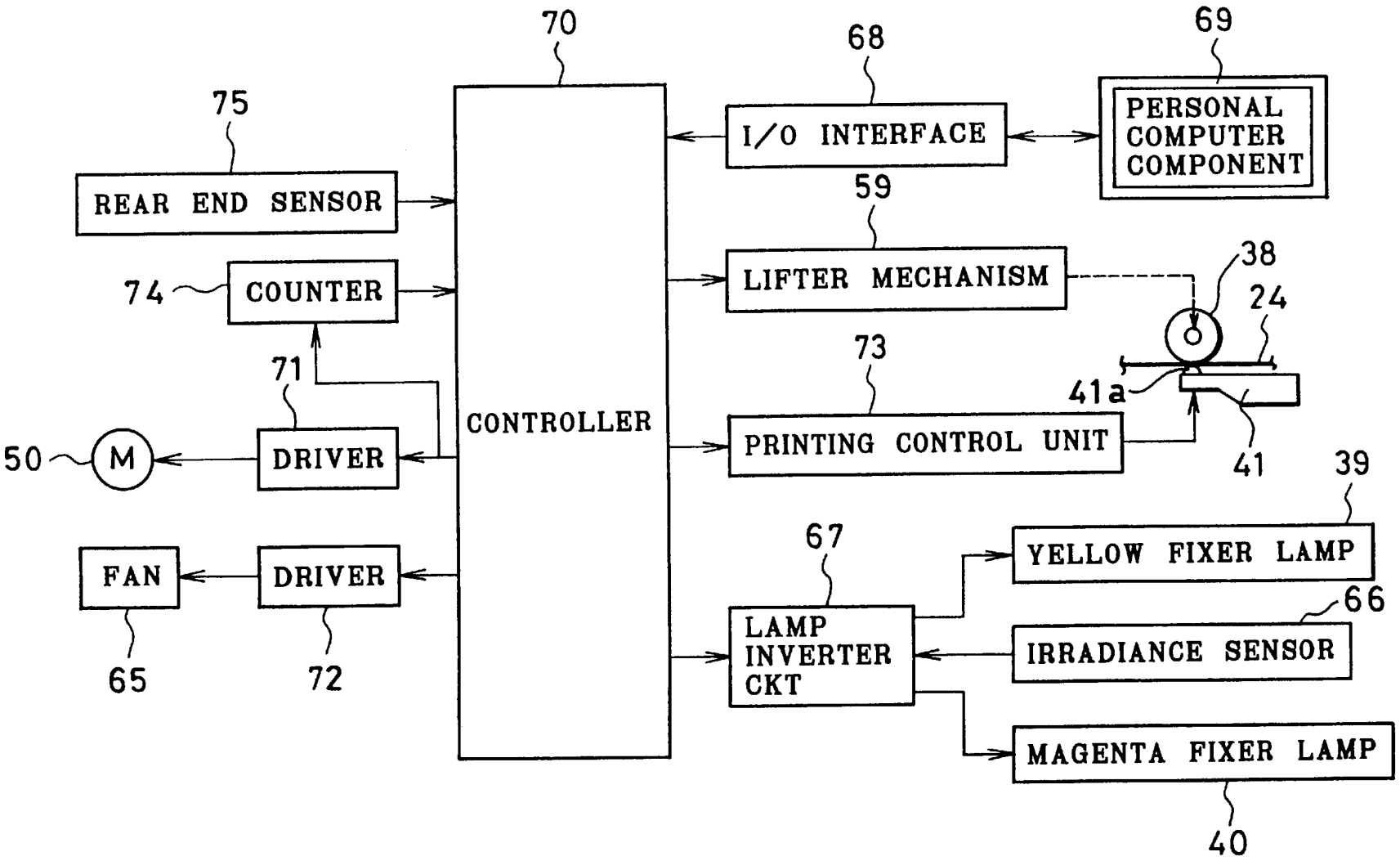
FIG. 4 is a block diagram illustrating relevant circuits in the thermal printer.

The fixer lamps 39 and 40 are close to each other to keep the printer size compact. In FIG. 4, an irradiance sensor 66 is disposed between the fixer lamps 39 and 40 to measure irradiance of the fixer lamps 39 and 40. A signal generated from the irradiance sensor 66 is sent to a lamp inverter circuit 67, which adjusts voltage to the fixer lamps 39 and 40 to regulate the irradiance at an unchanged value.

FIG. 4 is a block diagram in which electric circuits of the thermal printer 10 are depicted. The thermal printer 10 is connected to a personal computer component 69 of the personal computer 18 via an I/O interface 68. A controller 70 consists of a microcomputer well known in the art, receives printing control data and image data transferred from the personal computer component 69, and controls drivers 71 and 72, the lifter mechanism 59, a printing control unit 73, the lamp inverter circuit 67 and a counter 74. The thermal printer 10 does not have an operation panel, but executes the printing operation in accordance with the printing control data sent from the personal computer component 69.

The controller 70 sends the driver 71 a rotational direction signal and drive pulses. The gaps 63 cause the stepping motor 50 to rotate forwards or backwards, so that the drive roller 36*a* of the supply roller set 36 and the capstan roller 37*a* of the conveyor roller set 37 are rotated in the supply direction or the printing direction. The counter 74 starts a counting operation upon receipt of a rear end detecting signal from a rear end sensor 75, and steps up when the stepping motor 50 rotates forwards to convey the personal computer 18 in the printing direction B, and steps down when the stepping motor 50 rotates backwards to convey the personal computer 18 in the supply direction A. In FIG. 1, the rear end sensor 75 is disposed between the supply roller set 36 and the conveyor roller set 37 and near to the conveyor roller set 37.

The lifter mechanism 59 includes a solenoid or the like, moves up and down the platen roller 38 to shift it between a push position and a retracted position. The printing control unit 73 includes a head driver and a memory, which stores three-color image data constituting one frame. The printing control unit 73 drives the respective heating elements of the heating element array 41*a* in accordance with the three-color image data. The heating elements are caused to develop heat according to each designated one of the colors and the color image data of the color, to develop color of the recording sheet 24 at intended density. The lamp inverter circuit 67 controls the fixer lamps 39 and 40 at an unchanged amount of rays in accordance with detecting signals from the irradiance sensor 66. It is to be noted that the memory does not require capacity of one frame. The memory may have capacity only sufficient for storing a number of lines. It is preferable that the personal computer may successively send image data by a unit amount of plural lines in a timely manner associated with a printing sequence.

Figure 5:
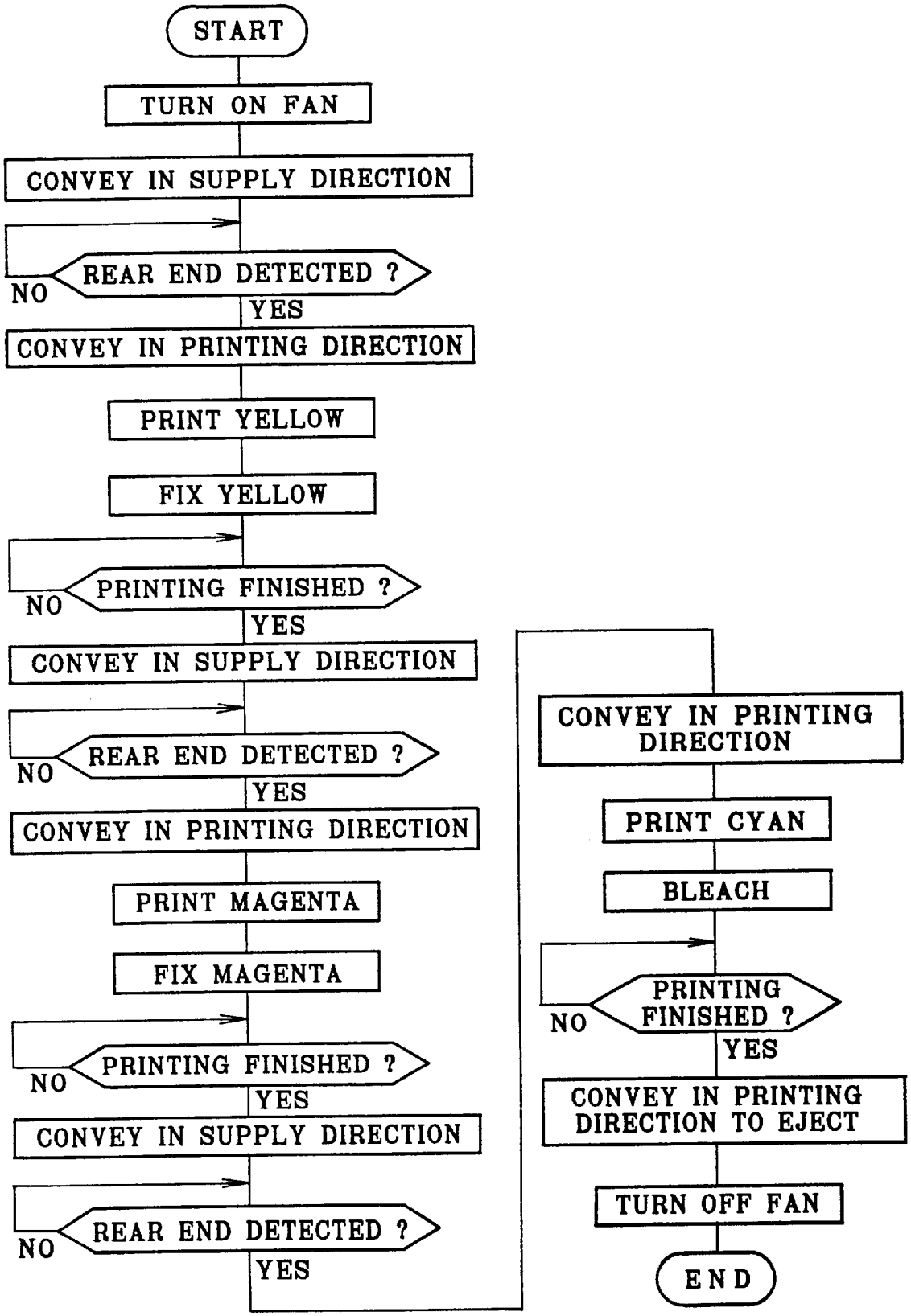
FIG. 5 is a flow chart illustrating operation of the thermal printer.

The operation of the present embodiment is described with reference to FIG. 5. When the personal computer component 69 is operated to command a printing operation, at first a motor for the fan unit 65 is rotated by the driver 72. Air is taken into the printer casing 11 through the air inlet 26. The air flows through the air passageway 64 in the printer casing 11 and is exhausted through the air outlet 27. Thus the heat emitted from the thermal head 41 is caused to flow out of the printer casing 11, inside which the temperature is kept from rising.

Then a command of supply of the recording sheet is input. The thermal printer 10 comes to stand by for the sheet supply. While the thermal printer 10 stands by, the stepping motor 50 causes the supply roller set 36, the conveyor roller set 37 and the platen roller 38 to rotate in the direction indicated by the arrow A. A user manually inserts a front end of the recording sheet 24 into the supply roller set 36. Therefore the recording sheet 24 is pulled into the printing unit 12, until a rear end of the recording sheet 24 is detected by the rear end sensor 75. Upon the detection, the recording sheet 24 is stopped.

Then a rotational direction of the stepping motor 50 is changed, to rotate the supply roller set 36, the conveyor roller set 37 and the platen roller 38 in the printing direction of the arrow B. The controller 70 causes the counter 74 to count the number of drive pulses of the stepping motor 50 in an incremental manner. According to the counted number of the counter 74, the controller 70 recognizes a position of starting the push of the thermal head 41, a position of starting the thermal recording, a position of stopping the thermal recording, a position of starting retreat of the thermal head 41, and a position of stopping conveyance of the recording sheet 24. The full-color image is recorded in the three-color frame-sequential manner in the order of yellow, magenta and cyan colors in the sequence known in the field of the thermal printing.

During the yellow recording, the yellow fixer lamp 39 is turned on to fix the yellow coloring layer, which is prevented from developing further color in the course of the magenta recording and the cyan recording. Similarly during the magenta recording, the magenta fixer lamp 40 is turned on to fix the magenta coloring layer. Additionally the magenta fixer lamp 40 is turned on during the cyan recording, to bleach a non-printing margin which has had yellowish appearance. After the cyan recording, the recording sheet is sent out through the insertion opening 25, to finish the full-color printing operation.

In the present embodiment, the recording sheet is manually inserted. Alternatively the thermal printer may be used with a sheet supply cassette and a supply mechanism, which may be mounted on the insertion opening in a removable manner, for automatically supplying the printer with recording sheets. A roll of continuous recording material may be prepared and set in a supply station. The continuous recording material may be cut into separate sheets. Moreover it is possible to combine the manual insertion, the use of the sheet supply cassette, and/or the use of the roll. Of course the positions of the thermal head 41 and the conveyor roller set 37 are not limited to the above examples, but changeable in a suitable manner. The printing sequence is not limited to the above example. The yellow fixation may be conducted during the conveyance in the supply direction after the yellow printing in the printing direction. Moreover the yellow fixation may be conducted during the conveyance both in the printing direction and in the supply direction, namely during and after the yellow printing.

In the above embodiment, the printing unit 12 is fixed on the printed circuit board 13. Alternatively each of the printing unit 12 and the printed circuit board 13 may be secured to the printed circuit board 13 in a separate manner. In the above embodiment the fixer lamps 39 and 40 are connected to the printed circuit board 13 via the sockets 46. Instead, the fixer lamps 39 and 40 are connected to it in a direct manner by use of a securing plate. Otherwise the sockets 46 may be directly mounted on the printed circuit board 13. The fixer lamps may be placed on the printed circuit board 13 in a removable manner.

Figure 6:
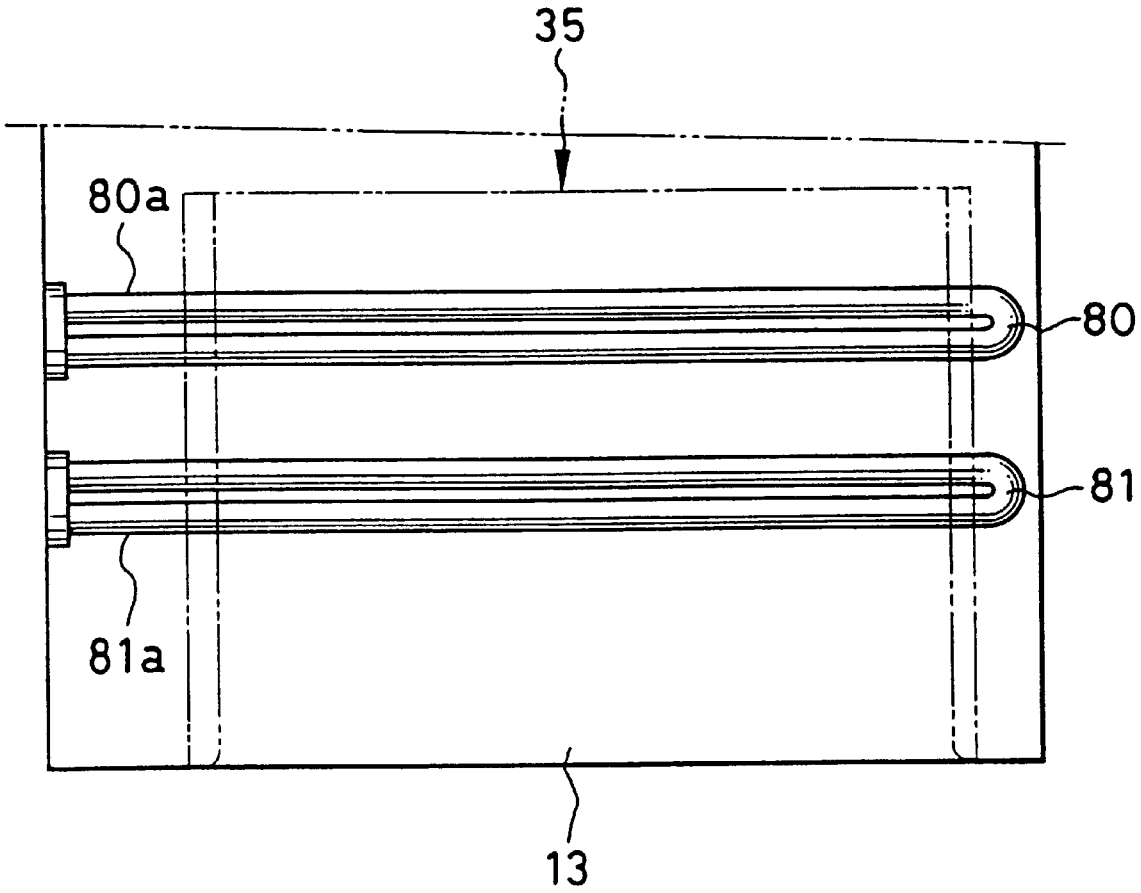
FIG. 6 is an explanatory view in a top plan, illustrating another preferred embodiment of fixer lamps.

In the above embodiment, the lamp ends 39*a* and 40*a* of the fixer lamps 39 and 40 are bent at the right angle to keep the printer size compact. It is possible to use fixer lamps 80 and 81 of a U-shape of FIG. 6. The fixer lamps 80 and 81 have lamp ends 80*a* and 81*a* from which rays are emitted only at a decreased amount. The lamp ends 80*a* and 81*a* can be collectively located, so that a printed circuit board 77 can have a reduced size. This is favorable in reducing the size of the entirety of the thermal printer. Note that a combination of plural arranged fixer lamps of the U-shape may be used for fixation of each color. This is typically effective in avoiding shortage in the amount of fixing rays.

In the above embodiment, the thermal printer 10 is mounted in the bay 19 of the personal computer 18 as depicted in FIG. 2. Alternatively a thermal printer may be mounted in a bay of a personal computer of a horizontal type being widely used. Furthermore a thermal printer may be mounted in a bay of a personal computer of a display-panel-combined type. Also a thermal printer may be mounted on any imaging apparatus such as a television set or a video player. In any of them, heat from the thermal head is kept from remaining within the apparatus, which can be constructed in a compact manner. In the present invention, it is also possible that the printer casing 11 is oriented in a upright direction instead of a horizontal direction.

The thermal printer includes the fixer lamps for fixation of coloring layers of the recording sheet. Numerous parts or elements are required for securing and wiring the fixer lamps. Steps of mounting the parts are numerous. The size of the printer and the cost will be large in an unwanted manner.

Although a color thermal printer does not use ink ribbon or ink which should be supplied newly in the course of long use, there is a fixer lamp which will be renewed with time. The prior art has not suggested a construction in which a fixer lamp in a thermal printer would be easily removed or secured. To solve this problem, another preferred embodiment is now described with reference to FIGS. 7–15.

The present embodiment is a color thermal printer of an externally mounted type and without an operation panel for the purpose of lowering the cost. The printer is combined with a personal computer for operation.

In FIGS. 7–10, a thermal printer has a printed circuit board 90, a printing unit 91 and a cabinet 92. The printing unit 91 is fixedly secured to the printed circuit board 90 by securing screws 96 via securing brackets 93 and collars 94. The printed circuit board 90 has a greater thickness than that used conventionally and is resistant to flexing force, because the printing unit 91 is secured to it.

On the printed circuit board 90 are disposed a yellow fixer lamp 100 of an optical fixer unit, a magenta fixer lamp 101 of the optical fixer unit, a transformer 102 with a power source, a power source connector 103, connectors 104 and 105, a lamp inverter unit 106 for the yellow and magenta fixer lamps 100 and 101, integrated circuits (IC) 107, resistors, transistors, and the like. Those elements in combination constitute the power source unit and the control unit of the thermal printer.

Figure 10:
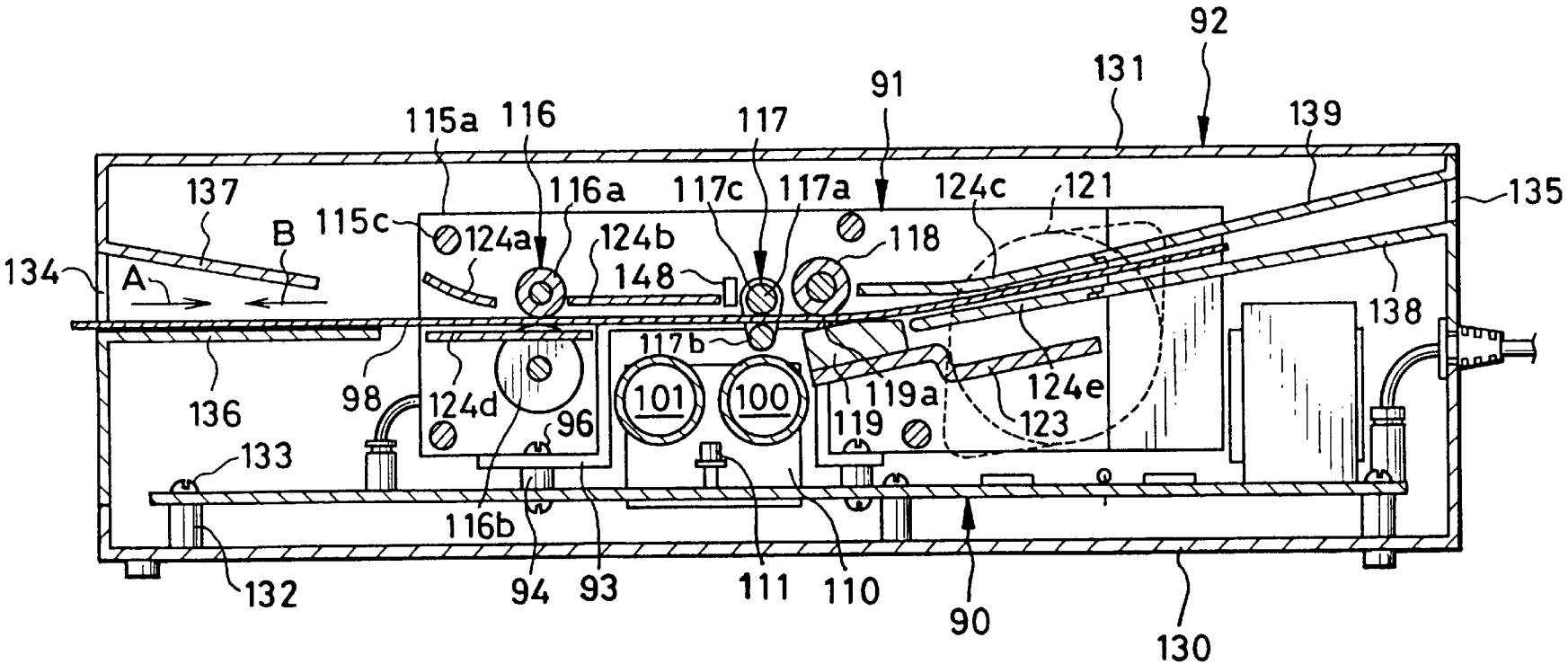
FIG. 10 is a vertical section illustrating the thermal printer.
Figure 11:
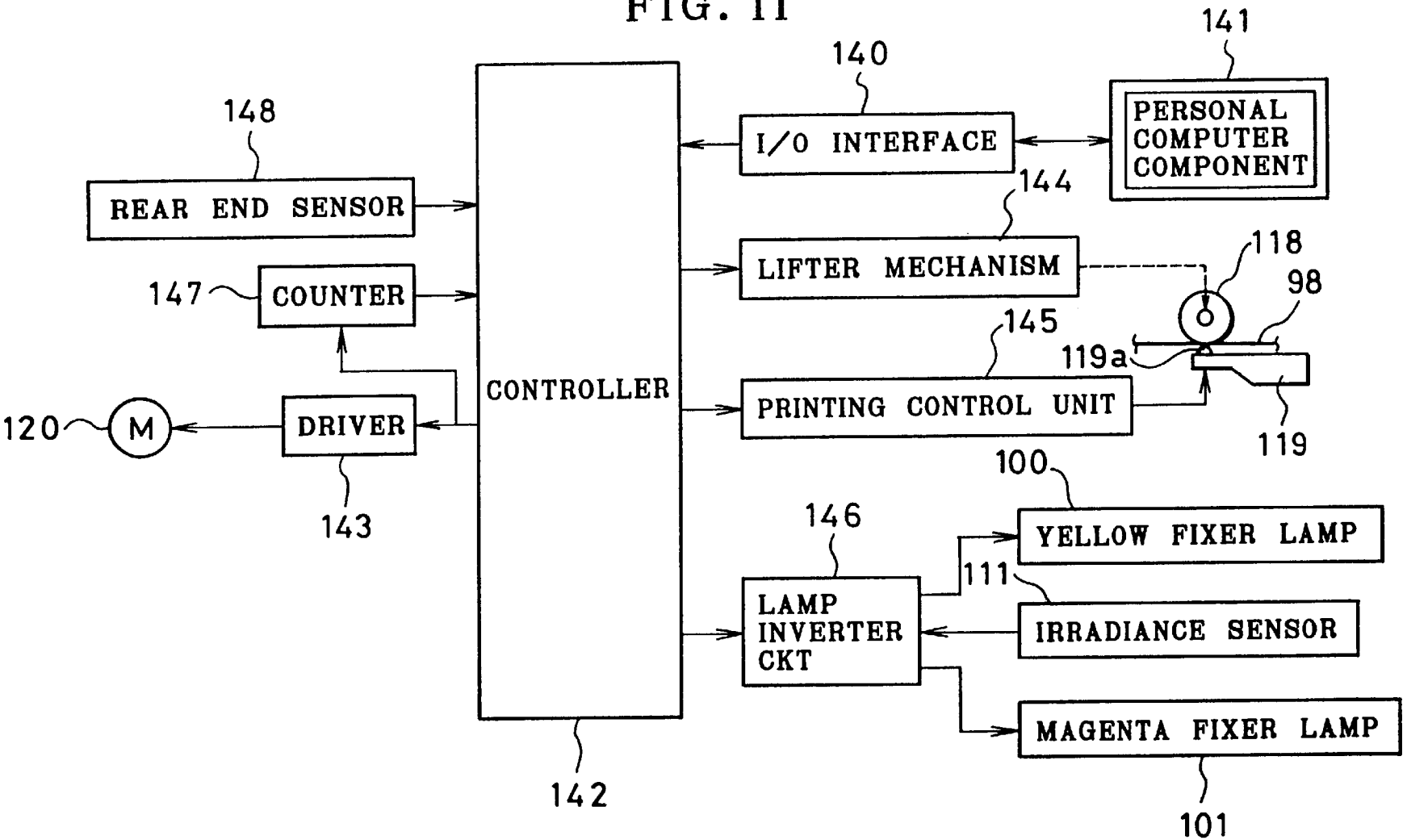
FIG. 11 is a block diagram illustrating relevant circuits of the thermal printer.

The yellow and magenta fixer lamps 100 and 101 are mounted on the printed circuit board 90 by use of support plates 110. The support plates 110 have a contact pattern 110*a* for connecting pins of the yellow and magenta fixer lamps 100 and 101 to the printed circuit board 90. The yellow and magenta fixer lamps 100 and 101 are disposed near to each other to render the printer compact. In FIG. 10, an irradiance sensor 111 is disposed on the printed circuit board 90 between the yellow and magenta fixer lamps 100 and 101. A signal from the irradiance sensor 111 is sent to a lamp inverter circuit 146 as depicted in FIG. 11. The lamp inverter circuit 146 adjusts voltage applied to the yellow and magenta fixer lamps 100 and 101 for the purpose of keeping irradiance of them unchanged.

Figure 9:
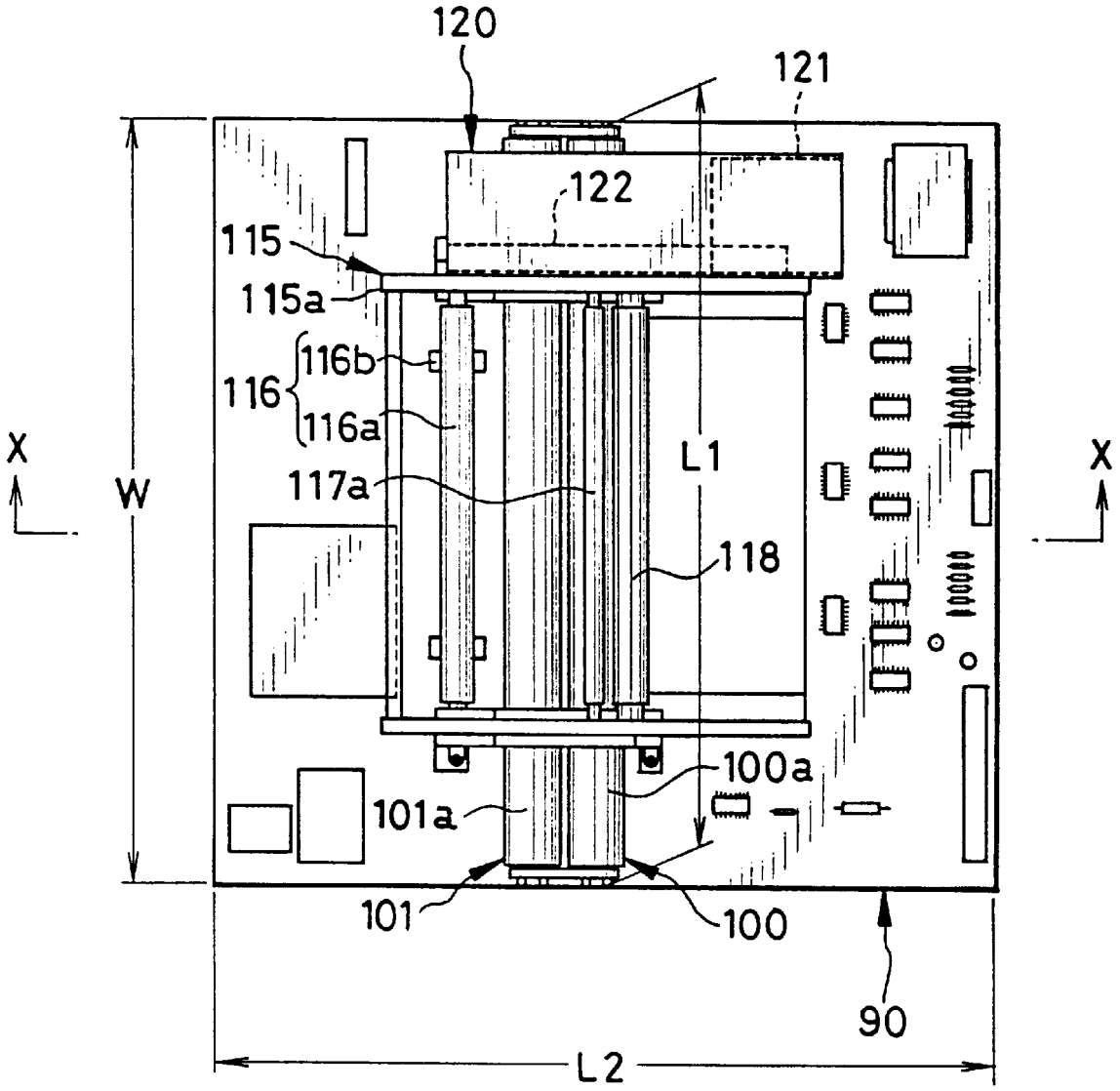
FIG. 9 is a top plan illustrating the printing unit.

In FIG. 9, a width W of the printed circuit board 90 is determined in accordance with a length L1 of the yellow and magenta fixer lamps 100 and 101. W and L1 have a relationship of L1≈W. A length L2 of the printed circuit board 90 is determined in consideration of electric elements. In the present embodiment, L2≈W, and the printed circuit board 90 is substantially a square. The yellow and magenta fixer lamps 100 and 101 are disposed in the center of the printed circuit board 90 in the length direction of the printed circuit board 90.

Figure 7:
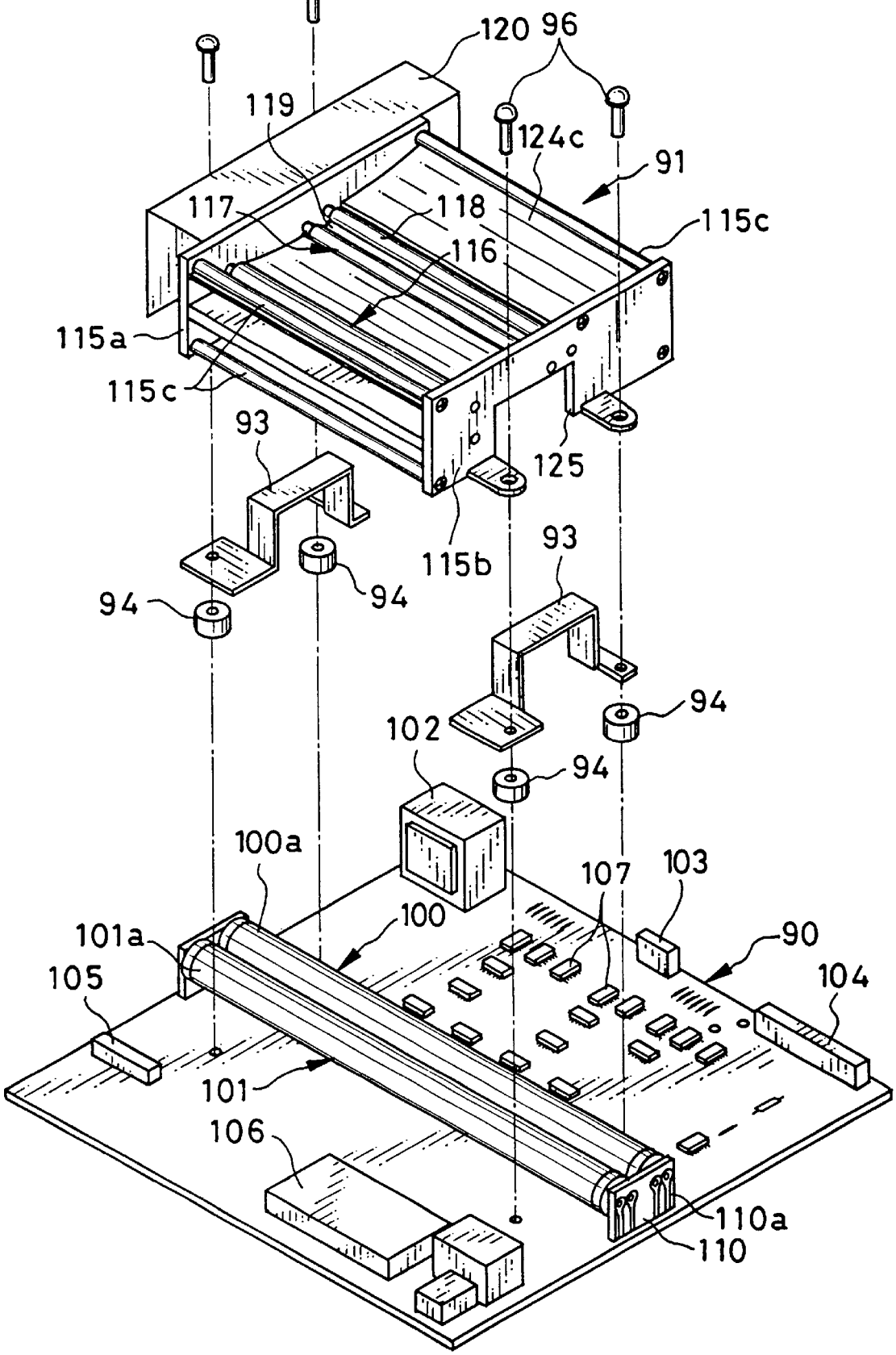
FIG. 7 is an exploded perspective illustrating still another preferred color thermal printer in which fixer lamps are secured on a printed circuit board.

In FIG. 7, the printing unit 91 has a chassis 115 as a construction of a unit, and includes a supply roller set 116, a conveyor roller set 117, a platen roller 118, a thermal head 119 and a drive unit 120, which are arranged in the chassis 115. The chassis 115 is constituted by lateral plates 115*a* and 115*b* and a stay 115*c* for connecting them. Between the lateral plates 115*a* and 115*b* are disposed the supply roller set 116, the conveyor roller set 117, the platen roller 118 and the thermal head 119. The drive unit 120 is disposed on the outside of the lateral plate 115*b*. Middle portions of the yellow and magenta fixer lamps 100 and 101 between lamp ends 100*a* and 101*a* have a feature of emitting rays at a uniform amount. Consequently the printing unit 91 is disposed along the middle portions of the yellow and magenta fixer lamps 100 and 101. The lateral plates 115*a* and 115*b* are disposed in positions for separating those middle portions from the lamp ends 100*a* and 101*a*.

In FIG. 10, the supply roller set 116 has a drive roller 116*a* and a push roller 116*b*. The conveyor roller set 117 has a capstan roller 117*a* and a pinch roller 117*b*, which is secured to the lateral plates 115*a* and 115*b* by use of a bracket 117*c*. Sheet guide plates 124*a*, 124*b*, 124*c*, 124*d* and 124*e* are disposed in the chassis 115, and guide color thermosensitive recording material or sheet 98 toward the supply roller set 116, the conveyor roller set 117 and the platen roller 118.

In FIG. 9, a stepping motor 121 and a gear train 122 are included in the drive unit 120. A head securing bracket 123 operates to secure the thermal head 119. A lifter mechanism 144 of FIG. 11 moves up and down the platen roller 118. The thermal head 119 has a heating element array 119*a*.

In FIG. 7, cutouts 125 are formed in the lateral plates 115*a* and 115*b*. When the chassis 115 is secured to the printed circuit board 90, the yellow and magenta fixer lamps 100 and 101 enter the cutouts 125. Thus efficiency in applying rays to the recording sheet 98 is increased.

In FIG. 10, the cabinet 92 includes lower and upper cabinet halves 130 and 131. The lower cabinet half 130 has securing bosses 132, to which the printed circuit board 90 is secured by use of securing screws 133. The cabinet 92 has an insertion opening 134 and an auxiliary opening 135. Sheet guide plates 136, 137, 138 and 139 are disposed between the insertion opening 134 and the printing unit 91 and between the auxiliary opening 135 and the printing unit 91.

In FIG. 11, an I/O interface 140 is adapted to connection with a personal computer 141. A controller 142 controls a driver 143, the lifter mechanism 144, a printing control unit 145, the lamp inverter circuit 146 and a counter 147. A rear end sensor 148 is adapted to detection of a rear end of the recording sheet 98.

Figure 12:
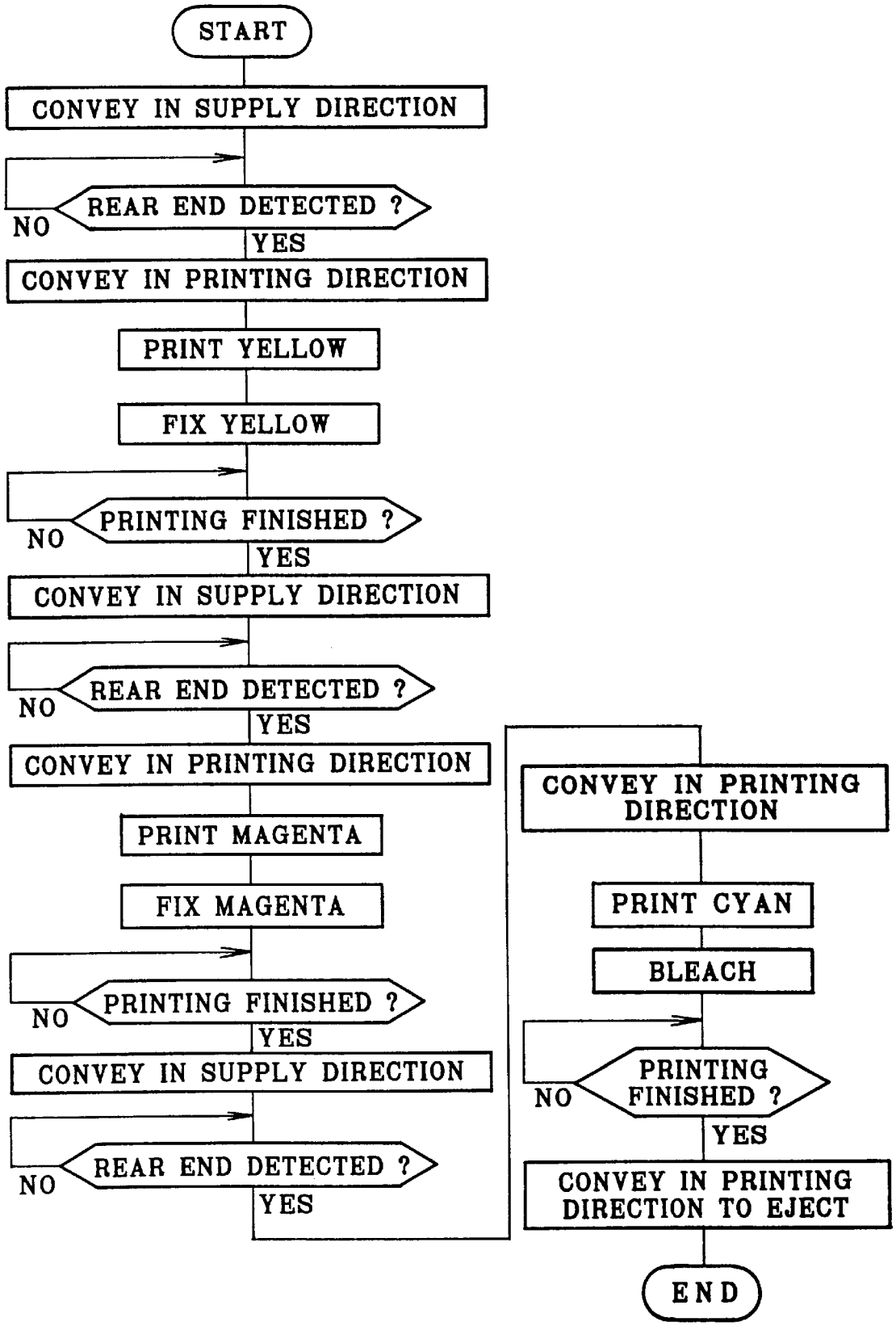
FIG. 12 is a flow chart illustrating operation of the thermal printer.

For the operation of the present embodiment, see the flow chart of FIG. 12.

In the present embodiment, the recording sheet is manually inserted. Alternatively the thermal printer may be used with a sheet supply cassette and a roll of continuous recording material, which may be set on the insertion opening in a removable manner, for automatically supplying the printer with the recording sheets or material. In the above embodiment, the recording sheet 98 is conveyed back and forth in the straight conveying path. Alternatively three printing units may be used in association with the three colors. The thermal printing may be conducted for the respective three colors in printing stages of the printing units. Also a thermal printer may have a platen drum. On the peripheral surface of the platen drum, a recording sheet may be placed for effecting a sequence of three-color frame-sequential recording.

In the above embodiment, the printer does not have an operation panel but is adapted for use with a personal computer. This is effective in decreasing a manufacturing cost of the printer. Of course a thermal printer of the present invention may have an operation panel, and may print an image of which data may be sent from a video tape recorder, a television set, or a digital still camera so-called electronic camera, in response to a printing command generated upon operation the operation panel.

In the above embodiment, the yellow and magenta fixer lamps 100 and 101 are mounted by use of the support plates 110. Alternatively sockets may be mounted on the printed circuit board. Fixer lamps may be placed on the sockets in a removable manner. A reflector may be mounted on the printed circuit board, so as to increase efficiency in application of the rays.

Figure 8:
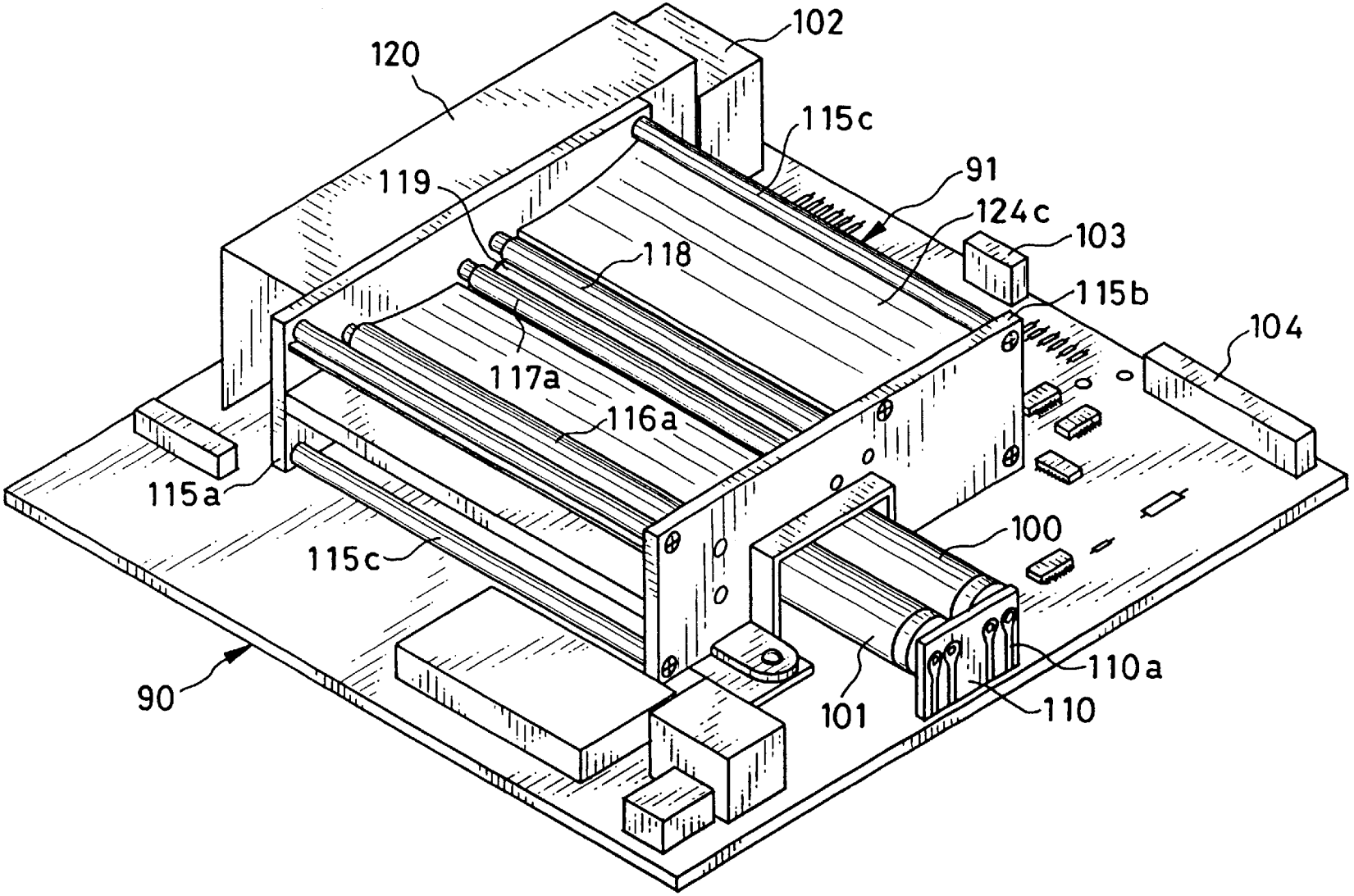
FIG. 8 is a perspective illustrating a printing unit of the thermal printer.

In the above embodiment, the printing unit 91 is secured to the printed circuit board 90 via the securing brackets 93 as depicted in FIGS. 7 and 8. Alternatively the printing unit 91 may be directly secured to the printed circuit board 90.

Figure 13:
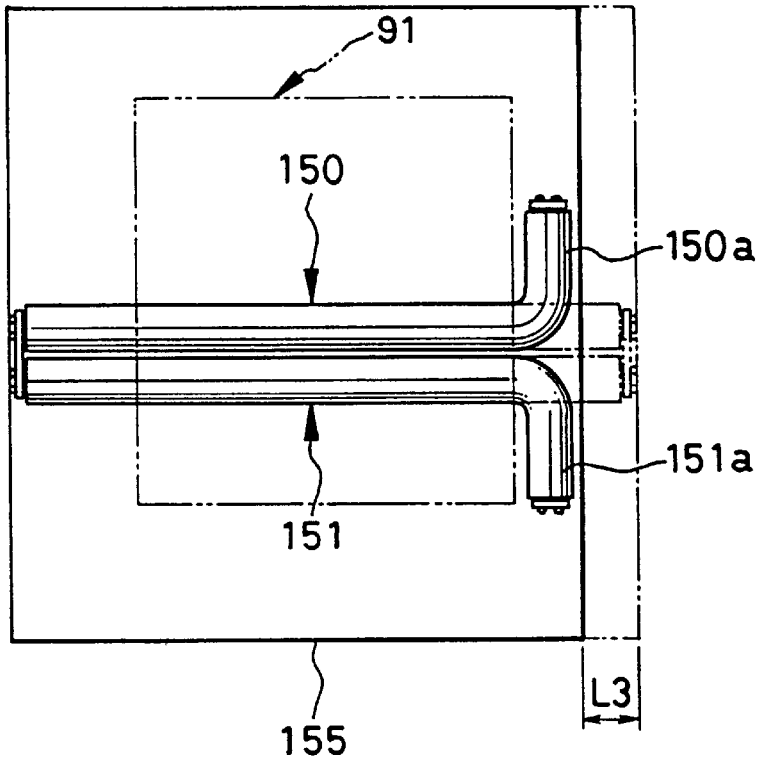
FIGS. 13, 14 and 15 are explanatory views in top plans, illustrating further preferred embodiments of fixer lamps.
Figure 14:
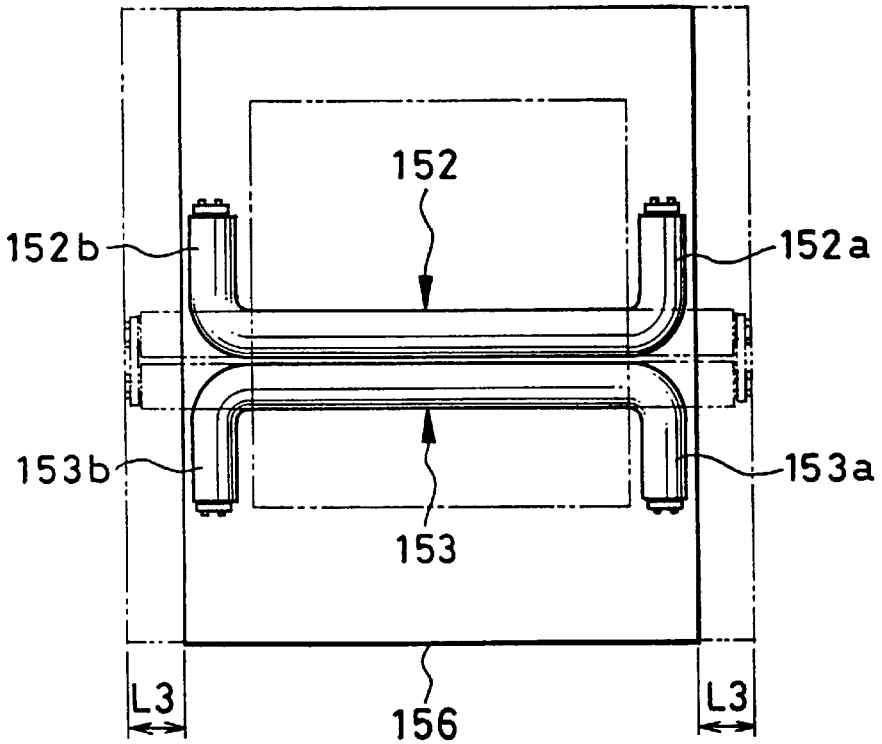

In the above embodiment, the yellow and magenta fixer lamps 100 and 101 of the straight shape are used. Alternatively fixer lamps 150 and 151 of an L-shape and fixer lamps 152 and 153 of a channel shape may be used as depicted in FIGS. 13 and 14. The fixer lamps 150, 151, 152 and 153 have respective lamp ends 150*a*, 151*a*, 152*a* and 153*a*, at any of which rays are emitted only at a decreased amount. It is possible to shorten a width of printed circuit boards 155 and 156 by a length L3. This is favorable in reducing the printer size. If the recording sheet is distant from the printed circuit board, the fixer lamps 152 and 153 of FIG. 14 may be disposed in respectively vertical orientation of the channel shape in a manner unlike the horizontal orientation of FIG. 14. The fixer lamps 152 and 153 of this orientation can be secured directly to the printed circuit board.

Figure 15:
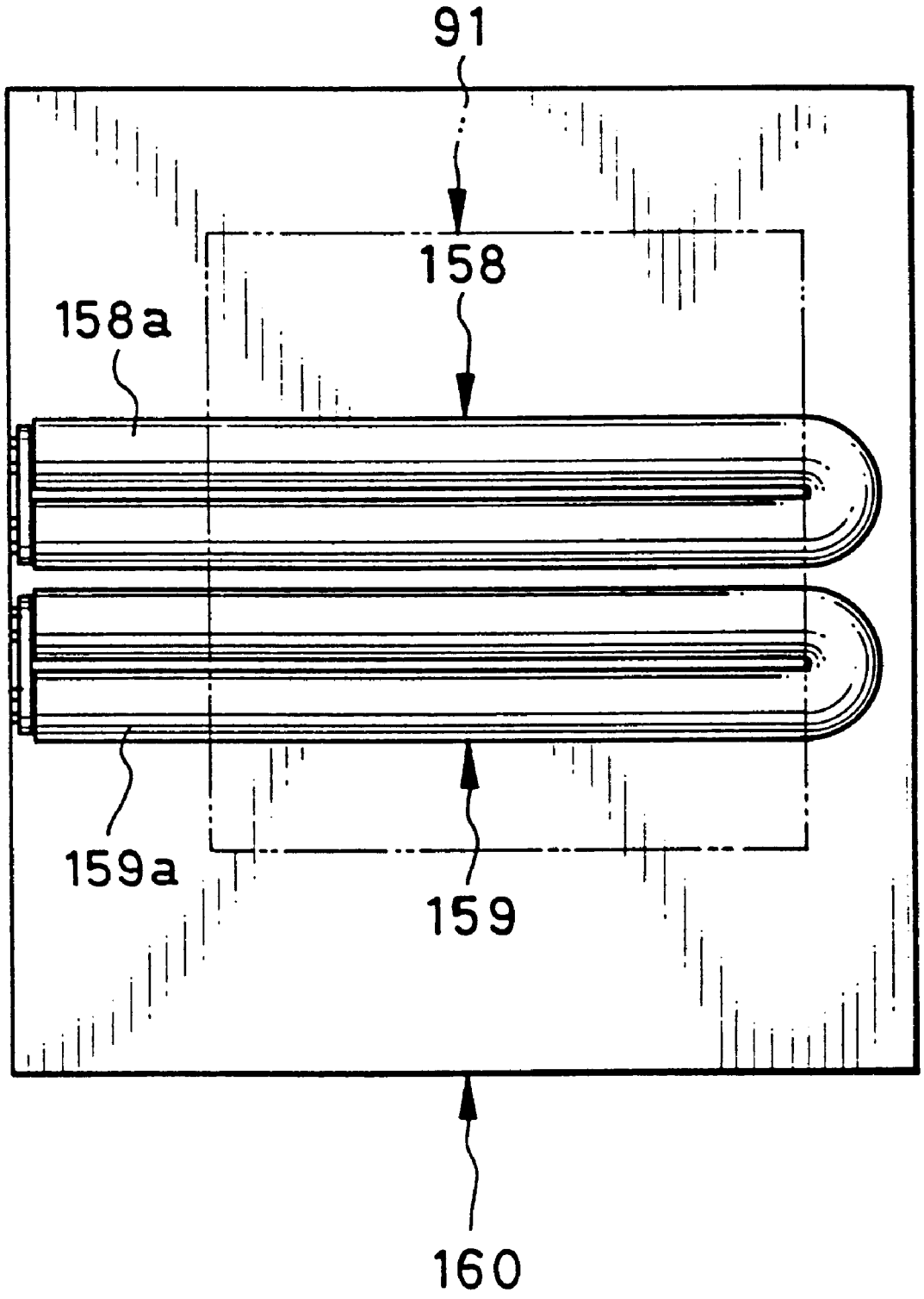

It is possible to use fixer lamps 158 and 159 of a U-shape of FIG. 15. The fixer lamps 158 and 159 have lamp ends 158*a* and 159*a* from which rays are emitted only at a decreased amount. The lamp ends 158*a* and 159*a* can be collectively located, so that a printed circuit board 160 can have a reduced size. This is favorable in reducing the size of the entirety of the thermal printer.

Figure 16A:
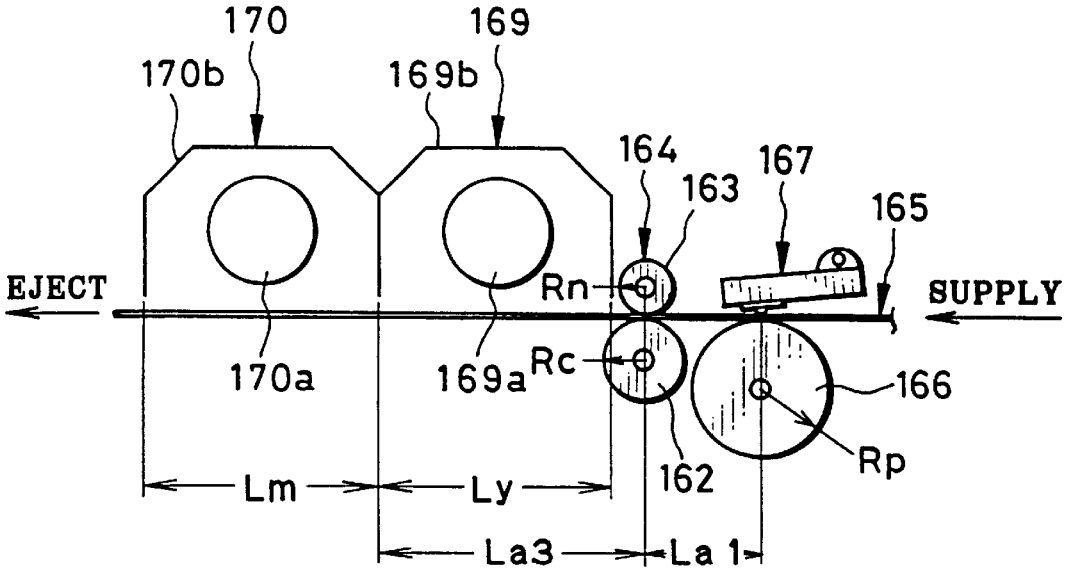
FIG. 16A is an explanatory view in elevation, illustrating a comparative example of a color thermal printer.
Figure 16B:
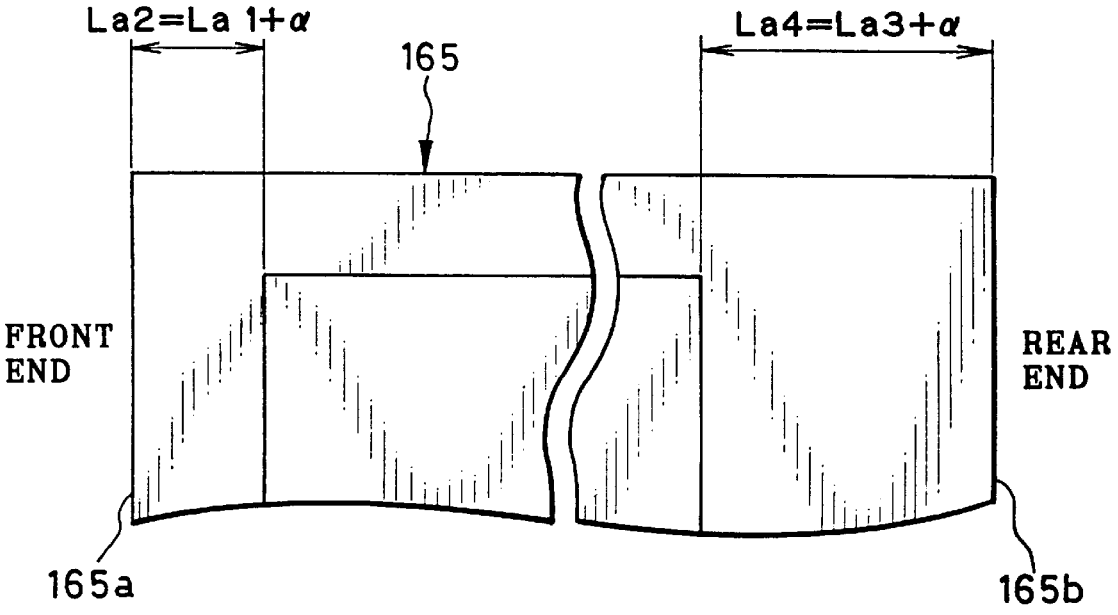
FIG. 16B is an explanatory view in plan, illustrating a color thermosensitive recording sheet after the recording by the printer of FIG. 16A.

In FIGS. 16A and 16B illustrating the color thermal printer, color thermosensitive recording material or sheet 165 is conveyed by a conveyor roller set 164 which includes a capstan roller 162 and a pinch roller 163. The capstan roller 162 is rotated by a motor. The pinch roller 163 has a smaller diameter than that of the capstan roller 162. The conveyor roller set 164 nips the recording sheet 165 and conveys it in a forward direction toward an ejection side and in a backward direction toward a supply side. The recording sheet 165 is pressurized and heated between a platen roller 166 and a thermal head 167 to print the three colors of yellow, magenta and cyan.

In a downstream position from the conveyor roller set 164 with reference to the forward direction, a yellow fixer 169 and a magenta fixer 170 are arranged. The yellow fixer 169 includes a fixer lamp 169*a* and a reflector 169*b*. The magenta fixer 170 includes a fixer lamp 170*a* and a reflector 170*b*. Those are turned on when the recording sheet 165 is conveyed in the backward direction.

Figure 17A:
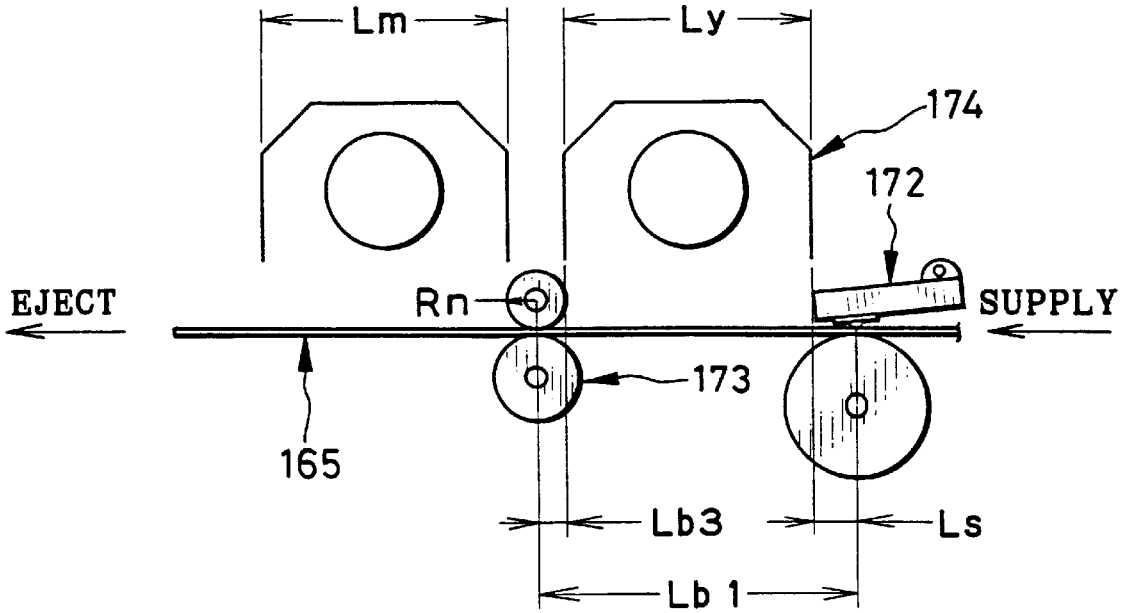
FIG. 17A is an explanatory view in elevation, illustrating another comparative example of a color thermal printer.

In FIG. 17A, another thermal printer has a yellow fixer 174 disposed between a thermal head 172 and a conveyor roller set 173. Ultraviolet rays from the yellow fixer 174 directly travel without being blocked by any of the conveyor roller set 173 and the thermal head 172. The printer of FIG. 17A is smaller than that of in FIG. 16A in the conveying direction of the recording sheet 165.

Let the thermal printer be a capstan-incorporating type in which a conveyor roller set is used. In FIG. 16B, a front end 165*a* of the recording sheet 165 is moved between the thermal head 167 and the platen roller 166, and nipped in the conveyor roller set 164 before the thermal recording. Let La1 be a distance between the platen roller 166 and the conveyor roller set 164. Let a be a range in the recording sheet 165 required for being nipped by the conveyor roller set 164. For example, $\alpha$=1 mm. As a result, the front end 165*a* of the recording sheet 165 has an unrecordable margin where the thermal recording is impossible, and which is in a range of La2=La1+$\alpha$. To decrease the unrecordable margin, La1 must be set small. But La1 is determined as a sum of Rp, Rc and a minimum gap as play, where Rp is a radius of the platen roller 166, and Rc is a radius of the capstan roller 162. It is impossible to set small the unrecordable margin in an acceptable range.

In the back-and-forth conveying type of thermal printer, the recording sheet 165 must be kept nipped by the conveyor roller set 164 before finishing the thermal recording to all the coloring layers, for the purpose of avoiding deviation in registering the three-color pixels. However there occurs a problem in that, if the yellow fixer 169 is turned off while a sheet rear end is still nipped by the conveyor roller set 164, fixation of a portion confronted with the yellow fixer 169 is insufficient. If in turn the yellow fixer 169 is kept turned on while the sheet rear end is nipped, a portion near to the magenta fixer 170 is over-fixed. Let La3 be a distance between the conveyor roller set 164 and an end of the platen roller 166. La3 is a sum of Ly, Rn, and a minimum gap as play, where Ly is a width of the yellow fixer 169, and Rn is a radius of the pinch roller 163. Let α be a range in the recording sheet 165 required for being nipped by the conveyor roller set 164. To effect the yellow fixation in an appropriate manner, a rear end 165*b* of the recording sheet 165 must have a margin in a range of La4=La3+α. However a problem occurs in that the margin range La4 is too large, as it is two times as long as the margin range La2 of the front end 165*a*.

To decrease the margin range La4 of the rear end 165*b*, a shutter or an additional structure must be used between the yellow fixer 169 and the recording sheet 165 for adjustment of an amount of rays to be applied. However such a structure causes enlargement of the printer, which cannot be small enough to contain in a bay of a personal computer. Such a structure also increases a manufacturing cost of the printer, and inconsistent to ideas to provide a color thermal printer for wide use.

Figure 17B:
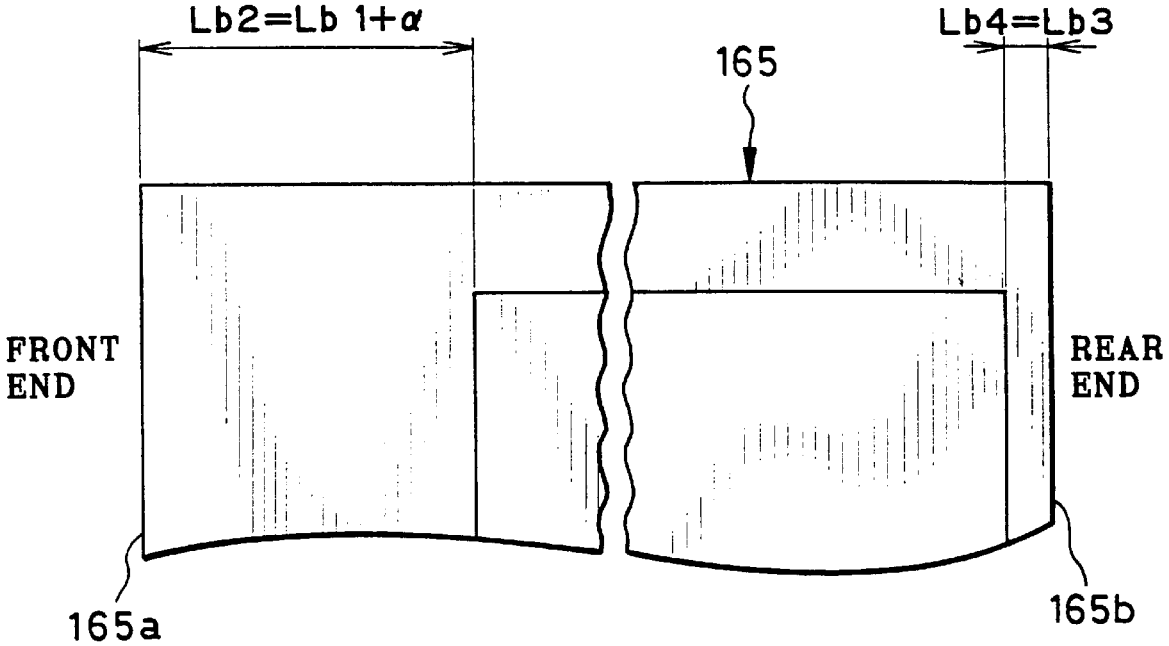
FIG. 17B is an explanatory view in plan, illustrating a recording sheet after the recording by the printer of FIG. 17A.

In the color thermal printer of FIG. 17A, a margin range Lb4 of the rear end 165*b* can be smaller than the margin range La4 according to the above-mentioned printer by the amount of the width Ly of the yellow fixer 174, as depicted in FIG. 17B. However a distance Lb1 between the thermal head 172 and the conveyor roller set 173 becomes longer by the amount of the width Ly. As a result, the margin range Lb2 formed on the front end 165*a* of the recording sheet 165 is remarkably longer than the margin range La2 according to the abovementioned printer.

JP-A 8-156299 discloses a color thermal printer in which both margins at the front and rear ends 165*a* and 165*b* of the recording sheet 165 can be reduced. According to this, two capstan rollers are disposed in positions outside a platen roller in a coaxial manner. Two pinch rollers are confronted with the capstan rollers. A thermal head is disposed between the pinch rollers. Yellow and magenta fixer lamps are arranged in a downstream position from those elements with reference to a forward direction. However there is a problem in instability in conveyance of a recording material, because the recording material is conveyed only by being driven along its lateral edges. It is likely that there occurs irregularity in conveyance and deviation in registering the colors, and that images are reproduced in low quality.

Figure 18A:
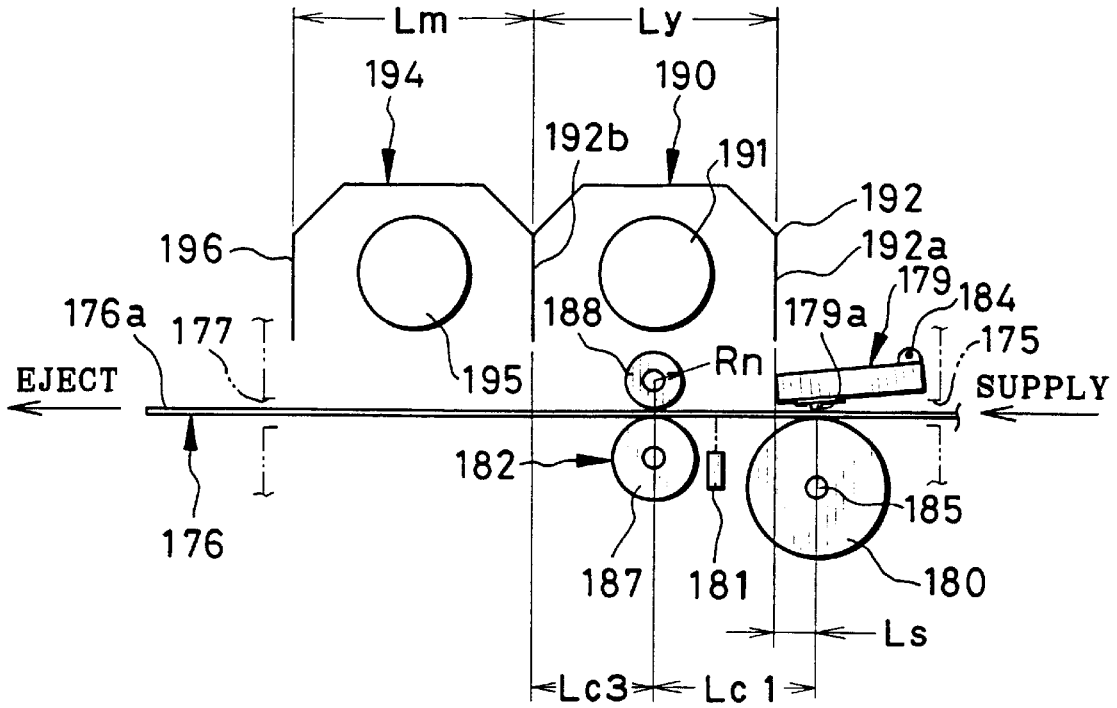
FIG. 18A is an explanatory view in elevation, illustrating still another preferred color thermal printer in which a fixer lamp is confronted with a pinch roller.
Figure 18B:
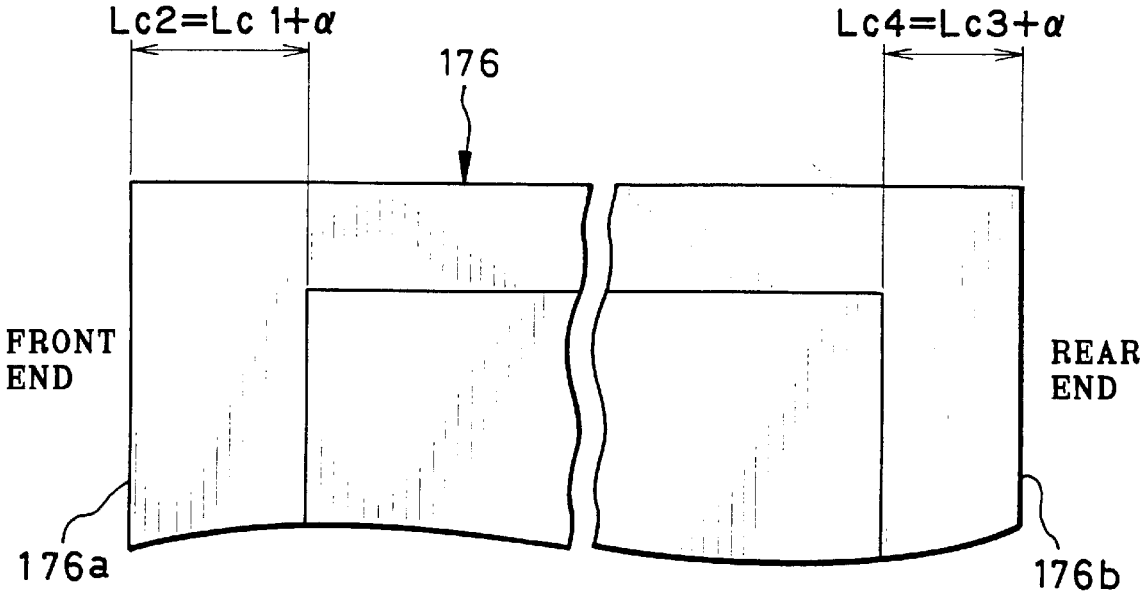
FIG. 18B is an explanatory view in plan, illustrating a recording sheet after the recording by the printer of FIG. 18A.
Figure 19A:
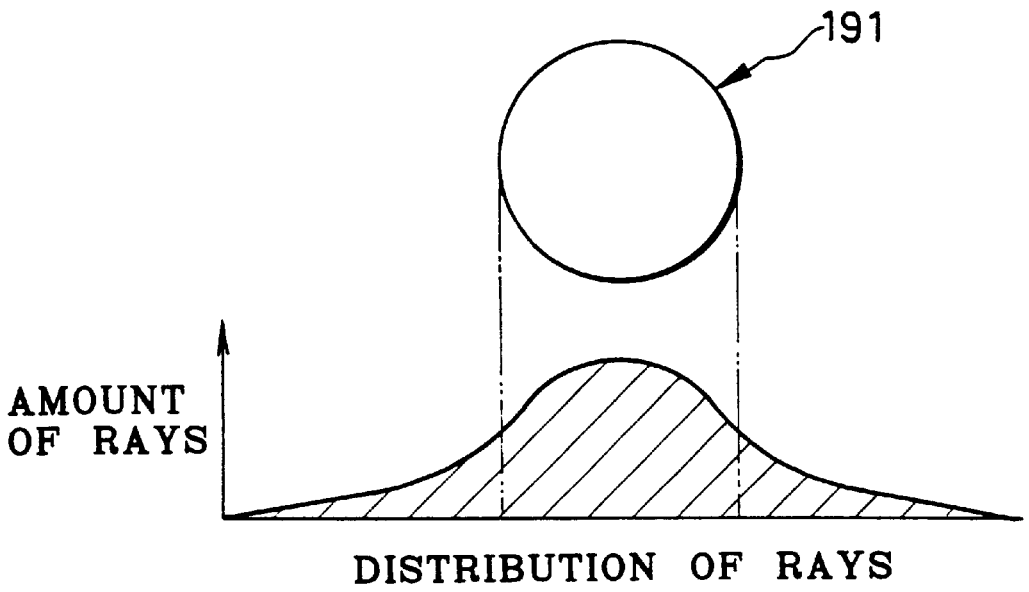
FIG. 19A is a graph illustrating a relationship between a position near to a fixer lamp without a reflector and an applying amount of rays from the fixer lamp.
Figure 19B:
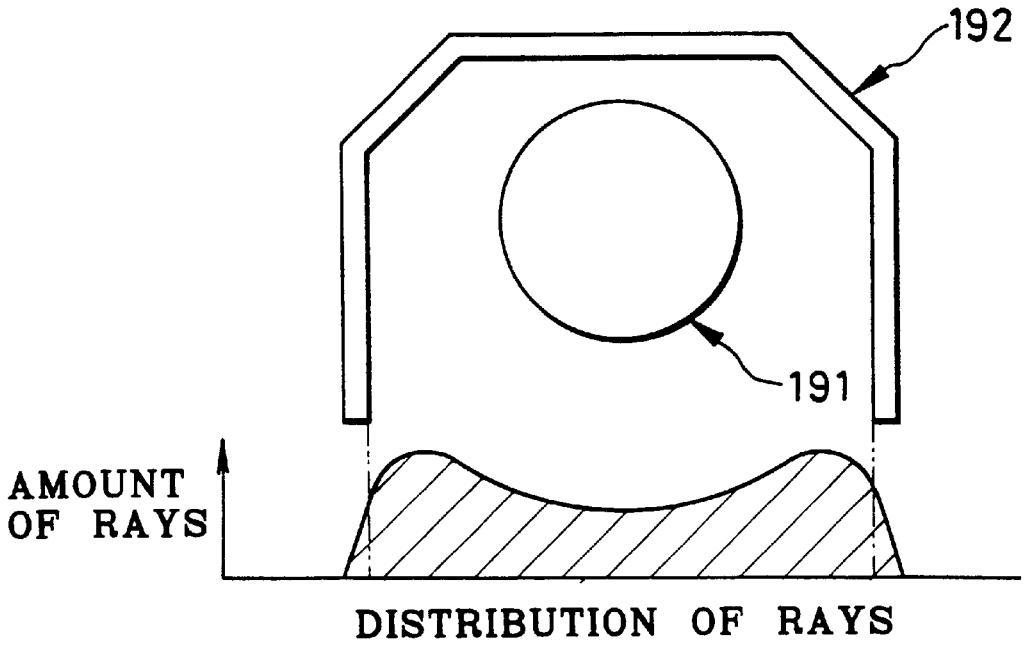
FIG. 19B is a graph illustrating a relationship between a position near to a fixer lamp associated with a reflector and an applying amount of rays from the fixer.
Figure 20A:
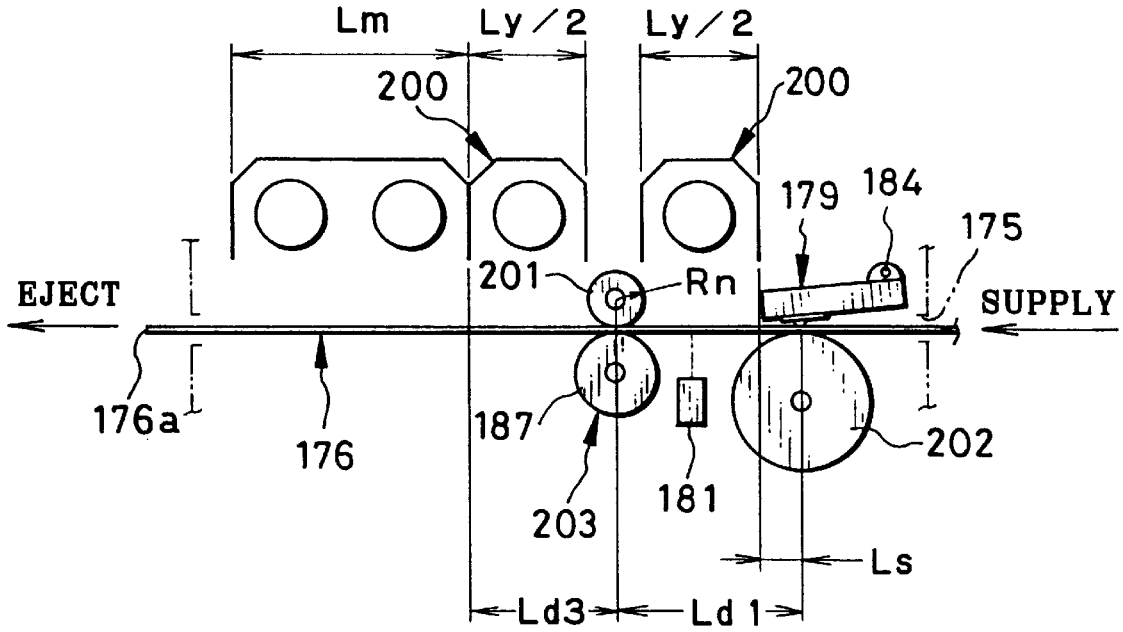
FIG. 20A an explanatory view in elevation, illustrating another preferred color thermal printer.
Figure 20B:
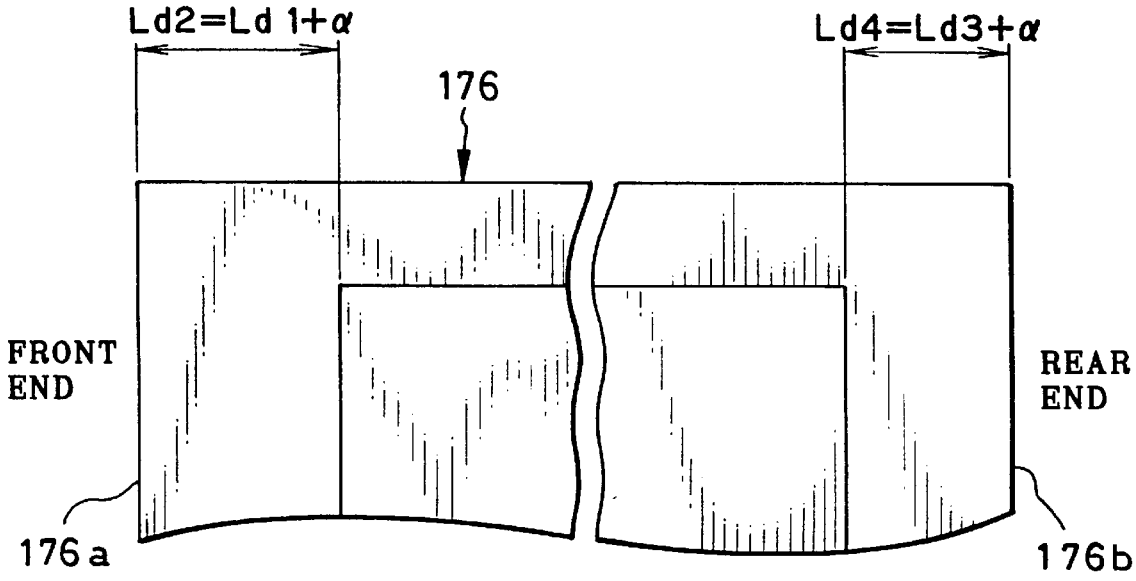
FIG. 20B is an explanatory view in plan, illustrating a recording sheet after the recording by the printer of FIG. 20A.

In FIGS. 18A–21, still another preferred embodiment is illustrated to solve those problems. In FIG. 18A, the printer has an insertion opening 175 through which color thermosensitive recording material or sheet 176 is inserted. The recording sheet 176 is conveyed in a forward direction of the insertion, and in a backward direction reverse to the forward direction, for the thermal recording and fixation of the full-color image. After the thermal recording of the recording sheet 176, the recording sheet 176 is ejected through an ejection opening 177. To reduce the size of the printer, the distance between the insertion opening 175 and the ejection opening 177 is smaller than a length of the recording sheet 176 with reference to the conveying direction. Either one of end portions of the recording sheet 176 emerges out of one of the insertion opening 175 and the ejection opening 177.

A thermal head 179 is confronted with a platen roller 180 in a position inside from the insertion opening 175. In a downstream position, there are a photo sensor 181 of a reflection type and a conveyor roller set 182. The photo sensor 181 detects a front end 176*a* of the recording sheet 176.

The thermal head 179 has a heating element array 179*a* in which a great number of heating elements are arranged crosswise to the conveying direction of the recording sheet 176, and is swingable about a rotational shaft 184 between a printing position in contact with the recording sheet 176 and a retracted position away from the recording sheet 176. The heating element array 179*a* generates heat energy adapted to color development of the coloring layers. The platen roller 180 is rotatable about a platen roller shaft 185, and is caused to rotate by movement of the recording sheet 176.

The conveyor roller set 182 is constituted by a capstan roller 187 and a pinch roller 188. The capstan roller 187 is rotated by a motor in forward and backward directions. The pinch roller 188 has a smaller diameter than that of the capstan roller 187, and is pressed against the capstan roller 187 by a spring (not shown). See springs 298 and 299 of FIGS. 29–34. The conveyor roller set 182 nips the recording sheet 176 from the insertion opening 175, and conveys the recording sheet 176 in forward and backward directions.

It is to be noted the recording sheet 176, having the three coloring layers, may additionally include a fourth, black coloring layer. Of course the order of the three or four coloring layers can be differently determined.

Among various positions, a bottom position directly under a fixer lamp 191 receives the greatest amount of rays if the fixer lamp 191 has a straight tubular shape and without additional reflection. See FIG. 19A. In the present embodiment, a reflector 192 is added to the fixer lamp 191, to obtain the ray applying distribution of FIG. 19B. Positions besides the bottom position directly under the fixer lamp 191 are caused to receive more rays than the bottom position. Consequently the rays can be applied without reduction in the total ray amount through the spaces beside the pinch roller 188, even with the fixer lamp 191 directly confronted with the pinch roller 188.

A yellow fixer 190 included in an optical fixer unit is in such a position that an end face 192*a* of the reflector 192 protrudes in a position offset by an amount of Ls in the forward direction from the thermal head 179. Or the yellow fixer 190 is so positioned that the thermal head 179 does not block rays from the yellow fixer 190. The conveyor roller set 182 has the pinch roller 188 disposed directly under the fixer lamp 191. A distance Lc1 between the platen roller 180 and the conveyor roller set 182 is defined as:

$$Lc1=Ls+Ly/2.$$

The margin range Lc2 at the front end 176*a* of the recording sheet 176 is determined as:

$$Lc2=Lc1+\alpha$$

where α is a nipped range of the recording sheet 176 nipped by the conveyor roller set 182.

A portion with a range Lc3 from the conveyor roller set 182 to an end face 192*b* of the reflector 192 of the yellow fixer 190 is likely to become a margin with insufficient fixation or over-fixation of the yellow fixer 190 as compared with a rear end 176*b* of the recording sheet 176. The rear end 176*b* of the recording sheet 176 has a margin in a range of Lc4=Lc3+α, where a is a range of the recording sheet 176 nipped by the conveyor roller set 182.

Consequently in the present invention, the margin range Lc2 at the front end 176*a* of the recording sheet 176 can be smaller than the margin range Lb2 at the sheet front end according to the known printer of FIGS. 17A and 17B, by an amount of:

$$(Ls+Ly+Rn)-(Ls+Ly/2)=Rn+Ly/2.$$

Also the margin range Lc4 at the rear end 176*b* of the recording sheet 176 can be smaller than the margin range La4 at the sheet rear end according to the known printer of FIGS. 16A and 16B by an amount of:

$$(Ly+Rn)-Ly/2=Rn+Ly/2.$$

The operation of the present embodiment is described now. The color thermal printer of FIG. 18A is connected with a personal computer. While the personal computer is used, there is an image which a user wishes to print. The user operates a keyboard of the personal computer to input a command to start printing. The personal computer sends printing data to the printer. The printer writes the printing data from the personal computer to an internal memory and stores it in a temporary manner.

After the start of the printing operation is commanded, messages are displayed on a monitor display panel of the personal computer, the messages including a finish of standby operation for the printing, and a need of insertion of the recording sheet 176 into the insertion opening 175 of the printer.

In accordance with the messages, the recording sheet 176 is inserted into the insertion opening 175. When not in use, the thermal head 179 is in the retracted position away from the platen roller 180 after swinging about the rotational shaft 184. The recording sheet 176 from the insertion opening 175 is moved between the thermal head 179 and the platen roller 180, until its front end comes in contact with the conveyor roller set 182. In the course of the movement, the front end 176*a* of the recording sheet 176 is detected by the photo sensor 181.

When the photo sensor 181 detects the front end 176*a* of the recording sheet 176, responsively the motor for the conveyor roller set 182 starts being driven, so that the capstan roller 187 is rotated in the counterclockwise direction. Then the pinch roller 188 pressed against the capstan roller 187 is driven to rotate in the clockwise direction to nip the front end 176*a* of the recording sheet 176.

At the same time as the conveyor roller set 182 nips the recording sheet 176, the thermal head 179 is swung about the rotational shaft 184 to a printing position. The heating element array 179*a* pushes the recording sheet 176 placed on the platen roller 180.

The recording sheet 176 is conveyed in the forward direction by the forward rotation of the conveyor roller set 182. The platen roller 180 is driven by conveyance of the recording sheet 176, and rotates in the counterclockwise direction about the platen roller shaft 185. During the conveyance of the recording sheet 176, the front edge of a recording area reaches the position of the heating element array 179*a*. Each of the heating elements generates heat energy associated with the respective pixels of a yellow image, to print it line by line to the yellow coloring layer. The recording sheet 176 after the yellow printing is moved past the underside of the yellow fixer 190 and a magenta fixer 194, until the front end of the recording sheet 176 protrudes from the ejection opening 177.

When the thermal recording to the yellow coloring layer of the recording sheet 176 is finished, the thermal head 179 stops being driven, and moves to the retracted position. Immediately the fixer lamp 191 of the yellow fixer 190 is turned on. The conveyor roller set 182 starts rotating in the backward direction, to convey the recording sheet 176 toward the insertion opening 175 with the rear end 176*b* moved ahead.

While the recording sheet 176 is conveyed in the backward direction, near ultraviolet rays from the fixer lamp 191 at 420 nm are applied to the recording sheet 176, so as to prevent the yellow color from being further developed in the course of magenta printing.

Ultraviolet rays from the fixer lamp 191 are partially intercepted by the pinch roller 188. However the reflector 192 causes the fixer to have the ray applying distribution of FIG. 19B, in which a periphery of the fixer has greater amount of rays than a position directly under the fixer lamp 191. Consequently the yellow coloring layer is fixed in an efficient manner. A portion with a range Lc4 at the rear end 176*b* of the recording sheet 176 becomes a non-printing margin because of insufficient fixation or over-fixation. But the range Lc4 of the present invention is smaller than the counterpart according to the known printer by an amount of a sum (Ly+Rn), where Ly is the width of the yellow fixer 190 and Rn is the radius of the pinch roller 188.

When the front edge of the recording sheet 176 comes again to the position of the heating element array 179*a,* the conveyor roller set 182 is stopped. The fixer lamp 191 is turned off. Again the thermal head 179 is moved to the printing position. The conveyor roller set 182 is rotated forwards to convey the recording sheet 176 in the forward direction. The thermal head 179 generates heat energy in accordance with a magenta image, and applies it to the magenta coloring layer for magenta printing.

The magenta image finishes being printed at an rear end of the recording area on the recording sheet 176 as viewed in the forward direction. Again the thermal head 179 moves to the retracted position and stops pushing the recording sheet 176. The conveyor roller set 182 is stopped. In a manner the same as the yellow printing, the conveyor roller set 182 immediately starts rotation in the backward direction. At the same time a fixer lamp 195 of the magenta fixer 194 included in the optical fixer unit is turned on. The fixer lamp 195 applies ultraviolet rays to the recording sheet 176 in the wavelength range of 365 nm, so as to prevent the magenta color from being further developed in the course of cyan printing. Referenced by 196 is a reflector.

When the front edge of the recording sheet 176 moves to the position of the heating element array 179*a,* the thermal head 179 is moved to the printing position in the same manner as before. The conveyor roller set 182 is rotated forwards to convey the recording sheet 176 in the forward direction. The thermal head 179 applies heat energy to the cyan coloring layer for cyan printing.

When the thermal recording to all the coloring layers is finished, the conveyor roller set 182 ejects the recording sheet 176 through the ejection opening 177. Note that the cyan coloring layer does not have fixability because the minimum coloring heat energy for the cyan coloring layer is so great that it is not colored in an ordinary preserving condition of room temperature. The yellow and magenta fixers 190 and 194 do not operate.

In the above present embodiment, the yellow fixer 190 is confronted with the conveyor roller set 182. Alternatively a yellow fixer 200 of FIG. 20A may be used. The yellow fixer 200 includes two parallel ultraviolet lamps with a small diameter, between which a position of a pinch roller 201 is determined. Let the yellow fixer 200 have the width of Ly/2. The distance Ld1 between a platen roller 202 and a conveyor roller set 203 is determined as $$Ld1=Ls+Ly/2+Rn.$$

A margin range Ld2 of the recording sheet 176 at the front end 176*a* is determined as $$Ld2=Ld1+\alpha.$$

In a range Ld3 defined between the conveyor roller set 203 and an end of the yellow fixer 200 as viewed in the forward direction, fixation of the rear end 176*b* of the recording sheet 176 by means of the yellow fixer 200 becomes insufficient fixation or over-fixation. Therefore a margin of a range Ld4 of the rear end 176*b* of the recording sheet 176 is defined as a sum (Ld3+α), where a is a space of the recording sheet 176 in which the conveyor roller set 203 nips it.

Accordingly the margin range Ld2 of the front end 176*a* of the recording sheet 176 in the present embodiment can be determined smaller than the margin range Lb2 of the front end of the recording sheet in the known printer of FIGS. 17A and 17B by the amount of:

$$(Ls+Ly+Rn)-(Ls+Ly/2+Rn)=Ly/2.$$

Also the margin range Ld4 of the rear end 176*b* of the recording sheet 176 in the present embodiment can be determined smaller than the margin range La4 of the rear end of the recording sheet in the known printer of FIGS. 16A and 16B by the amount of:

$$(Ly+Rn)-(Ly/2+Rn)=Ly/2.$$

Moreover the size of the printer can be reduced in the direction of its height.

Figure 21:
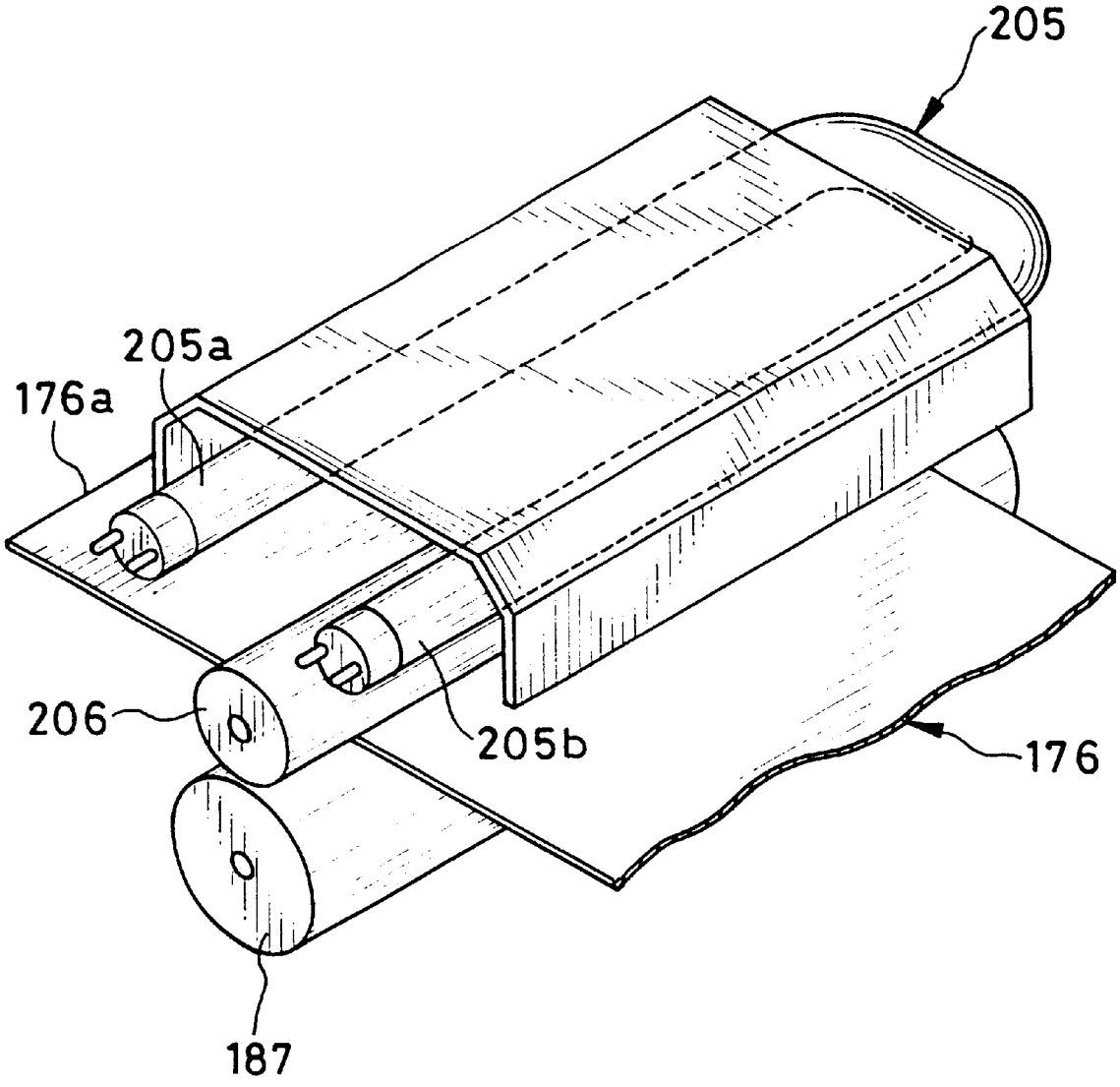
FIG. 21 is a perspective illustrating a further preferred embodiment of a fixer lamp.

In the above embodiments, the two lamps are combined as single fixer. In FIG. 21, an ultraviolet lamp 205 of a small shape may have a U-shape including two straight portions 205*a* and 205*b*, between which a pinch roller 206 may be positioned.

In the above embodiment, the disposition, the shape and the like of the yellow fixer is improved. Instead of the above-described recording sheet, a recording sheet may have magenta, yellow and cyan coloring layers among which the magenta coloring layer is disposed at a recording surface farthest from the support. Improvement of the disposition, the shape and the like may be used in the magenta fixer according to the present invention. It is possible in the present invention to use the above structure in a monochromatic thermal printer instead of the color thermal printer.

In the above embodiments, the reduction of the size of the printer and decrease in its manufacturing cost are intended. Recording material is supplied manually without constructing a supply mechanism. Or the conveying path for the recording sheet is shortened. However there remains a problem in which the recording sheet emerges out of the printer casing when conveyed for the supply or the thermal recording. Ambient light becomes incident upon the recording surface of the recording sheet partially emerging externally. Coloring layers having fixability are partially optically decomposed and partially fixed. Coloring ability of the coloring layers is lowered, to lower coloring density of yellow or magenta images.

To solve this problem, another preferred thermal printer, together with a printing method, is described with reference to FIGS. 22–27.

Figure 24:
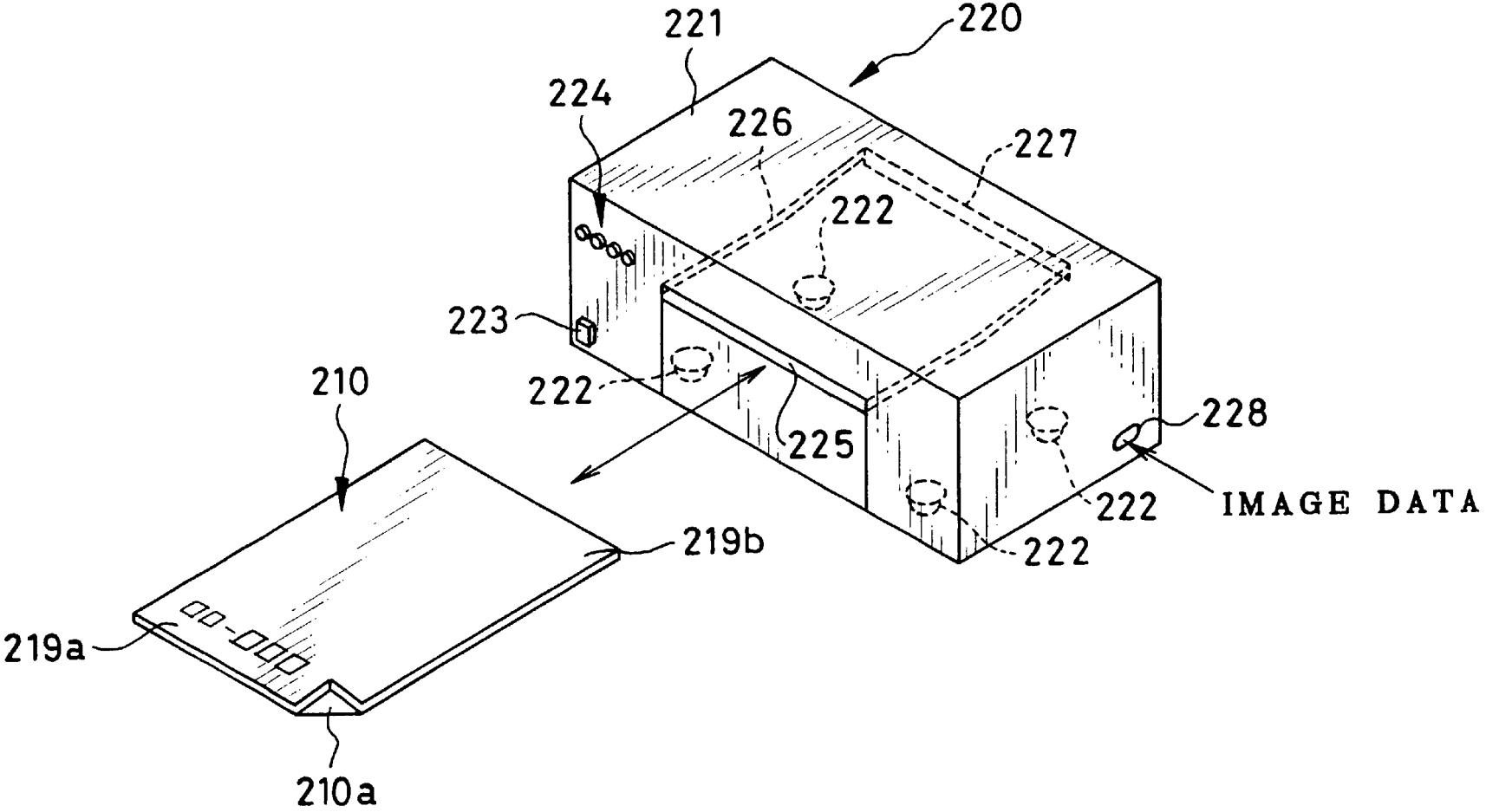
FIG. 24 is a perspective illustrating another preferred color thermal printer in which the recording sheet is oriented downwards.
Figure 25:
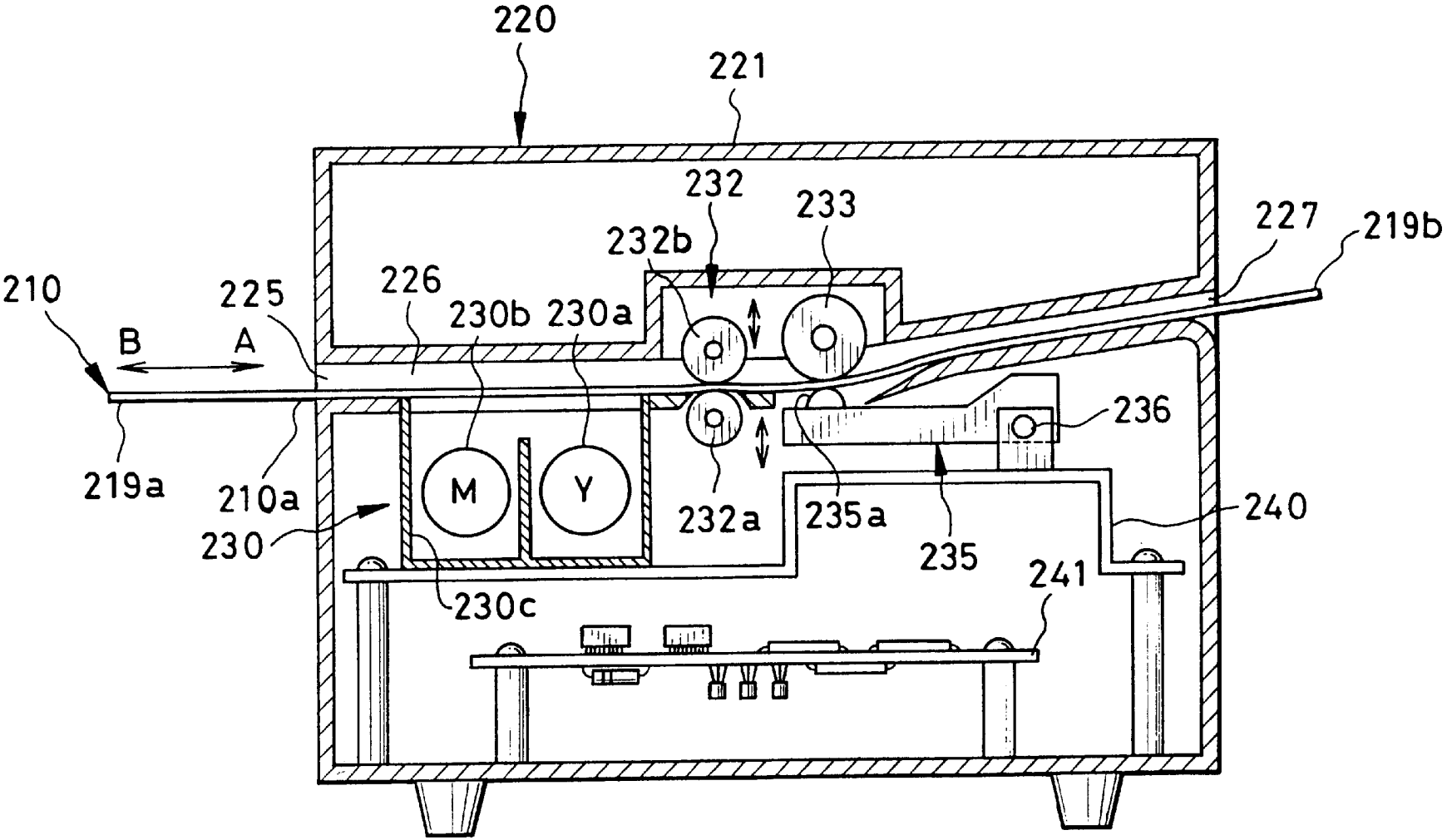
FIG. 25 is a vertical section illustrating the thermal printer.

In FIG. 24, a color thermal printer 220 is so simple that it does not have a sheet supply cassette or a mechanism for the supply/ejection. A color thermosensitive recording material or sheet 210 is manually supplied for the printer, and used for color printing of a color image. The recording sheet 210 has a postcard size of 100×148 mm. The thermal printer 220 has a printer casing 221 on which legs 222 are disposed. The thermal printer 220 is placed on a horizontal table or the like when used.

On the front side of the printer casing 221, there are a power switch 223 and an indicator lamp 224, which displays information of a printing state and an error. An insertion opening 225 is formed in the center of the printer casing 221 to extend horizontally in a slot shape. A conveying path 226 extends inside the printer casing 221 in a substantially straight manner and is connected with the insertion opening 225.

In supplying the recording sheet, ambient light, for example solar light or indoor fluorescent light, is likely to be directly incident upon a recording surface 210*a* of the recording sheet 210 to decompose magenta and yellow coloring layers with an ultraviolet component included in the ambient light. To prevent this, the recording surface 210*a* of the recording sheet 210 is oriented downwards, for examples to the upside of a table or a floor. A rear end 219*b* of the recording sheet 210 is advanced and inserted through the insertion opening 225 into the conveying path 226. After the thermal recording of an image to the recording sheet 210, its front end 219*a* will be advanced through the insertion opening 225 to exit from the printer through it with the recording surface 210*a* directed downwards.

The conveying path 226 extends from the insertion opening 225 toward the rear of the printer casing 221, and is connected with an auxiliary opening 227, which is formed in the rear of the printer casing 221 to extend horizontally in a slot shape. During the printing operation, the front and rear ends of the recording sheet 210 are moved through the insertion opening 225 and the auxiliary opening 227 and out of the printer casing 221. In other words the conveying path 226 is determined with a relatively small length as compared with the recording sheet 210, to reduce the size of the printer casing 221.

An input terminal 228 is disposed on the front of the printer casing 221. An external computer is connected with the input terminal 228, and inputs image data of yellow, magenta and cyan of an image to be recorded.

A conveyor roller set 232 is disposed in the conveying path 226 and in a position nearer to the auxiliary opening 227 than an optical fixer unit 230. The conveyor roller set 232 includes a capstan roller 232*a* in a lower position and a pinch roller 232*b* in an upper position. The capstan roller 232*a* is driven by a stepping motor (not shown). The pinch roller 232*b* is rotated by movement of the recording sheet 210. The pinch roller 232*b* is movable up and down, and is in a standby position and in contact with the capstan roller 232*a* before supply of the recording sheet 210. Upon the supply of the recording sheet 210, the recording sheet 210 is drawn between the pinch roller 232*b* and the capstan roller 232*a*, so that the pinch roller 232*b* is moved upwards by an amount as much as the thickness of the recording sheet 210 to nip it.

After the rear end 219*b* of the recording sheet 210 is nipped by the conveyor roller set 232, the capstan roller 232*a* is rotated by the stepping motor in the forward and backward directions, to convey the recording sheet 210 toward the insertion opening 225 and toward the auxiliary opening 227 in an alternate manner, namely back and forth. The recording surface 210*a*, while the recording sheet 210 is conveyed in the conveying path 226, is oriented downwards. Of course the portions emerging out of the insertion opening 225 and the auxiliary opening 227 are oriented to direct the recording surface 210*a* downwards. Note that there is a sensor (not shown) such as a photo sensor disposed beside the conveyor roller set 232 for detecting the front end 219*a* of the recording sheet 210 when the recording sheet 210 is conveyed toward the auxiliary opening 227.

To be precise, the sensor is disposed near to the conveyor roller set 232 and on the side nearer to the insertion opening 225, like the sensors 75 and 148.

The fixer unit 230 and a thermal head 235 are disposed on a base plate 240. Under the base plate 240 are disposed a printed circuit board 241 and a power source unit (not shown). The printed circuit board 241 has electronic circuits including an image memory for storing an image to be recorded, and a printing control unit. The power source unit is adapted to supply power for driving the thermal head 235 and the fixer unit 230.

Figure 22:
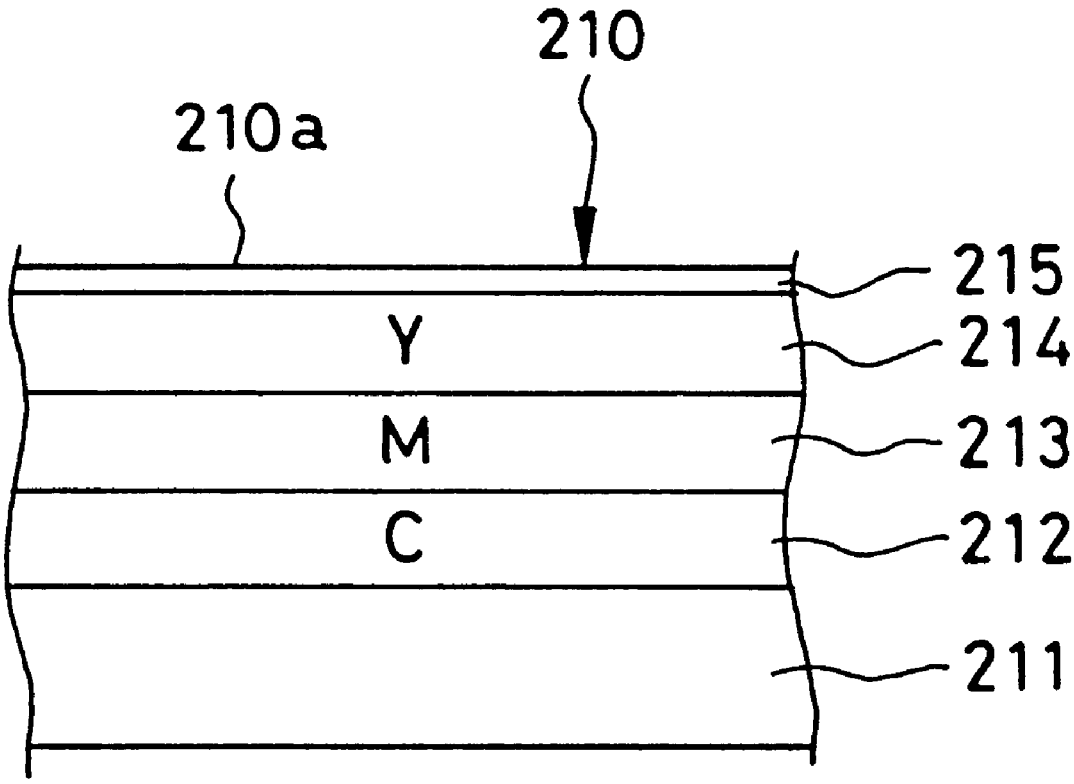
FIG. 22 is an explanatory view in section, illustrating a layered structure of the recording sheet.
Figure 23:
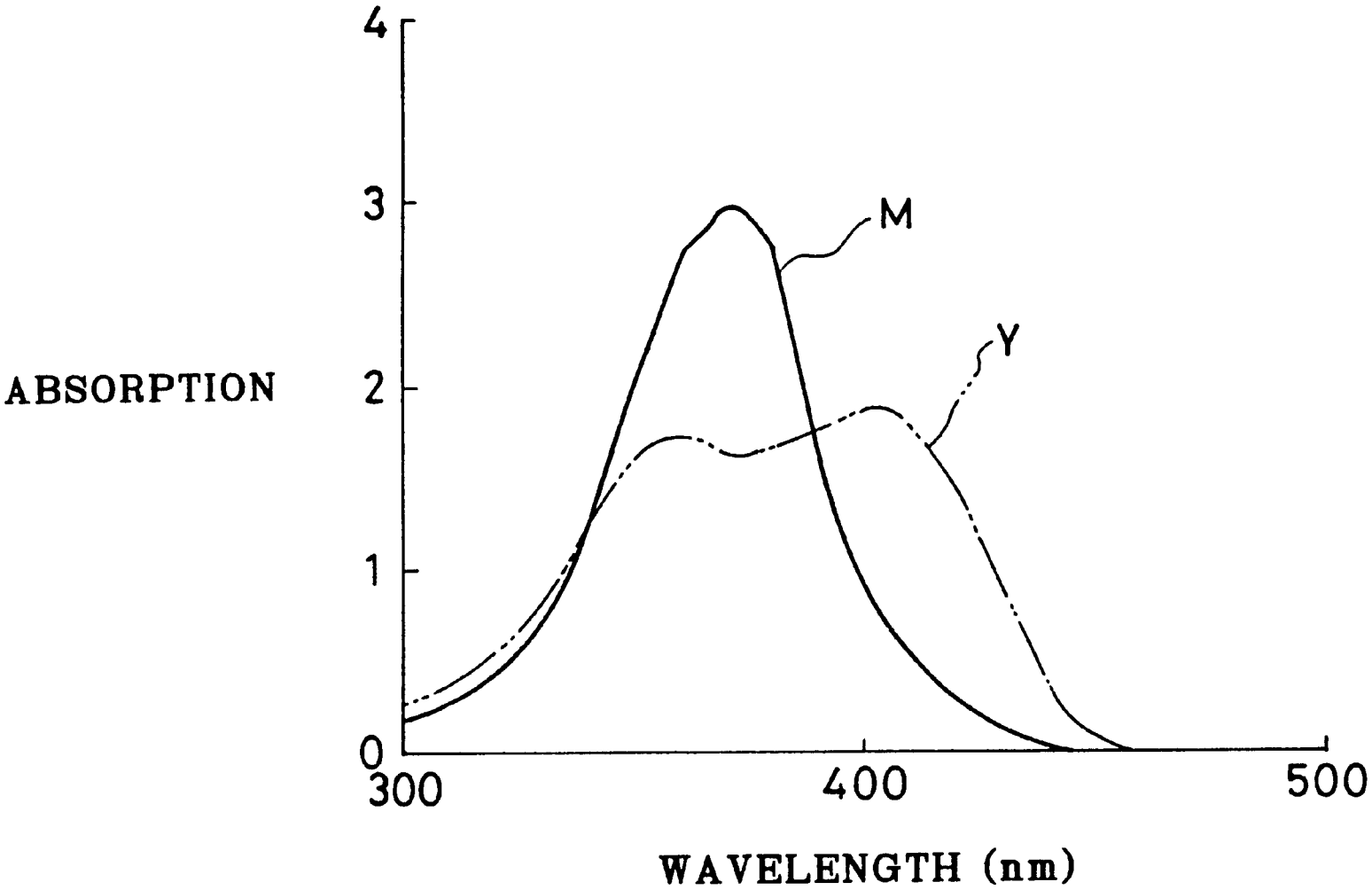
FIG. 23 is a graph illustrating optical fixability of yellow and magenta coloring layers of the recording sheet.

The recording sheet 210 is depicted in FIG. 22, and includes a support 211, a cyan thermosensitive coloring layer 212, a magenta thermosensitive coloring layer 213, and a yellow thermosensitive coloring layer 214. A protective layer 215 is disposed over the yellow coloring layer 214 on the recording surface 210*a* of the recording sheet 210. The yellow coloring layer 214 and the magenta coloring layer 213 have characteristics of optical fixability to ultraviolet rays of wavelength ranges depicted in FIG. 23. The support 211 consists of material impermeable to ultraviolet rays of those wavelength ranges determined for the magenta and yellow coloring layers 213 and 214, and is for example opaque coated paper, plastic film or the like.

The coloring layers 212–214 are disposed in the order of printing among the colors. It is possible to use an alternative recording sheet in which the magenta coloring layer is located at the recording surface and the cyan coloring layer is the deepest. In association with this, the wavelength ranges of ultraviolet fixation imparted to the coloring layers must be determined in an exchanged manner. Note that there are intermediate layers between adjacent ones of the coloring layers 212–214 for adjusting thermal sensitivity, although not shown in the drawings.

The operation of the above embodiment is described now. To print a full-color image, an external computer is connected to the input terminal 228, to cause the thermal printer 220 to retrieve yellow, magenta and cyan image data of the image to be recorded.

After retrieving the image, the one recording sheet 210 is manually picked up among those pre-contained in a container bag. The recording sheet 210 is oriented with the recording surface 210*a* directed downwards, inserted into the insertion opening 225 with the rear end 219*b* moved ahead, and moved for contact with the conveyor roller set 232 in the conveying path 226. If the recording sheet 210 is a postcard type of which a back surface has a train of squares for a postal zone code number, the code squares are directed upwards and in reverse to the advancing direction upon insertion in the insertion opening 225. The rear end 219*b* is inserted through the insertion opening 225.

It is possible that, if an image is recorded in a process from the final line to the first line in reverse to the above, the recording sheet 210 is inserted by advancing the front end 219*a*. It is preferable that, in taking the recording sheet 210 out of a container bag, the recording surface 210*a* should be directed downwards to avoid incidence of ambient light. The opening of the fixer unit 230 open in the inside of the conveying path 226 is actually smaller than is depicted. Thus the rear end 219*b* of the recording sheet 210 does not enter the fixer unit 230. This is for another reason of high rigidity of the recording sheet 210.

When the rear end 219*b* of the recording sheet 210 is moved to the conveyor roller set 232, the capstan roller 232*a* starts being rotated in its forward direction. The rear end 219*b* of the recording sheet 210 is drawn into the path between the capstan roller 232*a* and the pinch roller 232*b*, and nipped by them. The recording sheet 210 is conveyed toward the auxiliary opening 227 with its recording surface directed downwards in the conveying path 226.

When the front end 219*a* of the recording sheet 210 reaches the position of the conveyor roller set 232, the capstan roller 232*a* stops being rotated in the forward direction, to stop conveyance of the recording sheet 210. The rear end 219*b* of the recording sheet 210 is exposed out of the auxiliary opening 227 with the recording surface 210*a* directed downwards.

After the stop of the conveyance, the thermal head 235 is swung to the push position to press a heating element array 235*a* against the recording surface 210*a* of the recording sheet 210. A yellow fixer lamp 230*a* of the fixer unit 230 is turned on. The capstan roller 232*a* is rotated backwards, to convey the recording sheet 210 toward the insertion opening 225 in the forward direction. In the course of this conveyance, a front edge of the recording area of the recording sheet 210 comes to the heating element array 235*a*, of which the respective heating elements are driven according to the yellow image data. Coloring heat energy is provided for the recording sheet 210 to reproduce pixels of the yellow image. Accordingly the yellow image is printed to the recording sheet 210 one line after another. Note that a numeral 230*c* designates a reflector, 233 a platen roller, and 236 a rotational shaft.

When a portion of the recording sheet 210 with a yellow image recorded thereon reaches the upside of the fixer unit 230, the yellow fixer lamp 230*a* applies yellow fixing ultraviolet rays to fix the yellow coloring layer 214 optically. The fixed portion of the recording sheet 210 is moved through the insertion opening 225 out of the printer casing 221 while the front end 219*a* is moved ahead. The recording surface 210*a* remains oriented downwards. After printing to the entirety of the recording area by use of the thermal head 235, the recording sheet 210 is conveyed further by the conveyor roller set 232 to apply yellow fixing ultraviolet rays to the recording area.

When ultraviolet rays for the yellow fixation are applied to the whole of the recording area, the yellow fixer lamp 230*a* is turned off. The thermal head 235 is swung back to the retracted position. Then the rotational direction of the conveyor roller set 232 is changed over, so that the recording sheet 210 is conveyed toward the auxiliary opening 227 and in the backward direction. The front end 219*a* of the recording sheet 210 placed outside the insertion opening 225 is drawn back into the conveying path 226. In turn the rear end 219*b* is moved out of 221 through the auxiliary opening 227. Of course the recording surface 210*a* remains oriented downwards.

When the front end 219*a* of the recording sheet 210 comes to the position of the conveyor roller set 232, a rotational direction of the conveyor roller set 232 is changed over. When the front end of the recording area comes to the thermal head 235, the thermal head 235 is swung to the push position. The magenta image is printed to the recording sheet 210 one line after another. A magenta fixer lamp 230*b* of the fixer unit 230 is kept turned on. When the recording area with the magenta image recorded thereon comes to the upside of the fixer unit 230, magenta fixing ultraviolet rays are applied to the recording sheet 210 to fix the magenta coloring layer 213.

After the finish of the magenta recording and the fixation, the thermal head 235 is swung back to its retracted position. The conveyor roller set 232 is rotated backwards, to convey the recording sheet 210 back toward the auxiliary opening 227. Then the rotational direction of the conveyor roller set 232 is changed over, so that the recording sheet 210 is conveyed toward the insertion opening 225. During the conveyance the thermal head 235 prints a cyan image to the recording sheet 210 one line after another.

In the course of the cyan printing, the recording sheet 210 is conveyed toward the insertion opening 225 in the direction of moving ahead the front end 219*a*. The magenta fixer lamp 230*b* remains turned on. The rear end 219*b*, which has not received fixing rays, is caused to receive magenta fixing ultraviolet rays, and is bleached. The recording sheet 210 after all the recording and the optical fixation is moved through the insertion opening 225 to the outside of the printer casing 221. It is to be noted that the ejecting operation may be incompletely finished when the rear end 219*b* is nipped lightly between the conveyor roller set 232. Then a user's hand may manually pull the rear end 219*b* to remove the recording sheet 210 from the insertion opening 225.

The front and rear ends of the recording sheet 210 emerge out of the printer casing 221 in the back-and-forth conveyance. The recording surface 210*a* is directed downwards and free from being directly influenced by fluorescent light or other harmful ambient light. The coloring characteristics of the magenta and yellow coloring layers 213 and 214 are not affected with ambient light. It is certain that reflected light of the ambient light is incident upon the recording sheet 210 due to the table or floor where the printer casing 221 is placed. However the reflected light has no influence to the recording sheet 210, because the reflected light includes an excessively small amount of ultraviolet rays.

The coloring layers 212–214 are colored at density without being lowered, according to coloring heat energy imparted to the recording sheet 210. Thus a full-color image of a high quality is recorded on the recording sheet 210 being ejected. The movement of the recording sheet 210 toward the outside of the printer casing 221 is effected while the recording surface 210*a* is directed downwards. Thus no dust or dirt floating in the indoor air sticks on the recording surface 210*a* in this movement.

Figure 26:
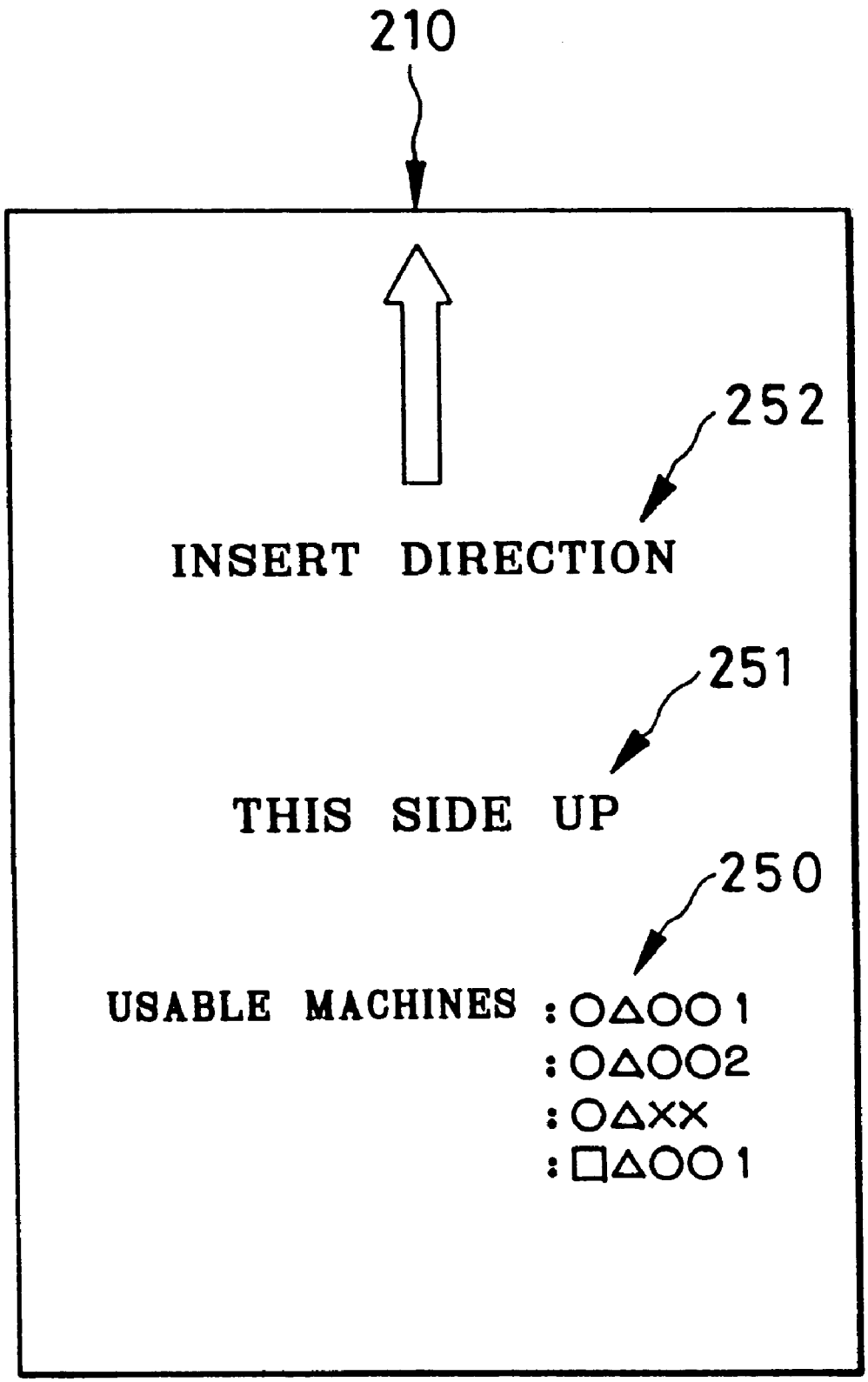
FIG. 26 is a plan illustrating the recording sheet of which a back surface is orientations upwards.

In FIG. 26, the back surface of the recording sheet 210 is depicted, and includes printed information of a machine type indication 250, an orienting instruction 251 and a directing instruction 252. The machine type indication 250 indicates plural types of thermal printers usable with the recording sheet 210. The orienting instruction 251 is a phrase THIS SIDE UP for instructing a user to orient the back surface upwards. The directing instruction 252 indicates the direction of insertion of the recording sheet 210. Consequently it is possible for the user to supply the printer with the sheet without errors.

Figure 27A:
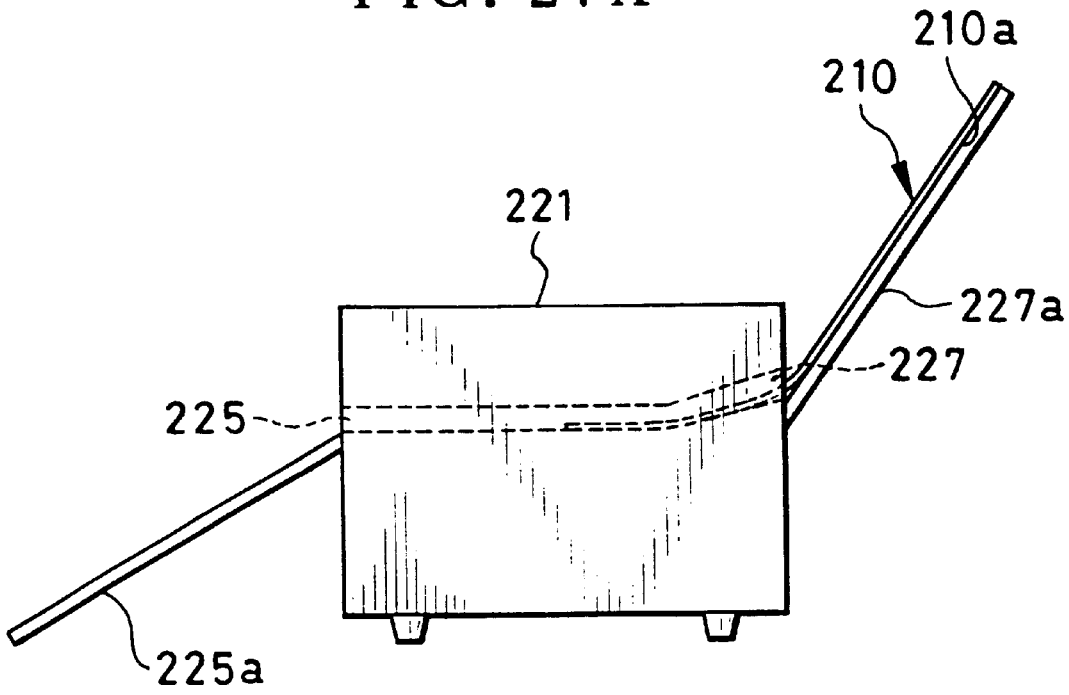
FIG. 27A is a side elevation illustrating the thermal printer where the recording sheet emerges out of an auxiliary opening.
Figure 27B:
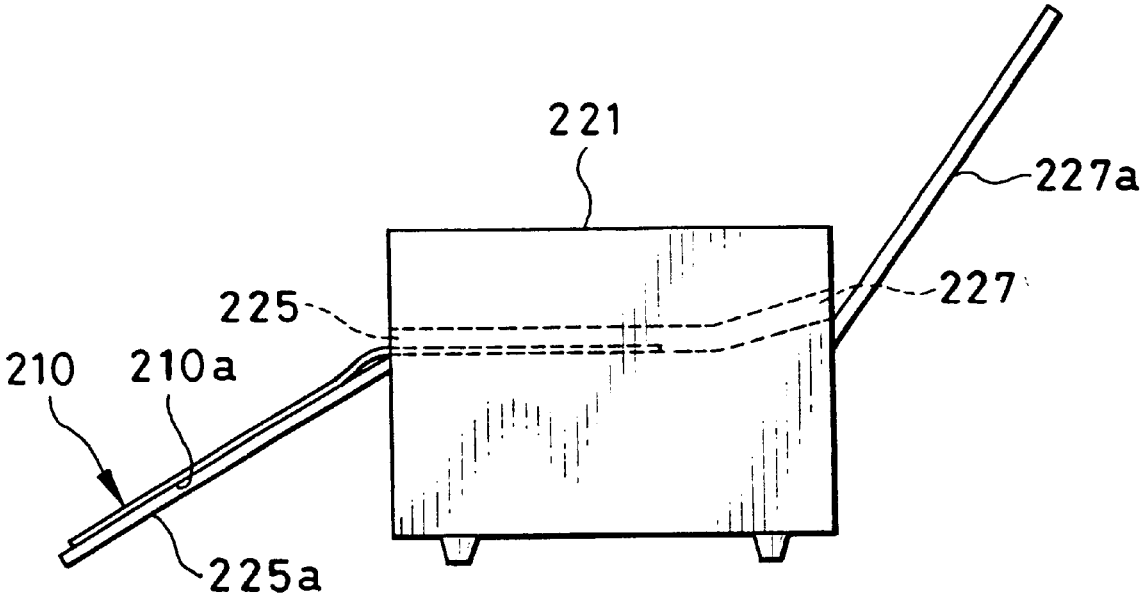
FIG. 27B is a side elevation illustrating the thermal printer where the recording sheet emerges out of an insertion opening.
Figure 28:
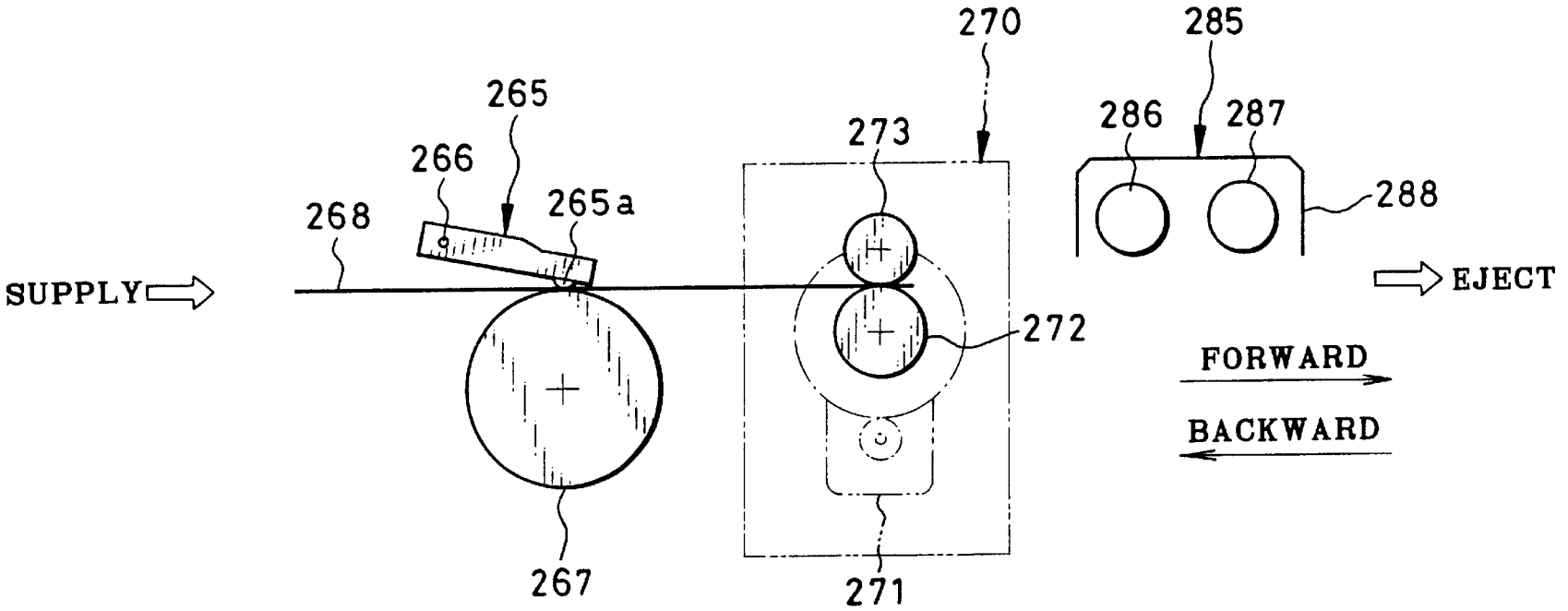
FIG. 28 is an explanatory view in elevation, illustrating still another preferred color thermal printer having an improved conveyor roller set.

As depicted in FIGS. 27A and 27B, inclined plates 225*a* and 227*a* can be disposed on the outside of the insertion opening 225 and the auxiliary opening 227 with inclination. They make it possible to prevent the recording sheet 210 from being bent by a wall of the room or the like, and from being contaminated by a floor or the like. Also the recording surface 210*a* of the recording sheet 210 entirely contacts the inclined plates 225*a* and 227*a*, and can be protected from incidence of ambient light.

In the present embodiment, the recording sheet is manually inserted. Alternatively a sheet feeder tray or cassette may be used for containing plural recording sheets and for automatically feeding the sheets. A roll of continuous recording material may be prepared and set in a supply station. The continuous recording material may be cut into separate sheets. Moreover it is possible to combine the manual insertion, the use of the sheet feeder tray, and/or the use of the roll. In any of those structures, the conveying path can be shortly determined. Portions of sheets emerging out of the printer casing can be protected from ambient light by orientation of the recording surface downwards. It is possible to construct the printer casing with a reduced size.

In the above embodiment, the recording surface of the recording sheet is directed downwards. The thermal head and the fixer are disposed under the conveying path. Alternatively a conveying path may be formed in a shape of being bent back like a letter U or J. The thermal head and the fixer may be disposed in a position at a top of a portion of the conveying path where the recording surface of the recording sheet is locally directed upwards. Furthermore, it is possible inside the printer casing to form spaces for temporarily containing portions of the recording sheet exiting from the conveying path. The entirety of the recording sheet is contained in the printer casing except for the sheet supply, in which the recording sheet before fixation is exposed outside the printer casing.

In the above embodiments, the capstan roller and the pinch roller are shaped with small diameters for the purpose of reducing the size of the printer. Typical material used for constructing the capstan roller and the pinch roller is rubber or the like. If the capstan roller and the pinch roller remain pressed against one another with time, contact portions of the rollers cause irrecoverable deformation to them. This deformation makes it impossible to convey the recording sheet with stability. It is likely that there occurs failure in registering the colors of the image to be recorded on the recording sheet, or irregularity in conveying the recording sheet.

When high intensity is desired for a pinch roller and a capstan roller having a small diameter, they may be manufactured with metal. It is general that a roller portion of the capstan roller is finished with a knurled surface or roulette surface. If the pinch roller is kept pressed against the capstan roller for a long time, it is likely that the pinch roller is scratched or damaged. There occurs a problem in that the pinch roller with a damage fails to convey a recording sheet straight.

To solve those problems, a further preferred embodiment is described now by referring to FIGS. 28–35.

A recording sheet conveyor device 270 is disposed in a position downstream from a thermal head 265 for conveying color thermosensitive recording material or sheet 268. The sheet conveyor device 270 includes a capstan roller 272 and a rotatable pinch roller 273. The capstan roller 272 is rotated by a stepping motor 271.

The sheet conveyor device 270 is supplied with the recording sheet 268, which is nipped between the capstan roller 272 and the pinch roller 273 when a front end of the recording sheet 268 comes to them. The stepping motor 271 is rotated in the forward and backward directions, to rotate the capstan roller 272 forwards and backwards. The recording sheet 268 is conveyed in the forward direction from a supply side to an ejection side, and in the backward direction from the ejection side to the supply side.

Figure 29:
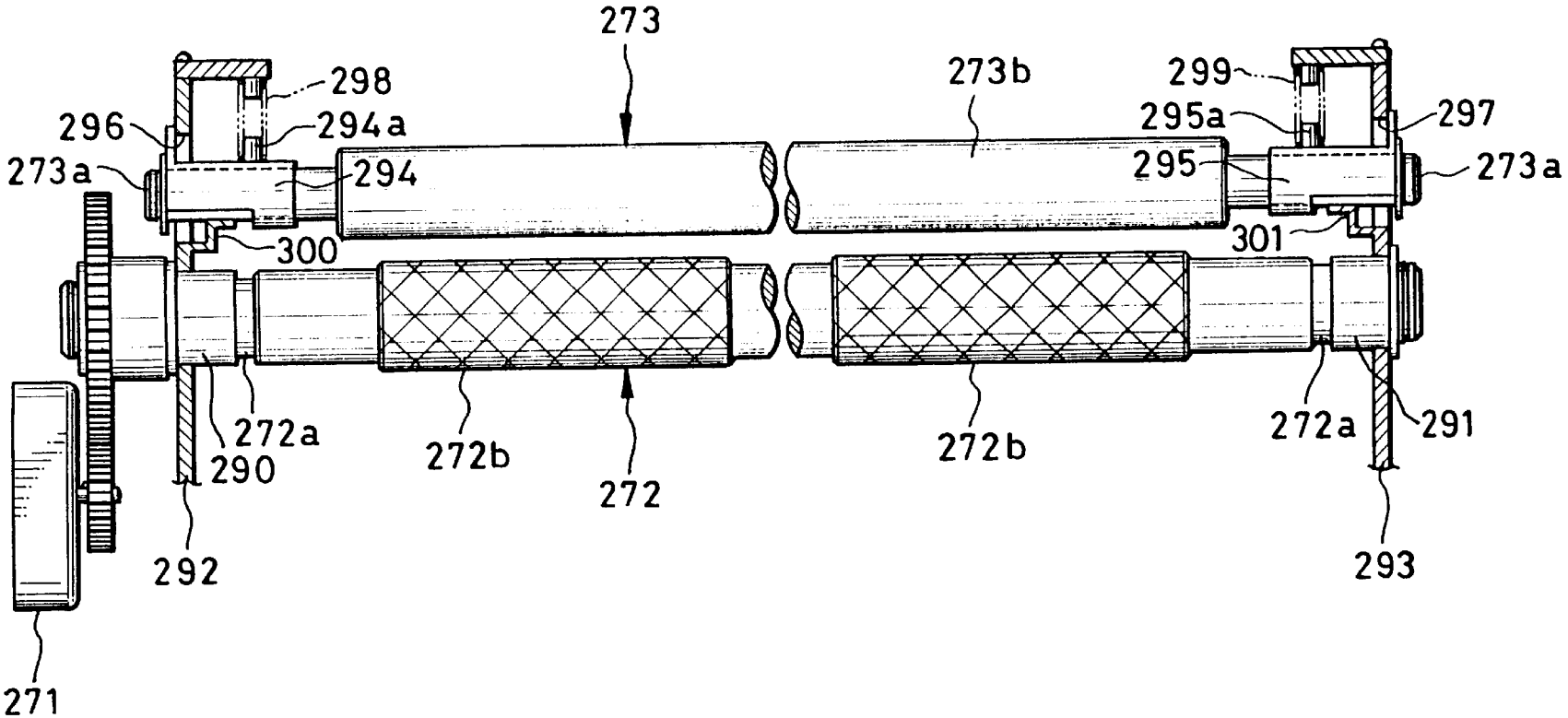
FIG. 29 is a front elevation illustrating the conveyor roller set in a state before nipping the recording sheet.

In FIG. 29, the capstan roller 272 is constituted by shaft portions 272*a* and a roller portion 272*b*. Distal ends of the shaft portions 272*a* are supported by lateral plates or support plates 292 and 293 as pinch roller supporters and via receiver members 290 and 291. The periphery of the roller portion 272*b* has a diameter greater than the shaft portions 272*a*. Also the pinch roller 273 is constituted by shaft portions 273*a* and a roller portion 273*b*.

The capstan roller 272 and the pinch roller 273 are formed by use of iron or other metal, and pieces respectively including the shaft portions 272*a* and the roller portion 272*b* and including the shaft portions 273*a* and the roller portion 273*b*. This use of metal is advantageous in both low cost of material and low manufacturing cost. Also the rollers can be shaped with high precision, and with suitability for recording sheet with a small thickness. It is to be noted that the roller portion 272*b* is finished with a minutely knurled surface or roulette surface for the purpose of reliable conveyance of the recording sheet 268.

The shaft portions 273*a* of the pinch roller 273 are inserted in respective receiver members 294 and 295. The receiver members 294 and 295 are inserted in respective slots 296 and 297 formed in the support plates 292 and 293. The slots 296 and 297 have a width as long as an outer diameter of the receiver members 294 and 295, and extend in a direction of setting the pinch roller 273 movable away from the capstan roller 272. The pinch roller 273 is movable between a near position and a retracted position, and when in the near position, is close to the capstan roller 272, and when in the retracted position, is moved away from the capstan roller 272.

The receiver members 294 and 295 of the pinch roller 273 have spring receivers 294*a* and 295*a*. There are springs 298 and 299 as bias mechanism, secured to the spring receivers 294*a* and 295*a*, for biasing the pinch roller 273 toward the capstan roller 272.

The support plates 292 and 293 have respective regulator projections 300 and 301 for regulating a position of the pinch roller 273. The regulator projections 300 and 301 contact the shaft portions 273*a* of the pinch roller 273 in such a position that a distance between the roller portion 273*b* of the pinch roller 273 and the roller portion 272*b* of the capstan roller 272 becomes smaller than the thickness of the recording sheet 268.

It is possible to form the regulator projections 300 and 301 in a manner separate from the support plates 292 and 293. Of course the regulator projections 300 and 301 may be formed by bending portions of the support plates 292 and 293 when opening the slots 296 and 297 by punching.

The operation of the present embodiment is described now. When a print start key (not shown) is operated, a sheet supply process is started at first. The recording sheet 268 is sent from a sheet supply cassette (not shown) and conveyed to the thermal head 265. In the supply operation, the thermal head 265 is located in the retracted position away from a platen roller 267. At the same time, the stepping motor 271 is driven to rotate the capstan roller 272 in a direction to move the recording sheet 268 in the forward direction. Referenced by 265*a* is a heating element array, and by 266 is a support shaft.

Figure 30:
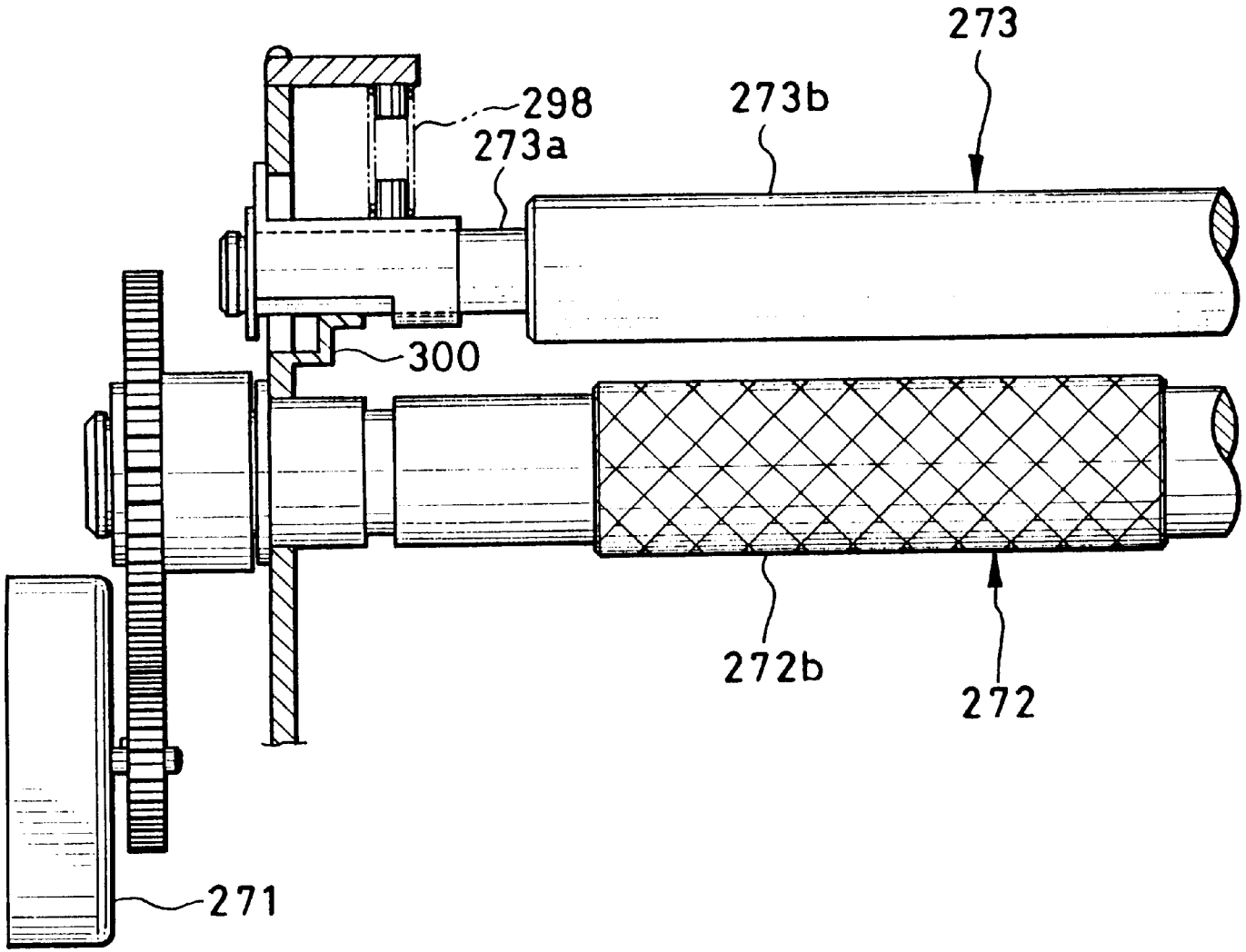
FIG. 30 is a front elevation, partially cutaway, illustrating the same as FIG. 29.

In FIG. 30, axial ends of the shaft portions 273*a* of the pinch roller 273 are regulated by the regulator projections 300 and 301. There is a space between the roller portions 272*b* and 273*b*, so that the roller portion 273*b* is protected from being scratched by contact with the knurled surface or roulette surface.

The recording sheet 268 being supplied is moved between the thermal head 265 and the platen roller 267, toward the gap between the pinch roller 273 and the capstan roller 272. When the front end of the recording sheet 268 comes to the gap between the pinch roller 273 and the capstan roller 272, rotation of the capstan roller 272 causes the roller portion 272*b* and 273*b* to nip the recording sheet 268.

Figure 31:
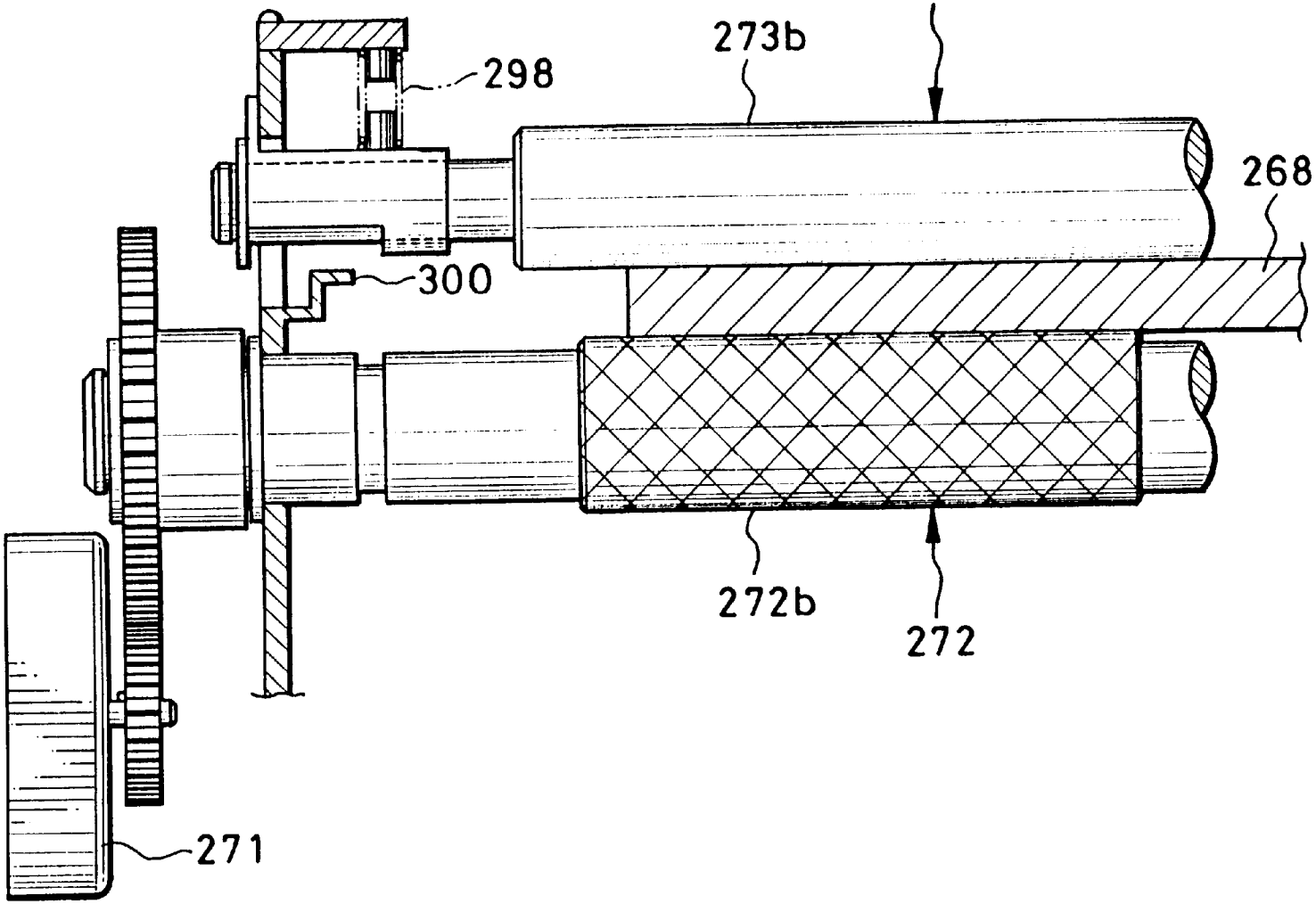
FIG. 31 is a front elevation, partially cutaway, illustrating the conveyor roller set in a state during nipping the recording sheet.

The space between the roller portions 272*b* and 273*b* is smaller than a thickness of the recording sheet 268. Upon insertion of the front end of the recording sheet 268 into this space, the thickness of the recording sheet 268 causes the pinch roller 273 to move toward the retracted position as illustrated in FIG. 31 against the bias of the springs 298 and 299. The bias of the springs 298 and 299 causes the pinch roller 273 and the capstan roller 272 to nip the recording sheet 268.

The recording sheet 268 is conveyed by rotation of the capstan roller 272 while nipped between the roller portions 272*b* and 273*b*. When a front end of the recording sheet 268 is detected by a position sensor (not shown), the sheet supply process is finished. The stepping motor 271 is stopped from rotation.

When the thermal head 265 finishes moving to the printing position, the stepping motor 271 is driven again, to convey the recording sheet 268 in the forward direction between the capstan roller 272 and the pinch roller 273.

During this conveyance, the thermal head 265 pushes the recording sheet 268. The heating elements generate heat energy according to yellow image data, to record a yellow image into a recording area on the recording sheet 268 one line after another. During the thermal recording, a yellow fixer lamp 286 of an optical fixer 285 is turned on, to fix the yellow coloring layer after the thermal recording. Referenced by 288 is a reflector.

When the yellow image finishes being printed to the recording area, the thermal head 265 moves back to the retracted position. The stepping motor 271 stops and then rotates backwards. The capstan roller 272 rotates in the counterclockwise direction, to convey the recording sheet 268 in the backward direction.

When the front end of the recording area of the recording sheet 268 is detected by the position sensor, the stepping motor 271 is stopped. The thermal head 265 is moved to the printing position. The stepping motor 271 is rotated in the forward direction. The recording sheet 268 is conveyed again in the forward direction in a stable manner. A magenta image is printed by the thermal head 265, and fixed by a magenta fixer lamp 287.

When the magenta image finishes being printed to the recording area, the thermal head 265 moves back to the retracted position. The stepping motor 271 stops and then rotates backwards. The capstan roller 272 rotates counterclockwise, to convey the recording sheet 268 in the backward direction.

When the recording sheet 268 finishes being moved back, the stepping motor 271 stops. The thermal head 265 is moved to the printing position. The stepping motor 271 rotates in the forward direction. Again the recording sheet 268 is stably conveyed in the forward direction, while the thermal head 265 prints a cyan image. There is no operation of fixing the cyan coloring layer, because the cyan coloring layer does not have fixability.

When the cyan image finishes being printed to the recording area, the capstan roller 272 makes further rotation to eject the recording sheet 268 to an ejector tray (not shown). During the conveyance in the ejecting direction, the magenta fixer lamp 287 is turned on to bleach the recording sheet 268. When the recording sheet 268 finishes being ejected, the stepping motor 271 is stopped. The magenta fixer lamp 287 is turned off.

When the recording sheet 268 is moved between the capstan roller 272 and the pinch roller 273 in the sheet ejection, the pinch roller 273 is moved to the position of regulation of the regulator projections 300 and 301 against the bias of the springs 298 and 299. The pinch roller 273 stands by in a position away from the capstan roller 272.

Note that the pinch roller 273 and the capstan roller 272, when in a standby condition, may be positioned with a space depending upon the thickness of the recording sheet, and for example with a preferable space or distance of 50 $\mu$m when the recording sheet is 250 $\mu$m thick.

Figure 32:
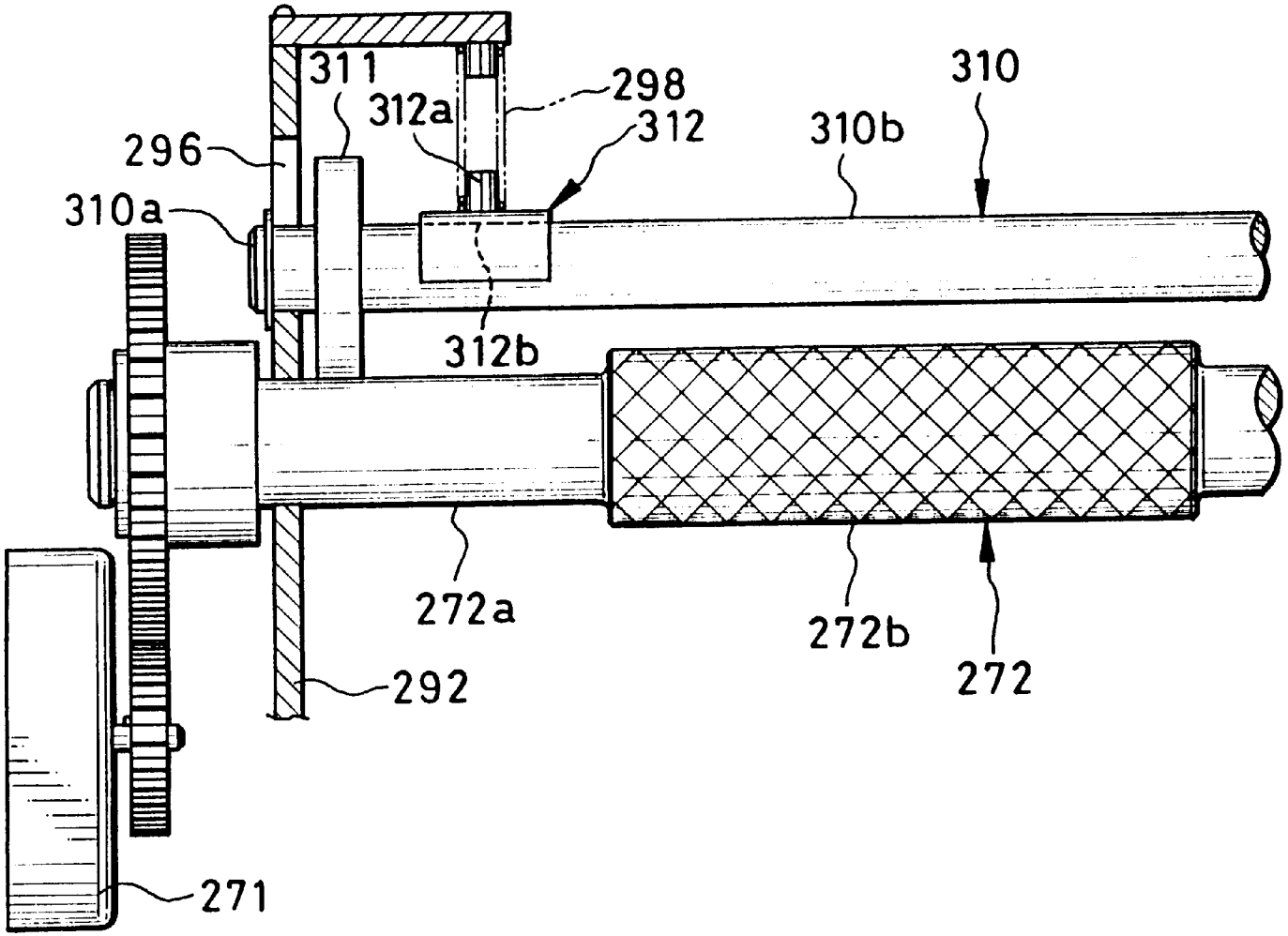
FIG. 32 is a front elevation, partially cutaway, illustrating another preferred conveyor roller set including regulating flange disks.
Figure 33:
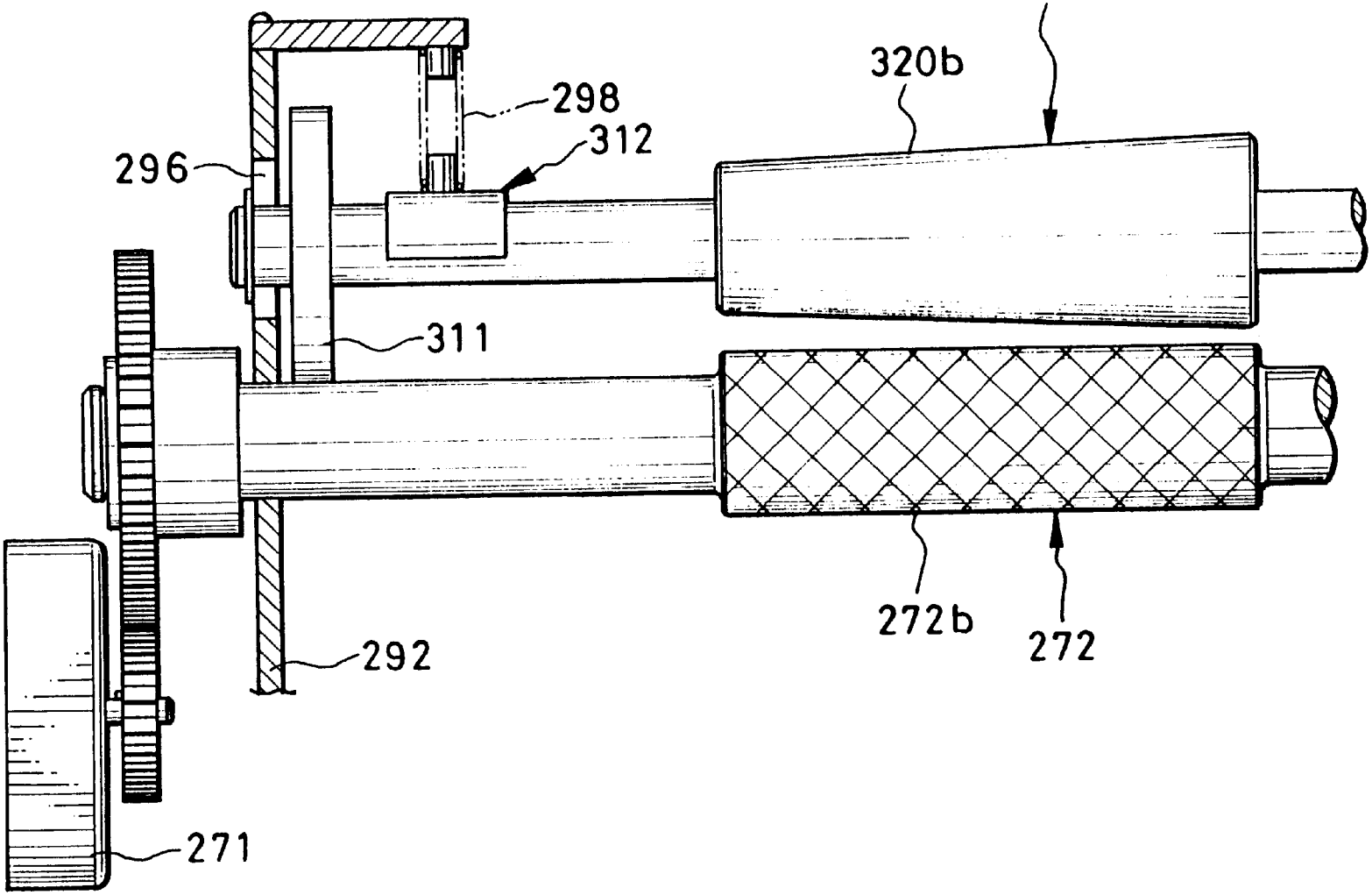
FIG. 33 is a front elevation, partially cutaway, illustrating still another preferred conveyor roller set including a pinch roller having conical portions.

The regulating mechanism is associated with the support plates 292 and 293 according to the above embodiment, but may be associated with a pinch roller. In FIG. 32, a pinch roller 310 has a pair of flange disks 311 respectively disposed on shaft portions 310*a* of the pinch roller 310 by way of a regulating mechanism. The flange disks 311, as viewed in section, have a circular shape coaxial with the shaft portions 310*a*. The periphery of the flange disks 311 contacts the shaft portions 272*a* of the capstan roller 272. The flange disks 311 have such a size that a distance between the roller portion 272*b* and a roller portion 310*b* is smaller than that when the recording sheet 268 is nipped between them. Note that the flange disks 311 can be fixed on the shaft portions 310*a* in a manner rotatable integrally therewith, or may be set rotatable about the shaft portions 310*a*.

In the present embodiment, no receiver member is used for the pinch roller 310. A pair of spring receivers 312 are used for the springs 298 and 299. The spring receivers 312 include a projection 312*a* and a push portion 312*b*. The projection 312*a* enters the inside of the springs 298 and 299. The push portion 312*b* is shaped in a U-shape as viewed in section, and pushes the shaft portions 310*a* of the pinch roller 310. Even when the pinch roller 310 rotates, the spring receivers 312 do not drop from the shaft portions 310*a*.

To nip the recording sheet with those metal members, it is effective to form a knurled surface or roulette surface about the roller portion 272*b* of the capstan roller 272 in manners of a crisscross pattern, a spline pattern, a mesh pattern and a pattern of checkered plate for the purpose of avoiding slips. The knurled surface or roulette surface can be formed by etching or scraping. In the present embodiment, the roller portion 310*b* of the pinch roller 310 has a diameter of the shaft portions 310*a*, to reduce a manufacturing cost. Elements in FIG. 32 similar to those of FIG. 29 are designated with identical reference numerals.

To reduce the size of the apparatus and save an amount of the material, it is preferable to reduce the diameter of the pinch roller. The pinch roller is constructed in a manner deformable when it nips the recording sheet. Upon this deformation, a roller portion of the pinch roller is deformed and curved, and thus fails to nip the recording sheet in a uniform manner. There occurs failure of obliqueness in conveying the recording sheet. In view of this, a preferred embodiment of FIG. 33 has a pinch roller 320 of which a curved surface 320*b* of a roller portion has a partial shape of a cone of which the center as viewed in the axial direction has a greater diameter.

Figure 34:
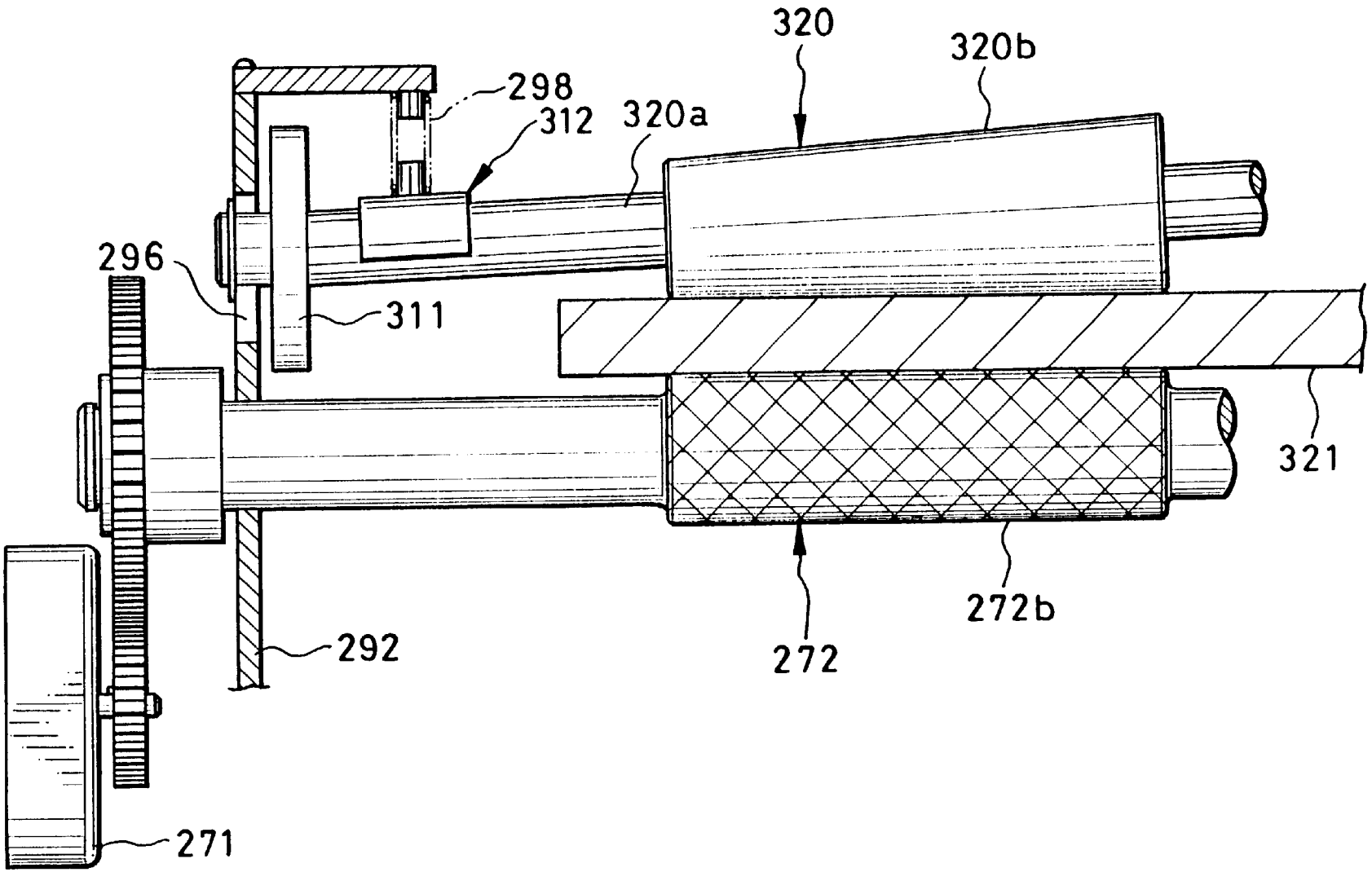
FIG. 34 is a front elevation, partially cutaway, illustrating the conveyor roller set of FIG. 33 but in a state during nipping the recording sheet.

When shaft portions 320*a* of the pinch roller 320 are bent as illustrated in FIG. 34, the surface of the curved surface 320*b* of the pinch roller 320 becomes parallel with the roller portion 272*b* of the capstan roller 272, so that recording material or sheet 321 can be nipped in a uniform manner.

Figure 35:
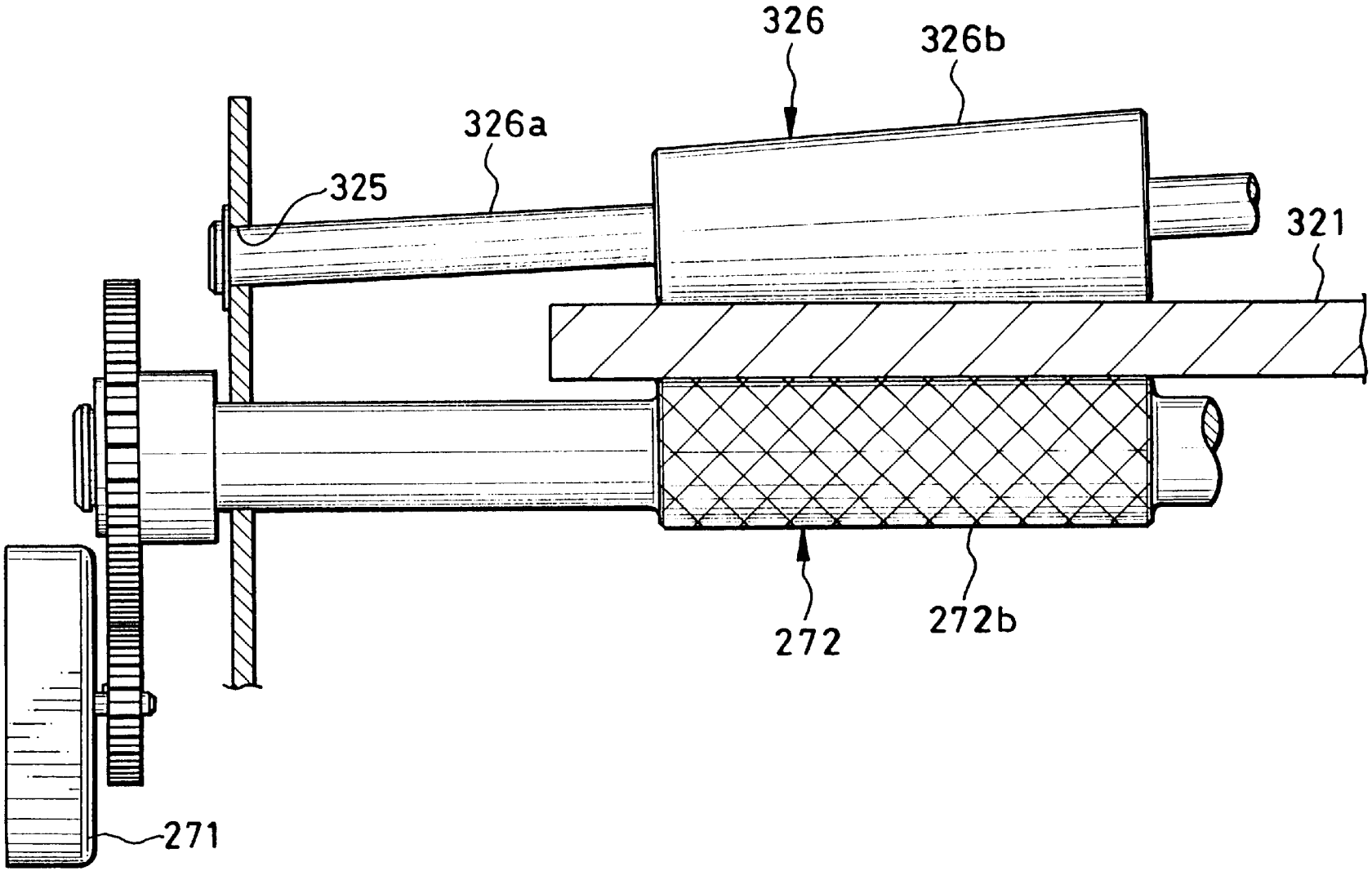
FIG. 35 is a front elevation, partially cutaway, illustrating a further preferred conveyor roller set in which shaft portions of a pinch roller operate in a resilient manner.

When the curved surface 320*b* of the pinch roller 320 has the shape of the cone, it is possible to omit the spring as bias mechanism while shaft portions of the pinch roller are provided with a small diameter in a resiliently deformable manner. In FIG. 35, holes 325 are used simply to support shaft portions 326*a* of a pinch roller 326. The slots 296 and 297 are omitted in the support plates 292 and 293. Resiliency of the pinch roller 326 keeps a curved surface 326*b* of its roller portion in contact with the recording sheet 321. After the recording sheet 321 is passed, the shaft portions 326*a* recover their original shape. The space between the capstan roller 272 and the pinch roller 326 in its original shape depends on the position of the holes 325.

Note that the roller portions of the rollers may be formed from rubber, plastics or the like and may be fitted about metal shafts. In the final group of the preferred embodiments, the thermal printer is the direct thermal printing type. Furthermore a thermal printer in the present invention may be a thermal transfer type. Also a monochromatic thermal printer may be used. Instead of a thermal printer, the present conveyor device can be incorporated in a laser printer, an ink jet printer, a dot printer, a duplicating machine, a telefacsimile machine, and other machines in which recording sheet is conveyed at a regular speed while an image is printed on it.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer for recording an image to thermosensitive recording material, said thermal printer including a conveyor for conveying said recording material along a conveying path, a thermal head for thermally recording said image to said recording material being conveyed, and a fixer lamp for applying electromagnetic rays of a predetermined range of wavelength to said recording material being conveyed, for optically fixing said recording material, said thermal printer comprising:

a printer casing, having a box shape of which a height is small, and including a front face oriented substantially vertically to a direction of said height, and a rear face opposite to said front face;

an insertion opening, formed in said front face, and adapted to insertion of said recording material therethrough before said recording, and ejection of said recording material therethrough after said recording;

an air inlet and an air outlet, formed in said front face, said insertion opening being disposed between said air inlet and said air outlet;

an air passageway, disposed in said printer casing, for communicating from said air inlet to said air outlet via at least a portion of said conveying path; and a fan unit, disposed in said air passageway, for causing air from said air inlet to flow along said air passageway, to cause heat generated in said printer casing to exit from said air outlet.

2. A thermal printer as defined in claim 1, further comprising a partition, disposed to extend along said conveying path, for defining first and second portions of said air passageway on respective sides thereof by partitioning an inside of said printer casing, said first portion extending from said air inlet, and said second portion communicating with said first portion at an edge of said partition, and extending to said air outlet.

3. A thermal printer as defined in claim 2, wherein said partition includes:

a front guide plate, extended from said insertion opening to said thermal head along said conveying path, for supporting said recording material being conveyed;

a bracket for supporting said thermal head; and a rear guide plate, extended from said thermal head toward said rear face of said printing casing along said conveying path, for supporting said recording material being conveyed, wherein said second portion of said air passageway communicates with said first portion at a rear edge of said rear guide plate.

4. A thermal printer as defined in claim 2, wherein said air inlet is disposed above said insertion opening, and said air outlet is disposed below said insertion opening.

5. A thermal printer as defined in claim 4, wherein said recording material includes a support, and at least first, second and third thermosensitive coloring layers, overlaid on said support, for developing respective colors being different from one another, wherein said first coloring layer is disposed at a recording surface, said third coloring layer is disposed most deeply from said recording surface, and said first and second coloring layers have fixability to electromagnetic rays of respectively first and second ranges of wavelength;

wherein said fixer lamp comprises:

a first fixer lamp, having a long shape, disposed to extend crosswise to conveyance of said recording material, for emitting electromagnetic rays of said first range of wavelength; and a second fixer lamp, having a long shape, disposed so that said first fixer lamp is disposed between said second fixer lamp and said thermal head, extended substantially in parallel with said first fixer lamp, for emitting electromagnetic rays of said second range of wavelength.

6. A thermal printer as defined in claim 5, wherein said fan unit comprises a cross flow fan, and disposed at a bottom of said rear edge of said rear guide plate.

7. A thermal printer as defined in claim 5, further comprising a plurality of first heat dissipator fins, disposed on said bracket to project into said air passageway.

8. A thermal printer as defined in claim 7, wherein said air outlet comprises a plurality of air sub-outlets;

further comprising a plurality of second heat dissipator fins, disposed on an end portion of said bracket to project toward an outside of said air sub-outlets.

9. A thermal printer as defined in claim 8, wherein said conveyor includes a conveyor roller set for nipping said recording material, conveying said recording material plural times in a first direction and a second direction reverse to said first direction, subjecting said recording material plural times to said thermal recording and said optical fixation, to record said full-color image by three-color frame-sequential manner.

10. A thermal printer as defined in claim 9, wherein said fixer lamps and said conveyor roller set are disposed between said insertion opening and said thermal head.

11. A thermal printer as defined in claim 5, further comprising two lateral plates, disposed in said printer casing substantially in parallel with each other, said fixer lamps being so extended that distal ends thereof are disposed beyond outer sides of said lateral plates, wherein said lateral plates exclude said distal ends from confrontation with said recording material for applying said electromagnetic rays in a uniformed manner, wherein a platen member, said thermal head and said conveyor roller set are disposed between said lateral plates.

12. A thermal printer as defined in claim 11, wherein each of said fixer lamps has a U-shape including first and second portions, disposed substantially in parallel with each other, and extended crosswise to said conveying path.

13. A thermal printer as defined in claim 11, wherein each of said fixer lamps includes one end bent in an L-shape substantially in parallel with conveyance of said recording material, to have an increased length containable in a given space.

14. A thermal printer as defined in claim 13, further comprising a drive unit for driving said conveyor roller set, said drive unit being disposed at least partially between an inside of said printer casing and one of said lateral plates opposite to said bent end of said fixer lamps.

15. A thermal printer as defined in claim 14, wherein said drive unit includes:

a stepping motor, disposed under said rear guide plate and between said lateral plates; and a gear train, disposed between said inside of said printer casing and said one of said lateral plates, for transmitting rotation of said stepping motor to said conveyor roller set.

16. A thermal printer as defined in claim 1, wherein said printer casing has a size insertable in a bay of a personal computer of a tower type.

* * * * *

UNITED STATES PATENT AND TRADEMARK OFFICE

CERTIFICATE OF CORRECTION

PATENT NO. : 6,344,869 B2
DATED : February 5, 2002
INVENTOR(S) : Hidemi Sasaki et al.

It is certified that error appears in the above-identified patent and that said Letters Patent is hereby corrected as shown below:

Title page,
Item [30], Foreign Application Priority Data, please change "Jan. 7, 1997 (JP)…….. 9-025163" to -- Feb. 7, 1997 (JP)……..9-025163 --.

Signed and Sealed this

Fourth Day of June, 2002

*Attest:*

*Attesting Officer*

JAMES E. ROGAN
*Director of the United States Patent and Trademark Office*